US006289190B1

(12) United States Patent
Amamiya et al.

(10) Patent No.: US 6,289,190 B1
(45) Date of Patent: Sep. 11, 2001

(54) ELECTROPHOTOGRAPHIC APPARATUS AND PROCESS CARTRIDGE

(75) Inventors: Shoji Amamiya, Numazu; Akio Maruyama, Tokyo; Yukio Nagase, Shizuoka-ken; Toshihiro Kikuchi; Koichi Suzuki, both of Yokohama; Harumi Ishiyama, Numazu, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/389,584

(22) Filed: Sep. 3, 1999

(30) Foreign Application Priority Data

Sep. 4, 1998 (JP) ..... 10-251158
Sep. 4, 1998 (JP) ..... 10-251159
Sep. 4, 1998 (JP) ..... 10-251160
Sep. 4, 1998 (JP) ..... 10-251162

(51) Int. Cl.[7] ..... G03G 15/02
(52) U.S. Cl. ..... 399/174; 430/58.05
(58) Field of Search ..... 430/58.05; 399/174

(56) References Cited

U.S. PATENT DOCUMENTS

| | | | | |
|---|---|---|---|---|
| 4,877,701 | * | 10/1989 | Hiro et al. | 430/58.05 |
| 5,241,342 | | 8/1993 | Asano et al. | 355/219 |
| 5,332,635 | | 7/1994 | Tanaka | 430/96 |
| 5,579,095 | | 11/1996 | Yano et al. | 355/219 |
| 5,606,401 | | 2/1997 | Yano et al. | 355/219 |
| 5,701,571 | | 12/1997 | Amamiya et al. | 399/343 |
| 5,754,927 | | 5/1998 | Ishiyama et al. | 399/176 |
| 5,822,659 | | 10/1998 | Ishiyama | 399/175 |
| 6,038,418 | * | 3/2000 | Chigono et al. | 399/174 |

FOREIGN PATENT DOCUMENTS

| | | | | |
|---|---|---|---|---|
| 63-149669 | | 6/1988 | (JP) . | |
| 5-113677 | * | 5/1993 | (JP) | 430/58.05 |
| 6-3921 | | 1/1994 | (JP) . | |
| 7-99442 | | 10/1995 | (JP) . | |

OTHER PUBLICATIONS

Patent Abstracts of Japan, vol. 009, No. 054 (P–340) Mar. 8, 1985 (JP–59 191044).
Patent Abstracts of Japan, vol. 15, No. 300 (P–1232), Jul. 30, 1991 (JP–03 103878).

* cited by examiner

*Primary Examiner*—Mark Chapman
(74) *Attorney, Agent, or Firm*—Fitzpatrick, Cella, Harper & Scinto

(57) ABSTRACT

An electrophotographic apparatus includes an electrophotographic photosensitive member; a charger for charging the electrophotographic photosensitive member including a charging member supplied with a voltage and disposed in contact with the photosensitive member so as to form a nip with the photosensitive member to charge the photosensitive member; an exposure device; a developing device; and a transfer device. The photosensitive member includes a surface layer containing a charge-transporting material having an oxidation potential of 0.4–1.0 volt. Charging promoter particles are present at the nip between the photosensitive member and the charging member to injection-charge the photosensitive member. Because of the selection of the charge-transporting material and the presence of the charging promoter particles, the photosensitive member can be effectively injection-charged.

56 Claims, 9 Drawing Sheets

ELECTROPHOTOGRAPHIC APPARATUS AND PROCESS CARTRIDGE

FIELD OF THE INVENTION AND RELATED ART

The present invention relates to an electrophotographic apparatus and a process cartridge, more particularly an electrophotographic apparatus and a process cartridge using a specific electro-photographic photosensitive member to be charged in a specific charging system.

Prior to the present invention, a corona-type charger (corona discharging device) has been widely used as a charging apparatus for charging (inclusive of discharging) an image bearing member (object to be charged) such as an electrophotographic photosensitive member or an electrostatic dielectric recording member to a predetermined polarity and a predetermined potential level in an image forming apparatus, for example, an electrophotographic apparatus (copying machine, printer, or the like) or an electrostatic recording apparatus.

The corona-type charging device is a noncontact-type charging device, and comprises a corona-discharging electrode such as a wire electrode, and a shield electrode, which surrounds the corona-discharging electrode. It is disposed so that the corona-discharging opening thereof faces an image-bearing member, that is, an object to be charged. In usage, the surface of an image bearing-member is charged to a predetermined potential level of a prescribed polarity by being exposed to discharge current (corona shower) generated as high voltage is applied between the corona-discharging electrode and the shield electrode.

In recent years, it has been proposed to employ a contact-type charging apparatus as a charging apparatus for charging the image bearing member, that is, the object to be charged, in an image forming apparatus of low to medium speed. This is due to the fact that a contact-type charging apparatus has an advantage over a corona-type charging apparatus in terms of low ozone production, low power consumption, and the like. Also, such a contact-type charging apparatus has been put to practical use.

In order to charge an object, such as an image bearing member, with the use of a contact-type charging apparatus, the electrically conductive charging member (contact-type charging member, contact-type charging device, or the like) of a contact-type apparatus is placed in contact with the object to be charged, and an electrical bias (charge bias) of a predetermined level is applied to this contact-type charging member so that the surface of the object to be charged is charged to a predetermined polarity and a predetermined potential level. The charging member is available in various forms, for example, a roller type (charge roller), a fur brush type, a magnetic brush type, a blade type, and the like.

In reality, when an object is electrically charged by a contact-type charging member, two types of charging mechanisms (charging mechanism or charging principle: (1) mechanism that discharges electrical charge, and (2) mechanism for injecting charge) come into action. Thus, the characteristics of each of the contact-type charging apparatuses or methods are determined by the charging mechanism that is the dominant one of the two in charging the object.

In an electrical discharge-based charging mechanism, the surface of an object to be charged is charged by electrical discharge that occurs across a microscopic gap between a contact-type charging member and the object to be charged. In the case of the electrical discharge based charging mechanism, there is a threshold voltage that must be surpassed by the charge bias applied to a contact-type charging member before electrical discharge occurs between a contact-type charging member and an object to be charged, and therefore, in order for an object to be charged through the electrical discharge based charging mechanism, it is necessary to apply to the contact-type charging member a voltage with a value greater than the value of the potential level to which the object is to be charged. Thus, in principle, when the electrical-discharge based charging mechanism is in action, it is impossible to avoid generating by-produce of electrical discharge, that is, active ions, such as ozone ions. In reality, even a contact-type charging apparatus charges an object partially through the electrical charge discharging mechanism as described above, a contact-type charging apparatus cannot completely eliminate the problems caused by the active ions, such as ionized ozone.

In a direct charge injection mechanism, the surface of an object to be charged is charged as an electrical charge is directly injected into the object to be charged, with the use of a contact-type charging member. Thus, this mechanism is called "direct charging mechanism", or "charge injection mechanism". More specifically, a contact-type charging member with medium electrical resistance is placed in contact with the surface of an object to be charged to directly inject electrical charge into the surface portion of an object to be charged, without relying on electrical discharge, in other words, without using electrical discharge in principle. Therefore, even if the value of the voltage applied to a contact-type charging member is below the discharge starting voltage value, the object to be charged can be charged to a voltage level that is substantially the same as the level of the voltage applied to the contact-type charging member.

This direct injection-charging mechanism does not suffer from the problems caused by the by-product of electrical discharge, since it is not accompanied by ozone production. However, in the case of this charging mechanism, the state of contact between a contact-type charging member and an object to be charged greatly affects the manner in which the object is charged, since this charging mechanism is such a mechanism that directly charges an object. Thus, this direct-injection charging mechanism should comprise a contact-type charging member composed of high density material, and also should be given a structure that provides a large speed difference between the charging member and the object to be charged, so that a given point on the surface of the object to be charged makes contact with a larger area of the charging member.

Representative contact charging systems proposed heretofore include those of (A)–(C) described below.

(A) Charging with Charge Roller

In the case of a contact-type charging apparatus, a roller charge system, that is, a charging system that employs an electrically conductive roller (charge roller) as a contact-type charging member, is widely used because of its desirability in terms of safety.

As for the charging mechanism in this roller charge system, the aforementioned discharge-based charging mechanism is dominant. Charge rollers are formed of rubber or foamed material with substantial electrical conductivity, or electrical resistance of a medium level. In some charge rollers, the rubber or foamed material layer is included in a laminate structure to obtain a specific characteristic In order to maintain stable contact between a charge roller and an object to be charged (hereinafter, "photosensitive member"), a charge roller is given elasticity, which in turn increases the frictional resistance between the charge roller and the photosensitive member. Also, in many cases, a charge roller is rotated by the rotation of a photosensitive drum, or is individually driven at a speed slightly different from that of the photosensitive drum. As a result, the state of the contact between the charge roller and the photosensitive drum becomes less desirable, and the dominant charging mechanism has been one of the discharge-based charging.

FIG. 10 is a graph that shows examples of efficiency according to several contact charging means. In the graph, the abscissa represents the bias voltage applied to the contact charging means, and the ordinate represents the potential levels corresponding to the voltage values of the bias applied to the contact charging means. The characteristics of the charging by a charge roller are represented by a line designated by a character A. According to this line, when a charge roller is used to charge an object, the charging of an object occurs in a voltage range above an electric discharge threshold value of approximately −500 V. Therefore, generally, in order to charge an object to a potential level of −500 V with the use of a charge roller, either a DC voltage of −1,000 V is applied to the charge roller, or an AC voltage with a peak-to-peak voltage of 1,200 V, in addition to a DC voltage of −500 V, is applied to the charge roller to keep the difference in potential level between the charge roller and the object to be charged, at a value greater than the electric discharge threshold value, so that the potential of the photosensitive drum converges to the desired potential level.

More specifically, in order to charge a photosensitive drum with a 25 $\mu$m-thick organic photoconductor layer by pressing a charge roller upon the photosensitive member, a charge bias voltage of approximately 640 V or higher should be applied to the charge roller. Where the charge bias voltage is approximately 640 V or higher, the potential level at the surface of the photosensitive member is proportional to the level of the voltage applied to the charge roller; the relationship between the potential level and the voltage applied to the charge roller is linear. This threshold voltage is defined as a charge start voltage $V_{th}$.

In other words, in order to charge the surface of a photosensitive member to a potential level of $V_d$, which is necessary for electrophotography, a DC voltage of $(V_d+V_{th})$, which is higher than the voltage level to which the photosensitive member is to be charged, is necessary. Hereinafter, the above described charging method, in which only DC voltage is applied to a contact-type charging member to charge an object, will be called "DC charging method".

However, prior to the present invention, even with the use of the DC charging method, it was difficult to bring the potential level of a photosensitive member exactly to a target level, since the resistance value of a contact charging member changed due to changes in ambience or the like, and also the threshold voltage $V_{th}$ changed as the photosensitive member was shaved away.

As for a counter measure for the above described problem, Japanese Laid-Open Patent Application No. (JP-A) 63-149669 discloses an invention that deals with the above problem to effect more uniform charging of a photosensitive member. According to this invention, an "AC charging method" is employed, in which a compound voltage composed of a DC component equivalent to a desired potential level $V_d$, and an AC component with a peak-to-peak voltage that is twice the threshold voltage $V_{th}$, is applied to a contact-type charging member. This invention is intended to utilize the averaging effect of alternating current. According to this invention, the potential of an object to be charged is caused to converge to the $V_d$, that is, the center of the peaks of the AC voltage, without being affected by external factors, such as operational ambience.

However, even in the case of the contact-type charging apparatus in the above-described JP reference, the principal charging mechanism is a discharge-based charging. Therefore, as already described, the voltage applied to the contact-type charging member needs to have a voltage level higher than the voltage level to which the photosensitive member is to be charged. Thus, ozone is generated, although only in a small amount.

Further, when AC current is used so that an object is uniformly charged due to the averaging effect of AC current, the problems related to AC voltage become more conspicuous. For example, more ozone is generated; noises traceable to the vibration of the contact-type charging member and the photosensitive drum caused by the electric field of AC voltage increase; the deterioration of the photosensitive member surface caused by electrical discharge increases, which add to the prior problems.

(B) Charging with Fur Brush

In the case of this charging apparatus, a charging member (fur brush type charging device) with a brush portion composed of electrically conductive fiber is employed as the contact-type charging member. The brush portion composed of electrically conductive fiber is placed in contact with a photosensitive member as an object to be charged, and a predetermined charge bias is applied to the charging member to charge the peripheral surface of the photosensitive member to a predetermined polarity and a predetermined potential level.

Also, in the case of this charging apparatus with a fur brush, the dominant charging mechanism is the discharge-based charging mechanism.

It is known that there are two type of fur-brush-type charging devices: a fixed type and a roller type. In the case of the fixed type, fiber with medium electrical resistance is woven into foundation cloth to form pile, and a piece of this pile is adhered to an electrode. In the case of. the rotatable type, the pile is wrapped around a metallic core. In terms of fiber density, pile with a density of 100 fiber/cm$^2$ can be relatively easily obtained, but the density of 100 fiber/cm$^2$ is not sufficient to create a state of contact that is satisfactory to charge an object by charge injection. Further, in order to give a photosensitive member a satisfactorily uniform charge by charge injection a velocity difference which is almost impossible to attain with the use of a mechanical structure must be established between a photosensitive drum and a roller-type fur brush.

The relationship between the DC voltage applied to a fur-brush-type charging member and the potential level to which a photosensitive member is charged by the DC voltage applied to the fur brush shows a characteristic represented by a line B in FIG. 10. As is evident from the graph, also in the case of the contact-type charging apparatus, which comprises a fur brush, whether the fur brush is of the fixed type or the roller type, the photosensitive member is charged mainly through electrical discharge triggered by applying to the fur brush a charge bias the voltage level of which is higher than the potential level desired for the photosensitive member.

(C) Magnetic Brush Charging

A charging apparatus of this type comprises a magnetic brush (magnetic brush based charging device) as the contact-type charging member. A magnetic brush is constituted of electrically conductive magnetic particles magnetically confined in the form of a brush by a magnetic roller or the like. This magnetic brush portion is placed in contact with a photosensitive member as an object to be charged, and a predetermined charge bias is applied to the magnetic brush to charge the peripheral surface of the photosensitive member to a predetermined polarity and a predetermined potential level.

In the case of this magnetic brush type charging apparatus, the charge injection mechanism can be predominant.

As for the material for the magnetic brush member, electrically conductive magnetic particles of a small diameter may be used. With the provision of a sufficient difference in peripheral velocity between a photosensitive drum and a magnetic brush, the photosensitive member can be uniformly charged through charge injection. In the case of a magnetic-brush-type charging apparatus, the photosensitive member is charged to a potential level that is substantially equal to the voltage level of the bias applied to the contact type charging member, as shown by a line C in FIG. 10.

However, a magnetic-brush-type charging apparatus also has its own problems. For example, it is complicated in structure. Also, the electrically conductive magnetic particles that constitute the magnetic brush member are liable to be separated from the magnetic brush and adhere to a photosensitive member.

In addition to the above-described representative contact charging processes, Japanese Patent Publication (JP-B) 7-99442 discloses a contact charging apparatus including a contact charging member on which powder is applied. In the contact charging apparatus, the powder is present at a contact boundary between the contact charging member and the surface of the object to be charged so as to prevent charge irregularity and allow uniform charging. The contact charging member is rotated following the rotation of the object to be charged, and the generation of ozone adducts is remarkably reduced than in a corona charger, such as a scorotron, but the charging mechanism is still principally based on discharging. Particularly, the superposition of an AC voltage on a DC voltage for providing stabler charging uniformity, promotes the generation of ozone adducts due to discharging. As a result, in case where the apparatus is used for a long period, particularly in an image forming apparatus of the cleaner-lens type, difficulties caused by ozone adducts, such as image flow in the resultant images, are liable to be caused.

On the other hand, some proposals have been made for promoting the injection charging by modification of electrophotographic photosensitive members. For example, JP-A 6-3921 discloses a contact-type charging method, according to which a photosensitive member is charged by injecting electric charge into the charge injectable surface layer thereof, more specifically, into the traps or electrically conductive particles in the charge injectable surface layer. Since this method does not rely on electrical discharge, the voltage level necessary to charge the photosensitive member to a predetermined potential level is substantially the same as the potential level to which the photosensitive member is to be charged, and in addition, no ozone is generated Further, if AC voltage is not applied, the occurrence of noise attributable to the application of AC voltage can be obviated Accordingly, the infection charging system is an excellent charging system superior to the roller-type charging system in terms of ozone generation and power consumption.

However, the injection charging scheme requires a photosensitive member including a charge injection surface layer containing electroconductive fine particles, of, e.g., $SnO_2$ doped with antimony, indium, etc., on an ordinary photosensitive layer, thus resulting in a lower production efficiency and a higher production cost. Further, the inclusion of electroconductive fine particles is liable to make difficult the control of resistivity change due to an environmental charge.

Further, in recent years, many proposals have been made regarding a system in which a waste toner is not allowed to be disposed out of an electrophotographic apparatus, which is generally called a toner recycling process (or a cleanerless system). For example, in the conventional transfer-type image forming apparatus, a transfer residual toner remaining on a photosensitive member (image-bearing member) after the toner image transfer is removed by a cleaner (i.e., a cleaning device) from the photosensitive member surface to be a waste toner. In the toner recycling process, however, the cleaner is removed, and the transfer residual toner remaining on the photosensitive member after image transfer is removed from the photosensitive member by the developing device and retained therein for reuse, thus realizing "simultaneous developing and cleaning".

More specifically, the toner that remains on a photosensitive member after image transfer is recovered by fog removal bias (voltage level difference $V_{back}$ between the level of the DC voltage applied to a developing device and the level of the surface potential of a photosensitive member) during the following image transfer. According to this cleaning method, the residual toner is recovered by the developing device and is used for the following image development and thereafter the waste toner is eliminated. Therefore, the labor spent for maintenance is reduced. Further, being cleanerless is quite advantageous in terms of space, allowing image forming apparatuses to be substantially reduced in size, in addition to the preferableness from the environmental viewpoint.

As mentioned above, it is difficult to effect injection charging of an object with the use of a contact-type charging apparatus with a simple structure that comprises a contact-type charging member such as a charge roller or a fur brush. Also, in the case of an image forming apparatus that employs such a charging apparatus, the photosensitive member is liable to be insufficiently charged, causing images to appear foggy (during reversal development, toner is adhered to the areas which are supposed to remain white), or the photosensitive member is liable to be nonuniformly charged, causing the image to be appear irregular in terms of continuity.

In the case of the contact-type charging apparatus structured so that the contact-type charging member is coated with electrically conductive powder, on the surface that comes in contact with the surface of the object to be charged, so that the contact-type charging member is rotated by the rotation of the photosensitive member, and so that the photosensitive member is mainly charged by electrical discharge, ozonic products are liable to be accumulated, and images are affected by the accumulated ozonic products, appearing as if flowing, when such a charging apparatus is used for an extended period of time, In particular, when such a charging apparatus is used in a cleanerless image forming apparatus for an extended period of time. Further, in the contact charging system, it is necessary to effect a sufficient contact between the object to be charged and the charging member, and some problems have been encountered as follows regarding the contact.

a) In the case of using a fur brush (charging brush) as a contact charging member, tips composed of electroconductive fiber or yarn 2*b* and connected to an electrode 2*a* of a charging brush 2 become divergent as shown in FIG. 9 to result in a portion of the object surface 1 failing to contact the brush, thus failing to uniformly charge the object surface. Incidentally, the electrode 2*a* of the charging brush 2 is connected to a charging bias voltage supply S1.

b) In the case of using a magnetic brush as a contact charging member, if the charger magnetic particles are reduced in size so as to improve the contact, the magnetic particles are liable to attach onto the object surface. On the other hand, if the charger magnetic particles are enlarged in size so as to exert a sufficient magnetic constraint force, the magnetic particles and the object contact each other less resulting in lower injection-charging performance.

c) It has been also proposed to apply or mix supplementary electroconductive magnetic fine particles onto or into the charging member, but in this case, it has been noted that the magnetic fine particles are attached onto the object to be charged to be consumed, during an extended period of use.

SUMMARY OF THE INVENTION

An object of the present invention is to provide an electrophotographic apparatus capable of realizing injection charging which is excellent in charging uniformity and stable during a long period of use.

Another object of the present invention is to provide an electrophotographic apparatus capable of realizing injection charging operable at a low voltage and free from ozone generation with a simple structure and at a low cost.

Another object of the present invention is to provide an electrophotographic apparatus capable of well injection-charging a photosensitive member and providing very high-quality images free from image defects attributable to deficiencies in charge injection performance, such as a positive ghost and black streaks in halftone images.

A further object of the present invention is to provide a process cartridge including relevant parts of such an electrophotographic apparatus.

According to the present invention, there is provided an electrophotographic apparatus, comprising:

an electrophotographic photosensitive member; charging means for charging the electrophotographic photosensitive member including a charging member supplied with a voltage and disposed in contact with the photosensitive member so as to form a nip with the photosensitive member to charge the photosensitive member; exposure means; developing means; and transfer means; wherein the photosensitive member includes a surface layer containing a charge-transporting material having an oxidation potential of 0.4–1.0 volt, and charging promoter particles are present at the nip between the photosensitive member and the charging member to injection-charge the photosensitive member.

According to the present invention, there is also. provided a process cartridge, comprising the above-mentioned electrophotographic photosensitive member and the charging member integrally supported to provide an apparatus unit that is detachably mountable to a main assembly of electrophotographic apparatus.

These and other objects, features and advantages of the present Invention will become more apparent upon a consideration of the following description of the preferred embodiments of the present invention taken in conjunction with the accompanying drawings.

DETAILED DESCRIPTION OF THE INVENTION

Figure 1:
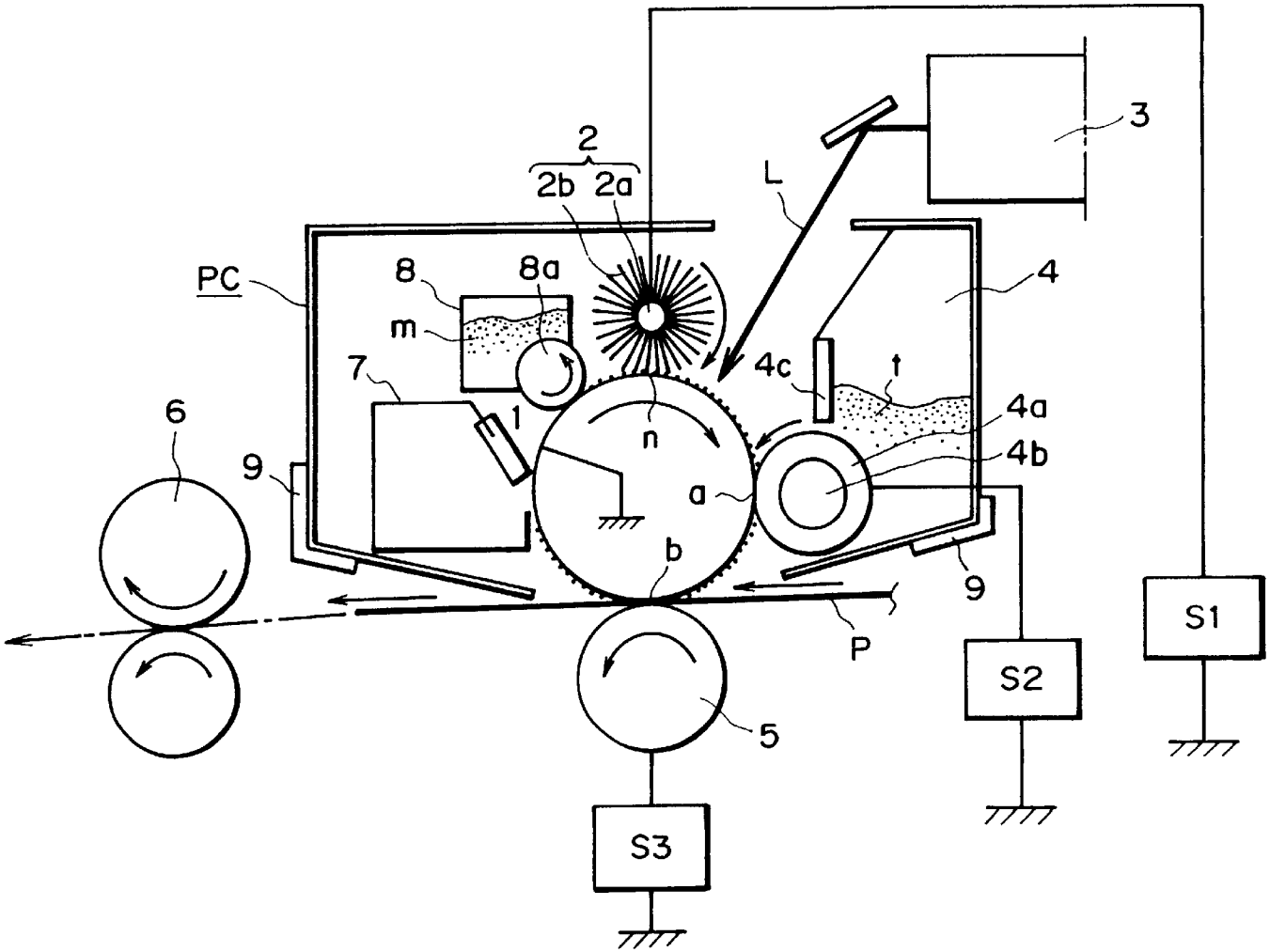
FIG. 1 is a schematic illustration of an embodiment of the electrophotographic apparatus according to the invention including a fur brush charging means and a cleaning device.

The structure of the electrophotographic photosensitive member used in the present invention will now be described in detail.

The photosensitive member may be any of a single layer-type including a single photosensitive layer and a laminate-type, including layers separately in charge of charge generation and charge transportation, respectively disposed on an electroconductive substrate, for example, including the following:

(1) a layer containing a charge-generating material/a layer containing a charge-transporting material, (2) a layer containing a charge-generating material and a charge-transporting material, (3) a layer containing a charge-generating material/a layer containing a charge-generating material and a charge-transporting material, wherein "/" represents lamination.

It is possible to dispose an undercoating layer having a barrier function and/or an adhesive function between the electroconductive support and the photosensitive layer. Among these, the lamination-type structures ((1) and (3) in the above) including a charge generation layer and a charge transport layer disposed In this order on an electroconductive substrate, are particularly preferred in view of sensitivity and durability.

Hereinbelow, a process for producing such a photosensitive member will be described with particular reference to a function separation-type one including a laminate of a charge generation layer and a charge transport layer.

The electroconductive support may have any of the following forms.

(1) a planar sheet or a drum of a metal, such as aluminum, aluminum alloy, stainless steel or copper;

(2) a non-electroconductive support of glass, resin, paper, etc., or an electroconductive support of (1) above, further coated with a film of aluminum, palladium, rhodium, gold or platinum by vapor deposition or lamination; and (3) a non-electroconductive support of glass, resin, paper, etc., or an electroconductive support of (1) above, further coated with a layer of electroconductive polymer, or an electroconductive compound, such as tin oxide or indium oxide, by vapor deposition or application.

Examples of the charge-generating material may include the following that may be used singly or in combination of two or more species:

(1) azo pigment inclusive of monoazo, disazo and trisazo pigments;

(2) indigo pigments inclusive of indigo and thioindigo pigments;

(3) phthalocyanines inclusive of metallic phthalocyanines and non-metallic phthalocyanines;

(4) perylene pigments inclusive of perylene-carboxylic anhydride and perylene-carboxylic acid imide;

(5) polycyclic quinone pigments, such as anthraquinone and pyrenequinane pigments;

(6) squalylium dyes;

(7) pyrylium salts and thiopyrylium salts;

(8) triphenylmethane dyes;

(9) inorganic material, such as selenium and amorphous silicon.

The charge generation layer, i.e., a layer containing such a charge-generating material, may be formed by dispersing such a charge-generating material in an appropriate binder and applying the dispersion onto the electroconductive support. It is also possible to form a film of the charge-generating material on the electroconductive support through a dry process, such as evaporation. sputtering or CVD (chemical vapor deposition).

The binder resin may be selected from a wide scope of resins, examples of which may include: polyester resin, butyral resin, polystyrene resin, polyvinyl acetal resin, diallyl phthalate resin, acrylic resin, methacrylic resin, vinyl acetate resin, phenolic resin, silicone resin, polysulfone resin, styrene-butadiene copolymer resin, alkyd resin, epoxy resin, urea resin, and vinylchloride-vinyl acetate copolymer resin These are not however exhaustive. These homopolymers or copolymers may be used singly or in combination of two or more species.

The binder resin may preferably be contained in at most 80 wt. % in the charge generation layer, more preferably in at most 40 wt. %. The charge generation layer may preferably have a thickness of at most 5 $\mu$m, more preferably 0.01–2 $\mu$m. It is also possible to incorporate various sensitizers in the charge generation layer.

The charge transport layer, i.e., a layer containing a charge-transporting material, may be formed as a layer containing a charge-transporting material having an oxidation potential in a range of 0.4–1.0 volt together with an appropriate binder resin. The binder resin may be selected from those enumerated for the charge generation layer. It is also possible to use a photoconductive polymer, such as polyvinylcarbazol or polyvinylanthracene.

The charge-transporting material used in the present invention may comprise a single species of compound or two or more species of compounds in combination. Moreover, while an aromatic cyclic compound having a nitrogen-containing substituent of a specific structure as will be discussed later is preferred, it is also possible to use, such an aromatic cyclic compound in combination with a charge-transporting material of a different structure, examples of which may include pollycyclic aromatic compounds including structures of pyrene and anthracene; heterocyclic compounds, such as carbazoles, indoles, oxazoles, thiazoles, oxadlazoles, pyrazoles, pyrazolines, thiadiazoles, and triazoles; triarylmethane compounds; and polymers having a group derives from such compounds in their main chains or side chains, such as poly-N-vinylcarbazole and polyvinylanthracene.

Such a charge-transporting material may preferably be used in 10–500 wt. parts per 100 wt. parts of the binder resin. The charge transport layer is electrically connected with the above-mentioned charge generation layer and has a function of receiving a charge carrier injected from the charge generation layer and transporting the charge carrier to the surface of the photosensitive member in the presence of an electric field. Regarding the thickness of the charge transport layer, there is a certain limit for capability of transporting charge carrier, thus not allowing an unnecessarily large thickness, and the thickness is preferably in the range of 5–40 $\mu$m, more preferably 10–30 $\mu$m. It is also possible to incorporate an optional additive, such as an anti-oxidant, an ultraviolet absorber or a plasticizer, as desired, in the charge transport layer.

The charge transport layer may be formed by using an appropriate organic solvent together with the charge-transporting material, the binder and optional additive to form a coating liquid, and applying the coating liquid by an appropriate coating method, such as dip coating, spray coating, spinner coating, roller coating, wire bar coating, or blade coating.

For the purpose of effecting stable injection charging under various environmental conditions ranging from low temperature/low humidity to high temperature/high humidity according to the present invention, it is preferred to use at least one species of the charge-transporting materials selected from compounds represented by the following formulae (1)–(7), condensed cyclic hydrocarbon compounds having a group represented by a formula (7a) appearing hereinafter, and condensed heterocyclic compounds having a group represented by the formula (7a) appearing hereinafter:

(1)

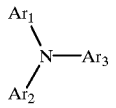

(2)

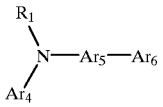

(3)

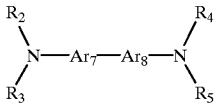

-continued (4)

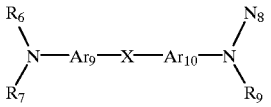

In the above formulae (1)–(4), $Ar_1$–$Ar_4$ and $Ar_6$ independently denote a monovalent aromatic cycle group capable of having a substituent; and $Ar_5$ and $At_7$–$Ar_{10}$ independently denote a divalent aromatic cyclic group capable of having a substituent. $R_1$–$R_9$ independently denote an alkyl group, an aralkyl group, a vinyl group or an aryl group each capable of having a substituent, with the proviso that at least two of $R_2$–$R_5$ and at least two of $R_6$–$R_9$ are respectively monovalent aromatic cyclic groups each capable of having a substituent.

X denotes a divalent group selected from an alkylene group capable of having a substituent, a divalent aromatic cyclic group capable of having a substituent, a group represented by —$CR_{10}$=$CR_{11}$— (wherein $R_{10}$ and $R_{11}$ independently denote an alkyl group capable of having a substituent, a monovalent aromatic cyclic group capable of having a substituent, or a hydrogen atom), —O—, —S—, —CO—, —SO—, —$SO_2$—, —$NR_{12}$— (wherein $R_{12}$ denotes an alkyl group or a monovalent aromatic cyclic group each capable of having a substituent), and an organic group including at least one of oxygen and sulfur atoms.

In the above, each pair of $Ar_1$ and $Ar_2$, $R_1$ and $Ar_4$, $R_2$ and $R_3$, $R_4$ and $R_5$, $R_6$ and $R_7$, or $R_8$ and $R_9$ can be connected with each other directly or via an organic group, such as —$CH_2$—, —$CH_2$—$CH_2$—, —CH=CH—, —O— or —S—, to form a ring; and each pair of $Ar_5$ and $Ar_6$ or $Ar_7$ and $Ar_8$ can form a ring via a divalent organic group, preferred examples of which may include: —O—, —S—, —$SO_2$—, —$NR_{13}$—, —$CR_{14}$=$CR_{15}$— and —$CR_{16}R_{17}$—, wherein $R_{13}$–$R_{17}$ independently denote an alkyl group capable of having a substituent, a monovalent aromatic cyclic group capable of having a substituent or a hydrogen atom.

More specifically, examples of the above-mentioned monovalent aromatic cyclic group include: aromatic hydrocarbon groups, such as phenyl, naphthyl, anthracenyl, and pyrenyl; and aromatic heterocyclic groups, such as pyridyl, quinolyl, thienyl, furyl, carbazolyl, benzimidazolyl, and benzthiazolyl. Examples of the alkylene group include: $C_1$–$C_{10}$ alkylene groups, such as methylene, ethylene, propylene and butylene. Examples of the divalent aromatic cyclic group include: those obtained by subtracting two hydrogen atoms from aromatic hydrocarbons, such as benzene, naphthalene, anthracene and pyrene, and aromatic heterocyclic rings, such as pyridine, quinoline, thiophene and furan. Examples of the alkyl group include: methyl, ethyl, propyl, butyl and hexyl. Examples of the aralkyl group include: benzyl, phenetyl, naphthylmethyl and furfuryl.

Furthers examples of the substituent optionally possessed by the above-mentioned groups may include: alkyl groups, such as methyl, ethyl, propyl, butyl and hexyl; alkoxy groups, such as methoxy, ethoxy and butoxy; halogen atoms, such as fluorine, chlorine, bromine and iodine; acyl groups, such as acetyl and benzolyl; alkylamino groups, such as dimethylamino; haloalkyl groups, such as trifluoromethyl; cyano group, nitro group, phenylcarbamoyl group, and hydroxyl group.

Compounds represented by the formulae (2)–(4) wherein $R_1$–$R_9$ are all monovalent aromatic cyclic groups, are particularly preferred.

(5)

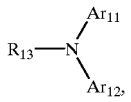

wherein $Ar_{11}$ and $Ar_{12}$ independently denote a monovalent aromatic cyclic group capable of having a substituent, and $R_{13}$ denotes an alkyl group, an aralkyl group or a monovalent aromatic cyclic group each capable of having a substituent with the proviso that at least one of $Ar_{11}$, $Ar_{12}$ and $R_{13}$ has at least one substituent represented by the following formula (5a):

(5a)

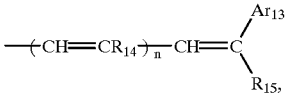

wherein $R_{14}$ and $R_{15}$ independently denote an alkyl group, an aralkyl group or a monovalent aromatic cyclic group each capable of having a substituent; $Ar_{13}$ denotes a monovalent aromatic cyclic group capable of having a substituent; and n is an integer of 0–2.

(6)

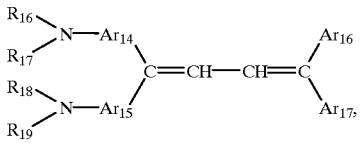

wherein $Ar_{14}$ and $Ar_{15}$ independently denote a divalent aromatic cyclic group capable of having a substituent; $Ar_{16}$ and $Ar_{17}$ independently denote a monovalent aromatic cyclic group capable of having a substituent; and $R_{16}$–$R_{19}$ independently denote an alkyl group, an aralkyl group or a monovalent aromatic cyclic group each capable of having a substituent.

(7)

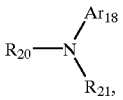

wherein $R_{20}$ and $R_{21}$ independently denote an alkyl group, an aralkyl group or a monovalent aromatic cyclic group each capable of having a substituent, and $Ar_{18}$ denotes a monovalent aromatic cyclic group capable of having a substituent, with the proviso that at least one of $R_{20}$, $R_{21}$ and $Ar_{18}$ has a substituent represented by the following formula (7a):

(7a)

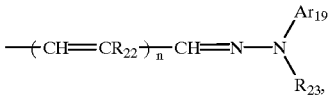

wherein $R_{22}$ and $R_{23}$ independently denote an alkyl group, an aralkyl group or a monovalent aromatic cyclic group each capable of having a substituent, or a hydrogen atom: $Ar_{19}$ denotes a monovalent aromatic cyclic group capable of having a substituent; and n is an integer of 0–2.

Examples of the condensed cyclic hydrocarbon compounds having at least one substituent of the formula (7a) may include: naphthalene, anthracene, phenanthrene, pyrene, fluorene, fluoroanthene, azulene, indene, perylene, chrysene, and coronene; and examples of the condensed heterocyclic compounds having at least one substituent of the formula (7a) may include: benzofuran, indole, carbazole, benzcarbazole, acridine, phenothiazine, and quinoline.

In the explanation of the formulae (5)–(7), (5a) and (7a), examples of the above-mentioned monovalent aromatic cyclic group include: aromatic hydrocarbon groups, such as phenyl, naphthyl, anthracenyl, and pyrenyl; and aromatic heterocyclic groups, such as pyridyl, quinolyl, thienyl, furyl, carbazolyl, benzimidazolyl, and benzthiazolyl. Examples of the divalent aromatic cyclic group include: those obtained by subtracting two hydrogen atoms from aromatic hydrocarbons, such as benzene, naphthalene, anthracene and pyrene, and aromatic heterocyclic rings, such as pyridine, quinoline, thiophene and furan. Examples of the alkyl group include: methyl, ethyl, propyl, butyl and hexyl. Examples of the aralkyl group include: benzyl, phenetyl, naphthylmethyl and furfuryl.

Further, examples of the substituent optionally possessed by the above-mentioned groups may include: alkyl groups, such as methyl, ethyl, propyl, butyl and hexyl; alkoxy groups, such as methoxy, ethoxy and butoxy; halogen atoms, such as fluorine, chlorine, bromine and iodine; acyl groups, such as acetyl and benzolyl; alkylamino groups, such as dimethylamino; haloalkyl groups, such as trifluoromethyl; cyano group, nitro group, phenylcarbamoyl group, carboxyl group, and hydroxyl group.

In the above, each pair of $R_{13}$ and $Ar_{11}$, $Ar_{13}$ and $R_{15}$, $Ar_{16}$ and $Ar_{17}$, $R_{16}$ and $R_{17}$, $R_{18}$ and $R_{19}$, $R_{20}$ and $R_{21}$ or $Ar_{19}$ and $R_{23}$ can be connected with each other directly or via an organic group, such as —$CH_2$—, —$CH_2$—$CH_2$—, —CH═CH—, —O—, —S— or —$NR_{24}$—, to form a ring; wherein $R_{24}$ denotes an alkyl group capable of having a substituent, a monovalent aromatic cyclic group capable of having a substituent or a hydrogen atom.

Compounds of the formula (5) wherein $R_{13}$ is a monovalent aromatic cyclic group, are particularly preferred.

Table 1 below lists some preferred examples of the compounds represented by the formulae (1)–(7), the condensed cyclic hydrocarbon compounds having a substituent of the formula (7a) and the condensed heterocyclic compounds having a substituent of the formula (7a). These are however not exhaustive.

TABLE 1

Charge-transporting compounds

| No. | Structure |
|---|---|
| 1 | 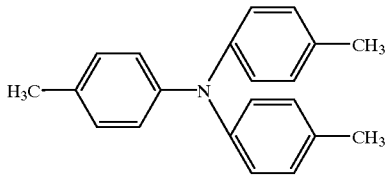 |
| 2 | 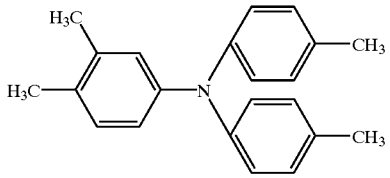 |
| 3 | 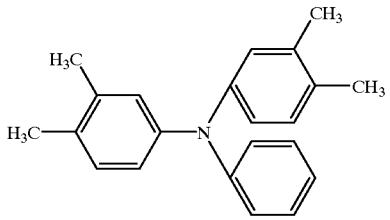 |
| 4 | 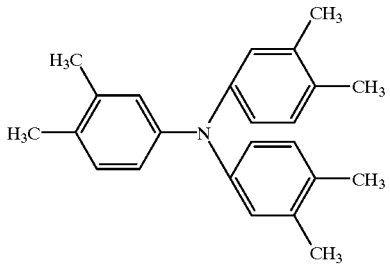 |

TABLE 1-continued
| Charge-transporting compounds | |
|---|---|
| No. | Structure |
| 5 | 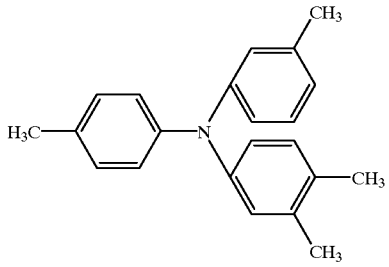 |
| 6 | 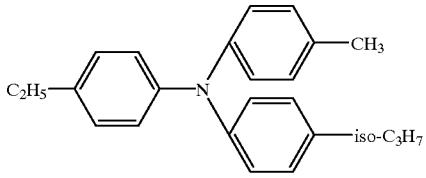 |
| 7 | 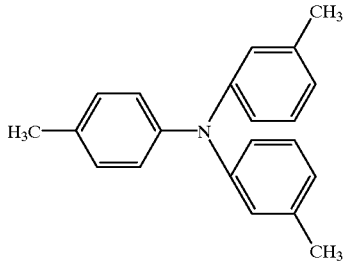 |
| 8 | 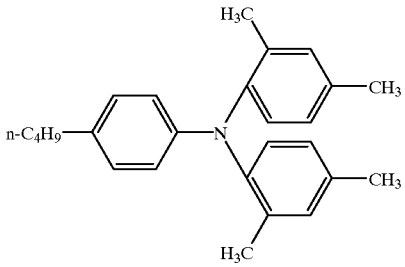 |
| 9 | 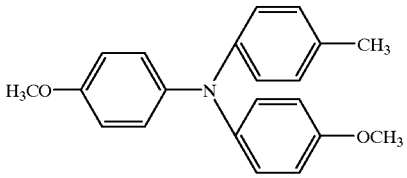 |
| 10 | 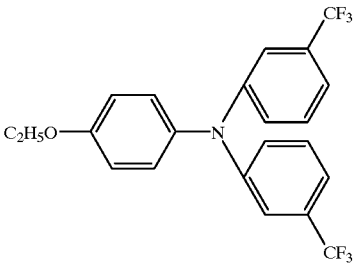 |

TABLE 1-continued
| Charge-transporting compounds | |
|---|---|
| No. | Structure |
| 11 | 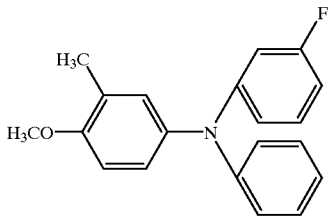 |
| 12 | 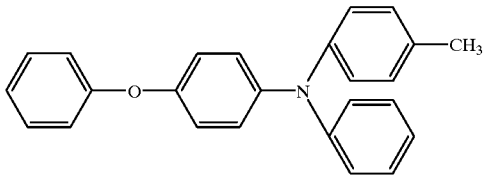 |
| 13 | 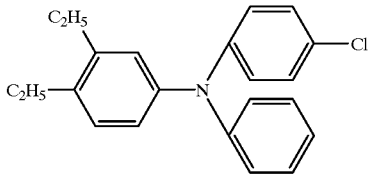 |
| 14 | 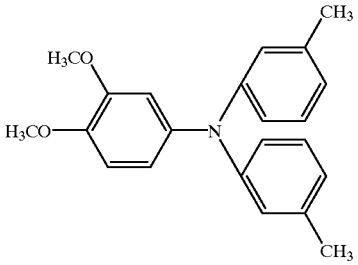 |
| 15 | 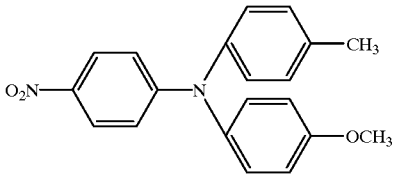 |
| 16 | 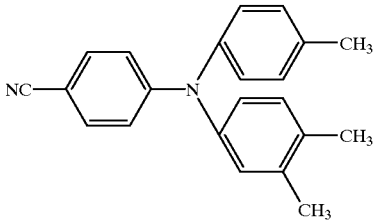 |

TABLE 1-continued
| Charge-transporting compounds | |
|---|---|
| No. | Structure |
| 17 | 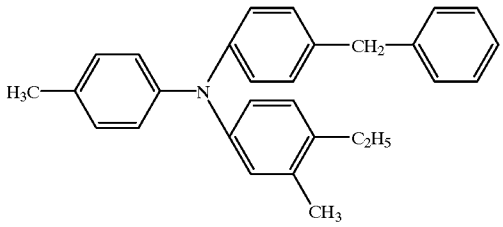 |
| 18 | 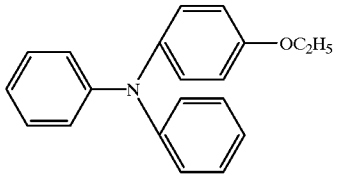 |
| 19 | 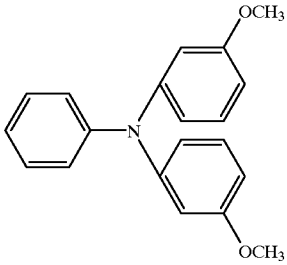 |
| 20 | 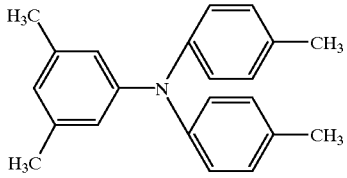 |
| 21 | 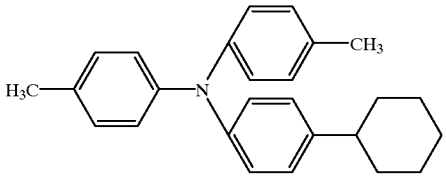 |
| 22 | 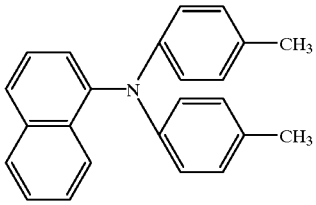 |

TABLE 1-continued
| Charge-transporting compounds | |
|---|---|
| No. | Structure |
| 23 | 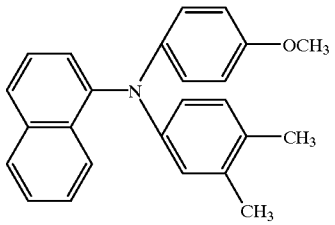 |
| 24 | 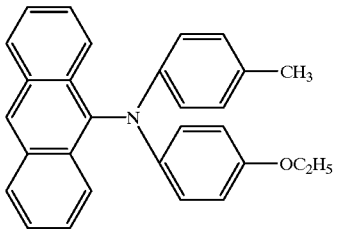 |
| 25 | 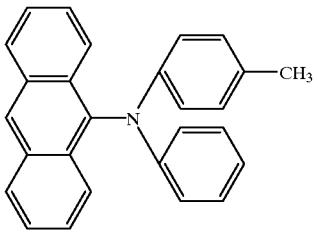 |
| 26 | 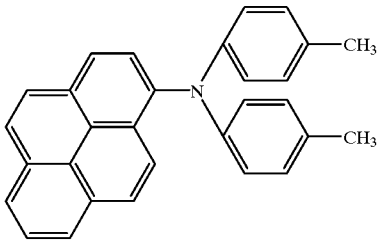 |
| 27 | 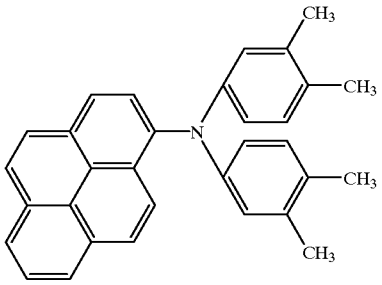 |

TABLE 1-continued
| Charge-transporting compounds | |
|---|---|
| No. | Structure |
| 28 | 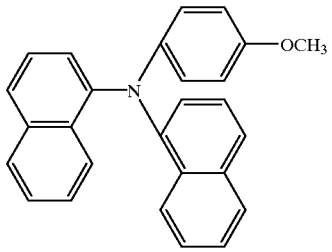 |
| 29 | 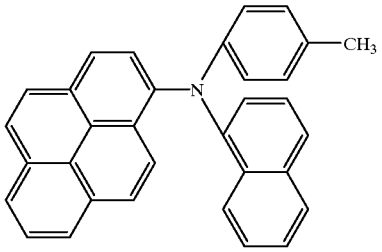 |
| 30 | 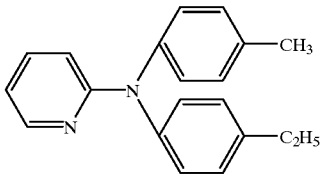 |
| 31 | 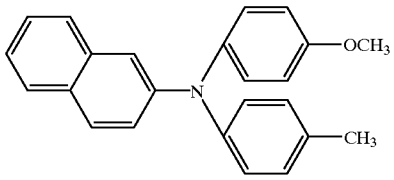 |
| 32 | 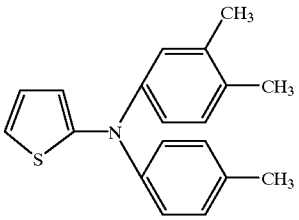 |
| 33 | 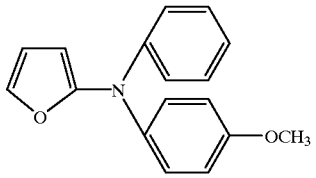 |

TABLE 1-continued
| Charge-transporting compounds | |
|---|---|
| No. | Structure |
| 34 | 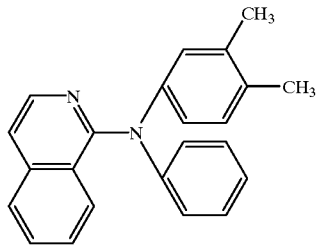 |
| 35 | 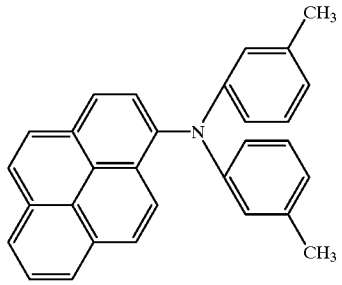 |
| 36 | 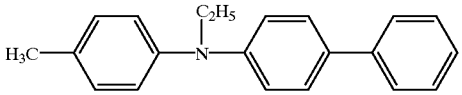 |
| 37 | 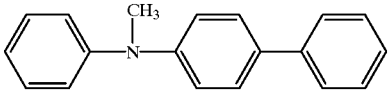 |
| 38 | 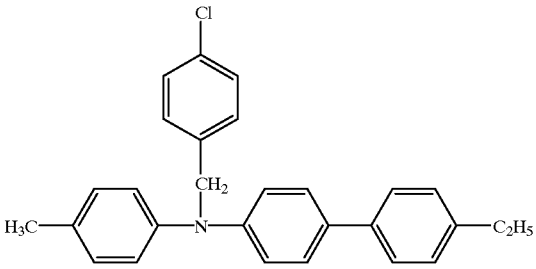 |
| 39 | 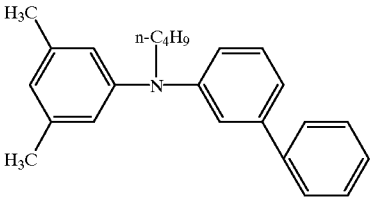 |
| 40 | 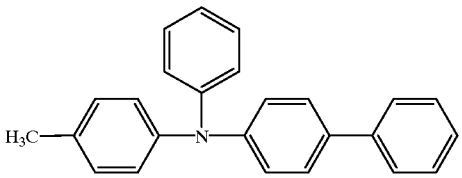 |

TABLE 1-continued
| No. | Charge-transporting compounds<br>Structure |
|---|---|
| 41 | 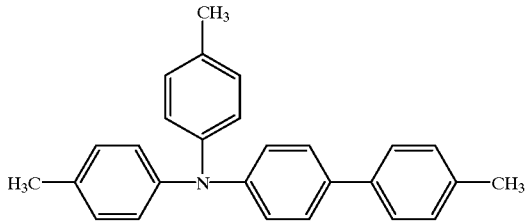 |
| 42 | 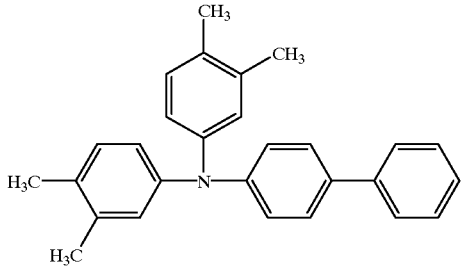 |
| 43 | 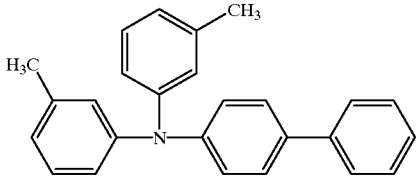 |
| 44 | 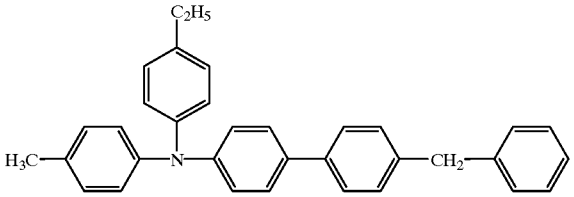 |
| 45 | 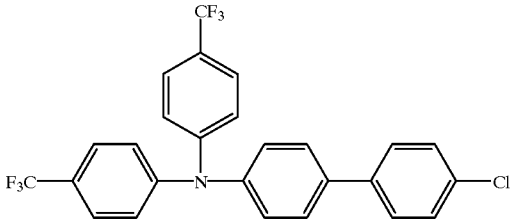 |
| 46 | 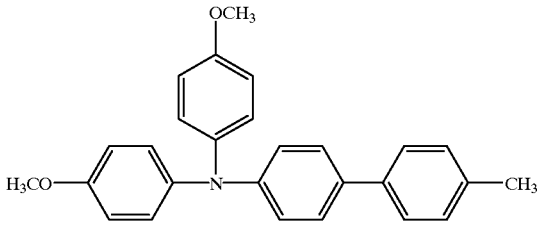 |

TABLE 1-continued
| Charge-transporting compounds | |
|---|---|
| No. | Structure |
| 47 | 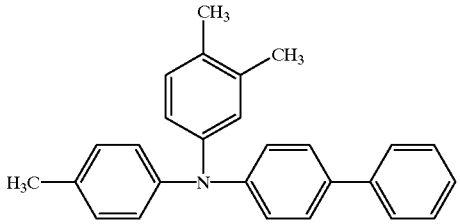 |
| 48 | 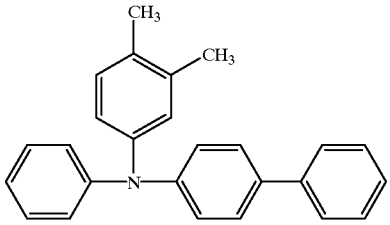 |
| 49 | 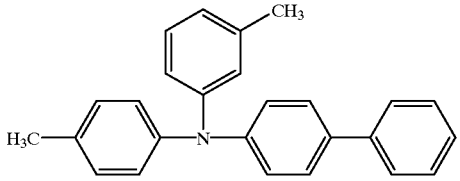 |
| 50 | 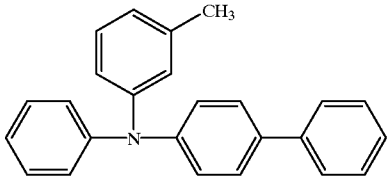 |
| 51 | 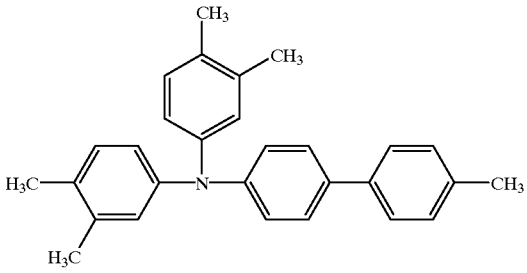 |
| 52 | 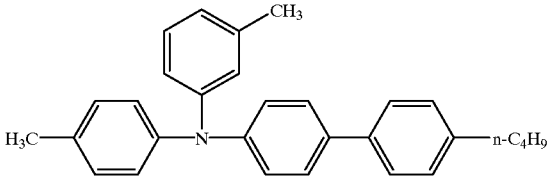 |

TABLE 1-continued
| Charge-transporting compounds | |
|---|---|
| No. | Structure |
| 53 | 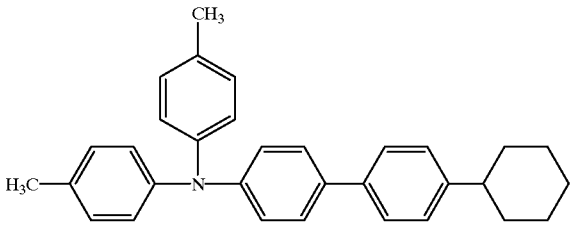 |
| 54 | 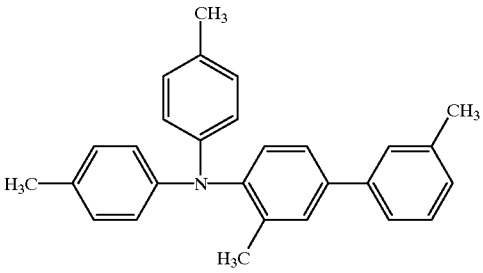 |
| 55 | 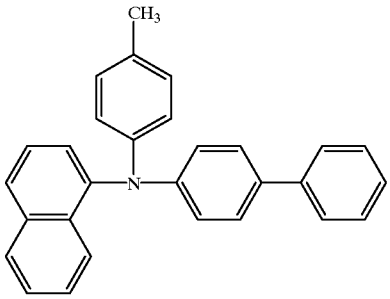 |
| 56 | 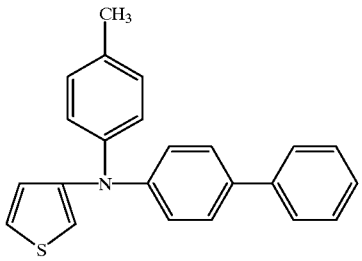 |
| 57 | 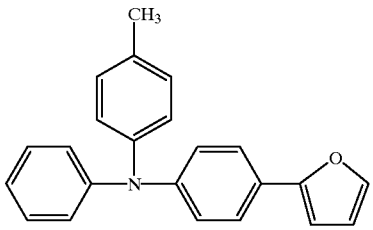 |

TABLE 1-continued
| No. | Charge-transporting compounds<br>Structure |
|---|---|
| 58 | 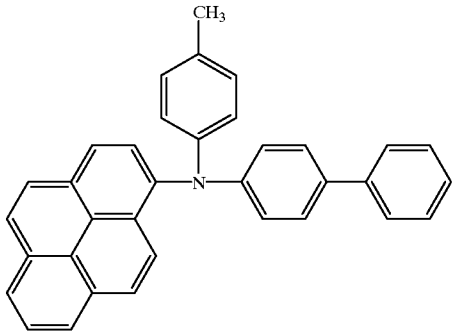 |
| 59 | 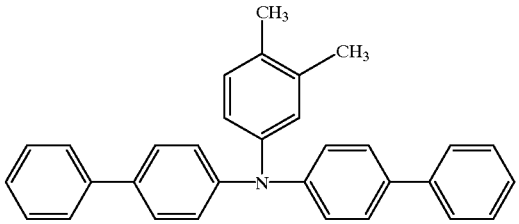 |
| 60 | 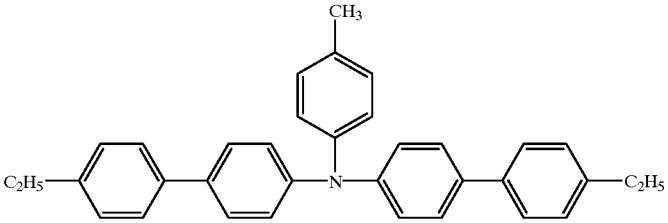 |
| 61 | 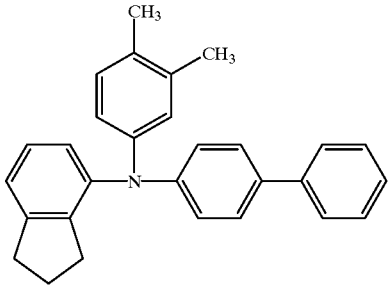 |
| 62 | 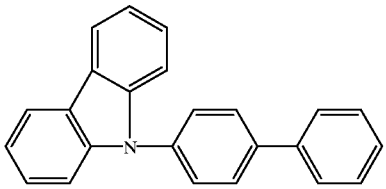 |
| 63 | 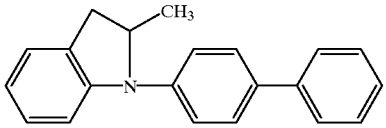 |

TABLE 1-continued
| Charge-transporting compounds | |
|---|---|
| No. | Structure |
| 64 | 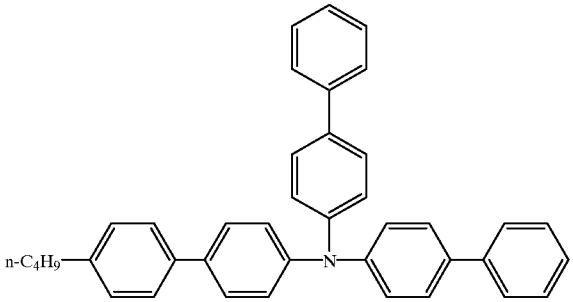 |
| 65 | 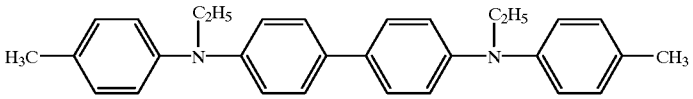 |
| 66 | 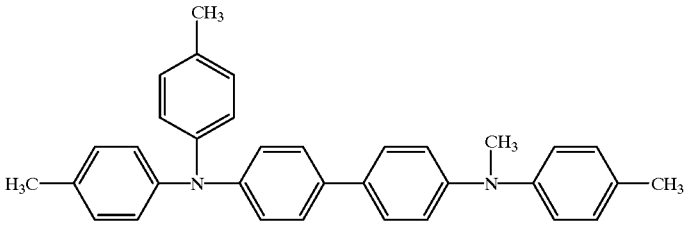 |
| 67 | 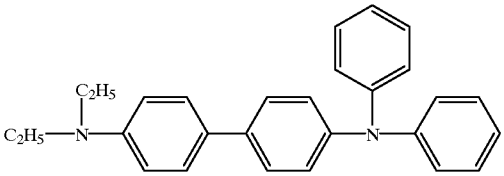 |
| 68 | 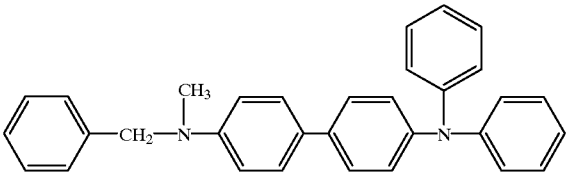 |
| 69 | 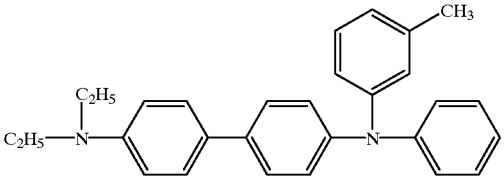 |
| 70 | 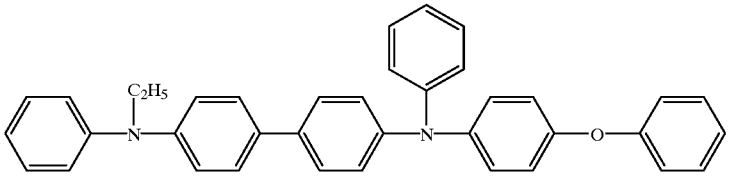 |

TABLE 1-continued
| No. | Charge-transporting compounds<br>Structure |
|---|---|
| 71 | 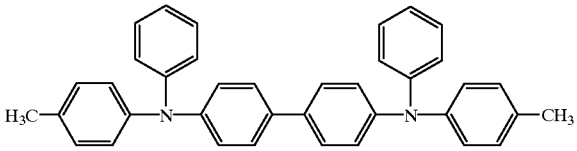 |
| 72 | 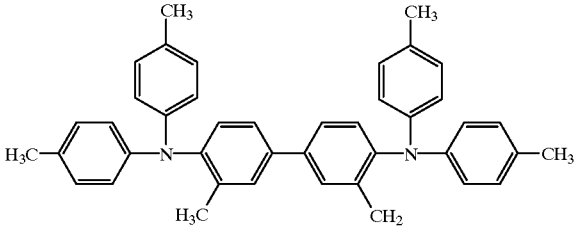 |
| 73 | 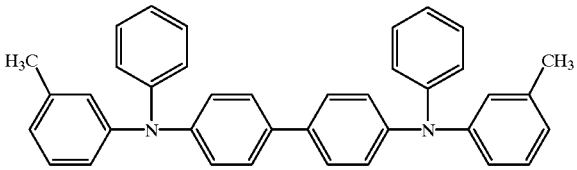 |
| 74 | 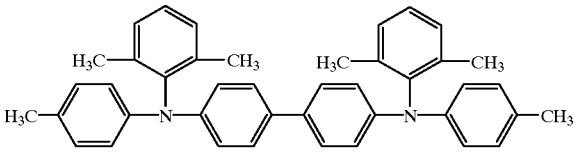 |
| 75 | 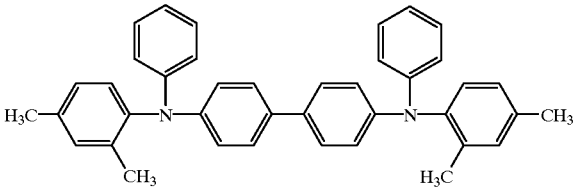 |
| 76 | 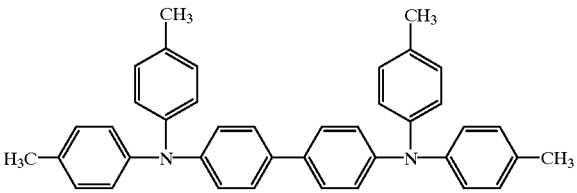 |
| 77 | 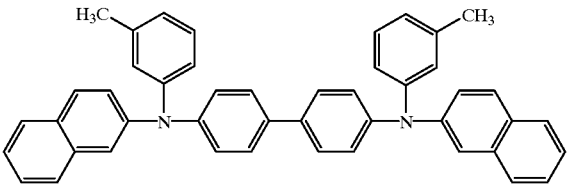 |

TABLE 1-continued
| Charge-transporting compounds | |
|---|---|
| No. | Structure |
| 78 | 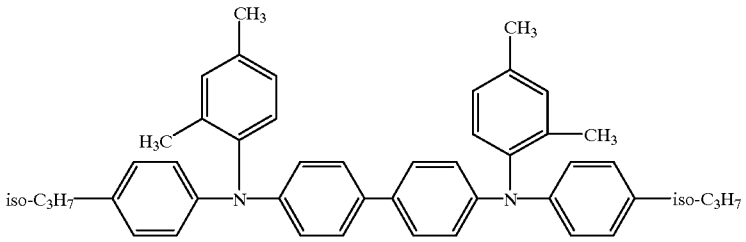 |
| 79 | 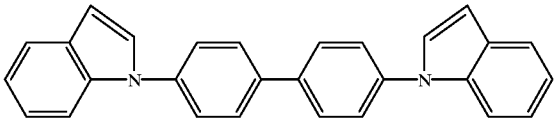 |
| 80 | 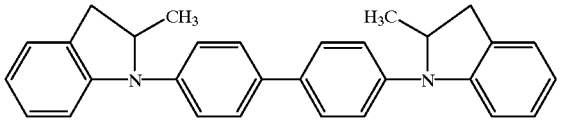 |
| 81 | 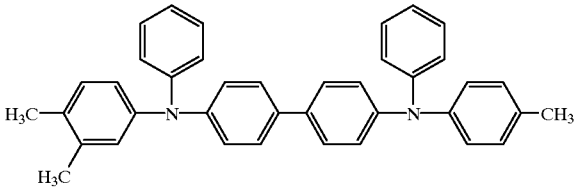 |
| 82 | 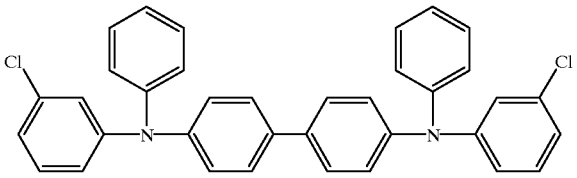 |
| 83 | 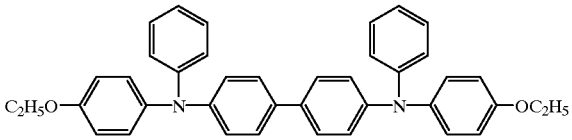 |
| 84 | 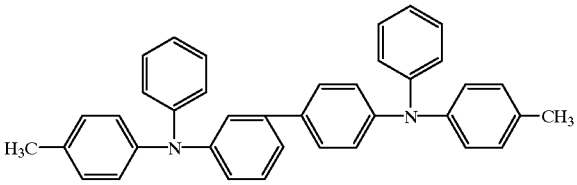 |
| 85 | 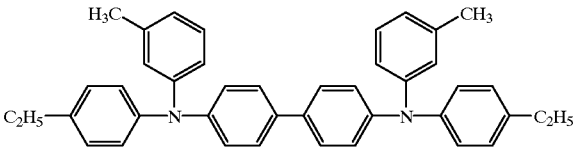 |

TABLE 1-continued
| No. | Charge-transporting compounds<br>Structure |
|---|---|
| 86 | 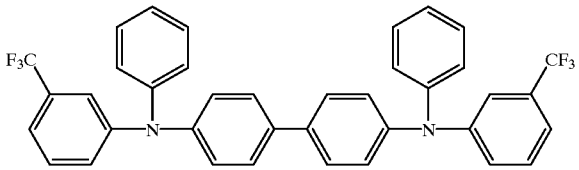 |
| 87 | 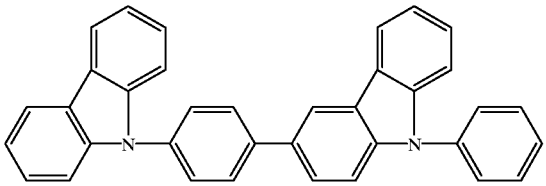 |
| 88 | 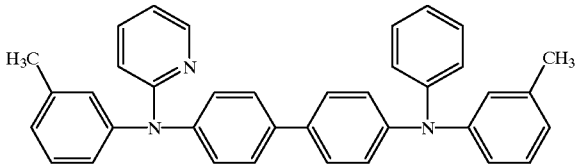 |
| 89 | 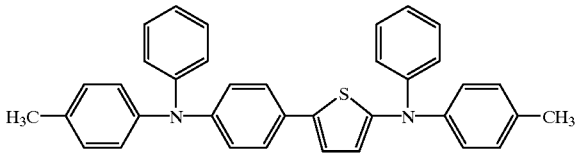 |
| 90 | 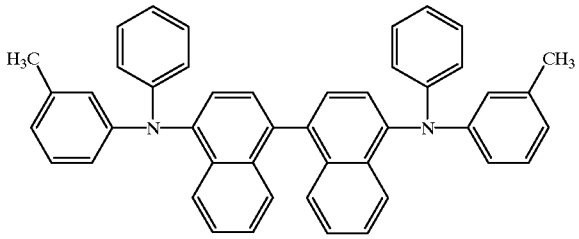 |
| 91 | 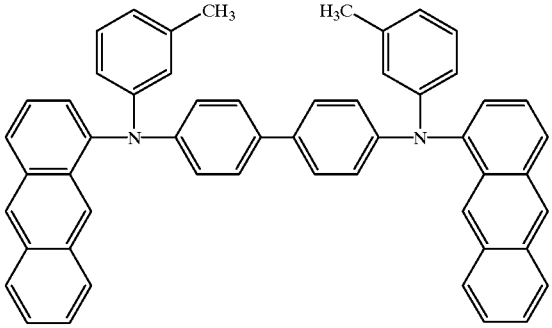 |
| 92 | 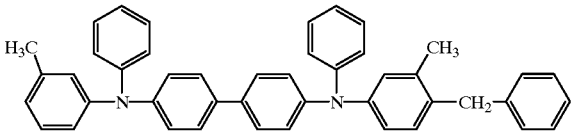 |

TABLE 1-continued
| Charge-transporting compounds | |
|---|---|
| No. | Structure |
| 93 | 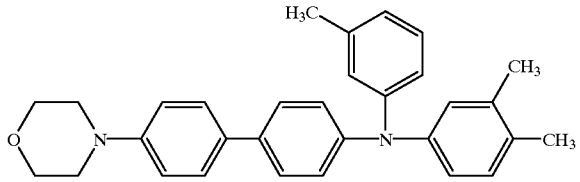 |
| 94 | 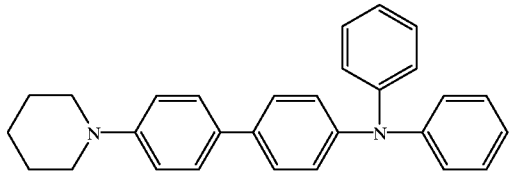 |
| 95 | 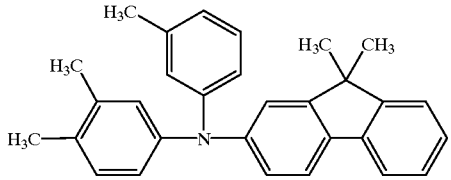 |
| 96 | 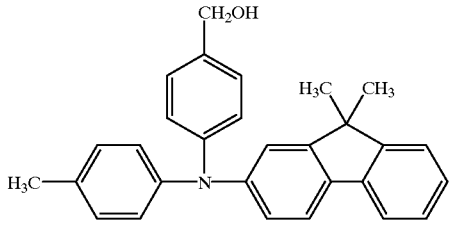 |
| 97 | 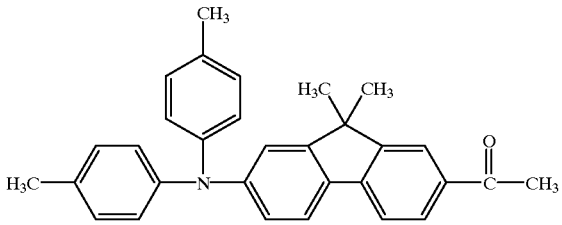 |
| 98 | 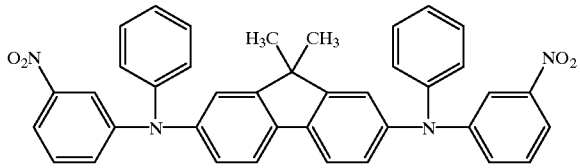 |
| 99 | 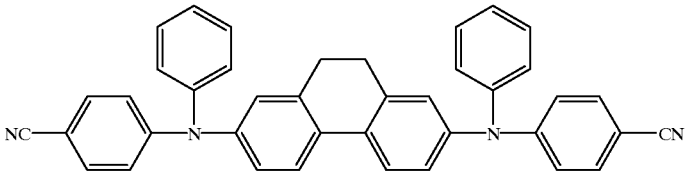 |

TABLE 1-continued
| Charge-transporting compounds | |
|---|---|
| No. | Structure |
| 100 | 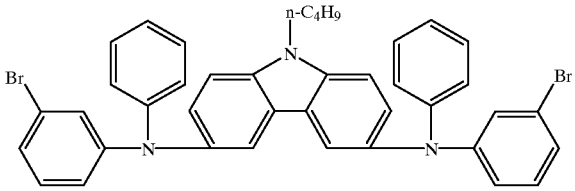 |
| 101 | 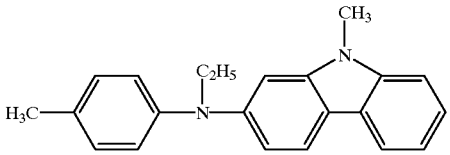 |
| 102 | 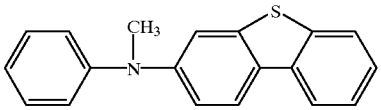 |
| 103 | 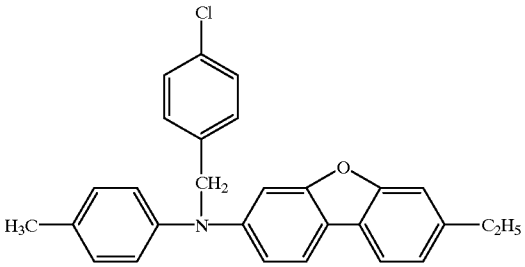 |
| 104 | 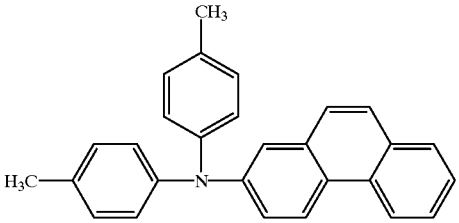 |
| 105 | 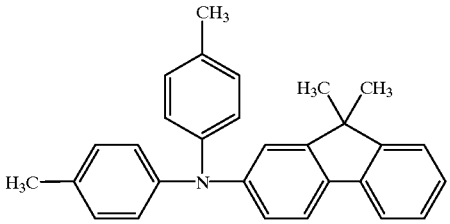 |
| 106 | 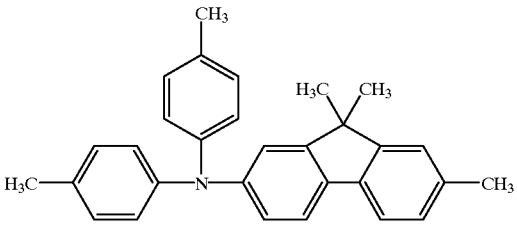 |

TABLE 1-continued
| Charge-transporting compounds | |
|---|---|
| No. | Structure |
| 107 | 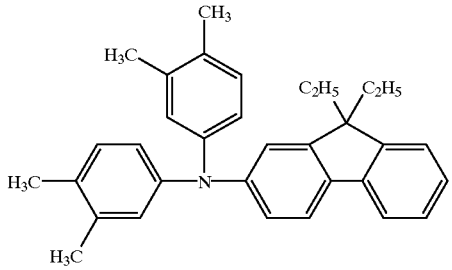 |
| 108 | 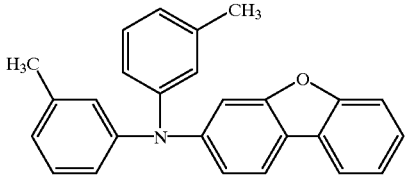 |
| 109 | 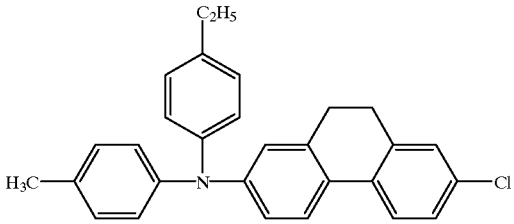 |
| 110 | 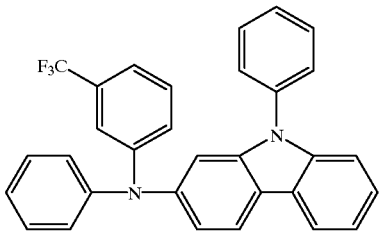 |
| 111 | 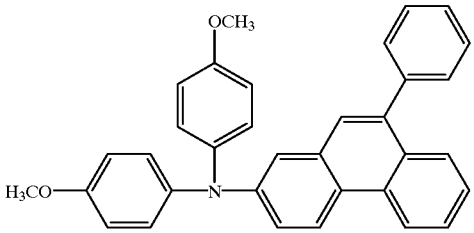 |
| 112 | 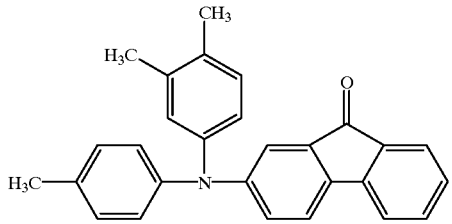 |

TABLE 1-continued
| Charge-transporting compounds | |
|---|---|
| No. | Structure |
| 113 | 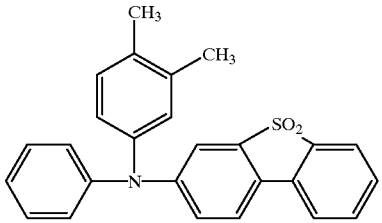 |
| 114 | 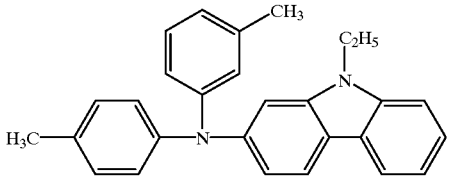 |
| 115 | 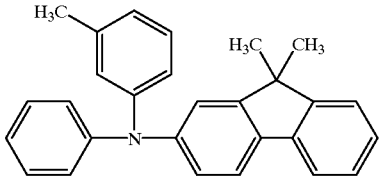 |
| 116 | 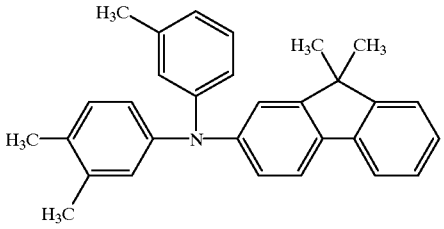 |
| 117 | 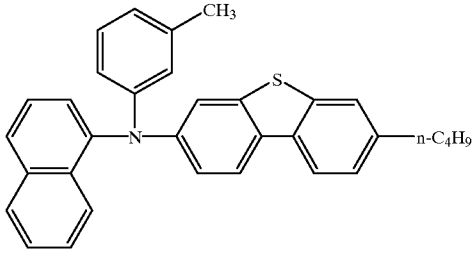 |
| 118 | 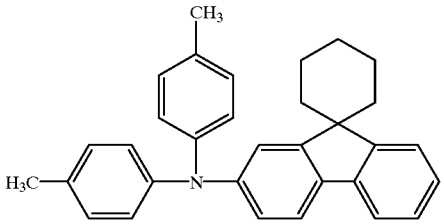 |

TABLE 1-continued
| Charge-transporting compounds | |
|---|---|
| No. | Structure |
| 119 | 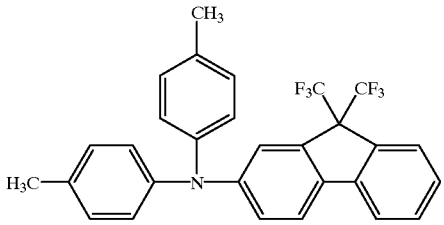 |
| 120 | 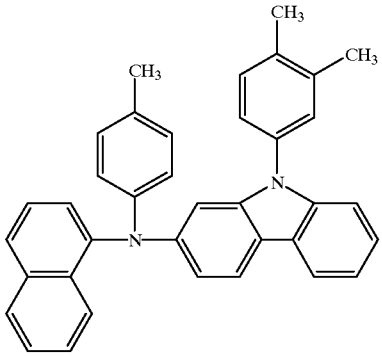 |
| 121 | 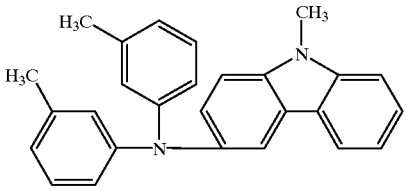 |
| 122 | 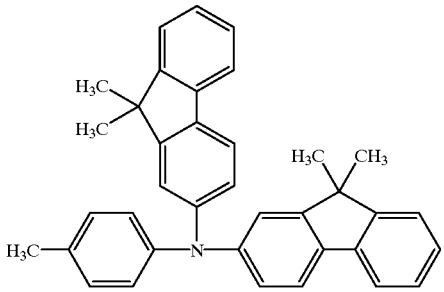 |
| 123 | 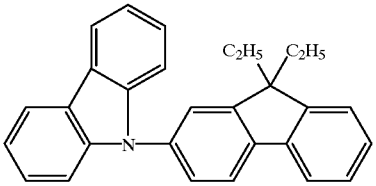 |

TABLE 1-continued
| No. | Charge-transporting compounds<br>Structure |
|---|---|
| 124 | 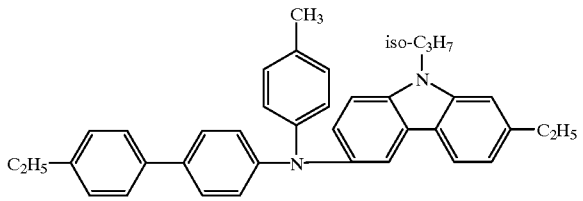 |
| 125 | 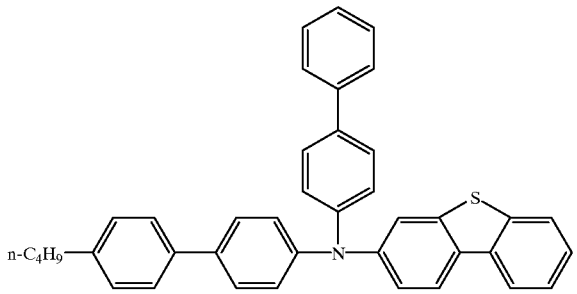 |
| 126 | 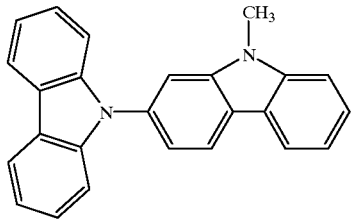 |
| 127 | 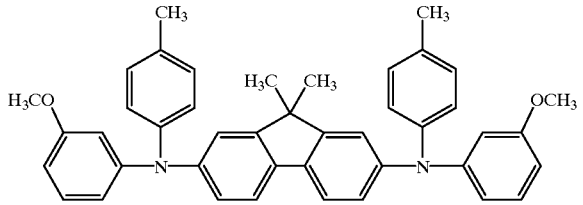 |
| 128 | 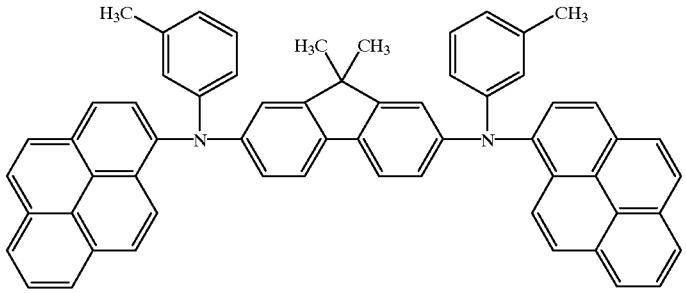 |
| 129 | 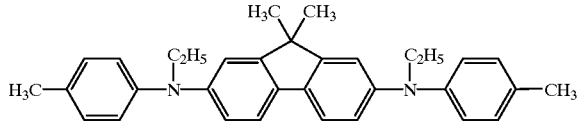 |

TABLE 1-continued
| Charge-transporting compounds | |
|---|---|
| No. | Structure |
| 130 | 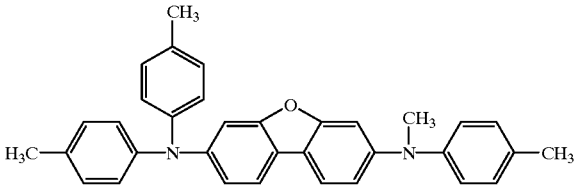 |
| 131 | 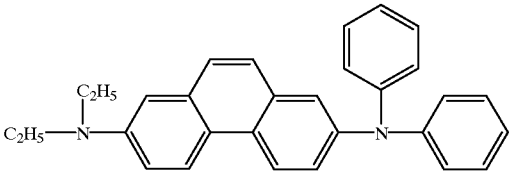 |
| 132 | 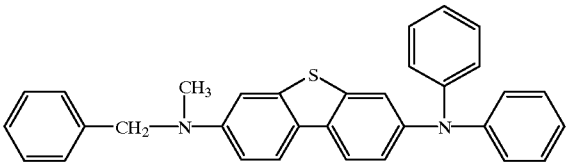 |
| 133 | 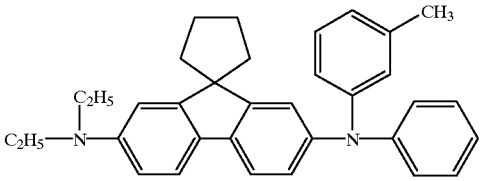 |
| 134 | 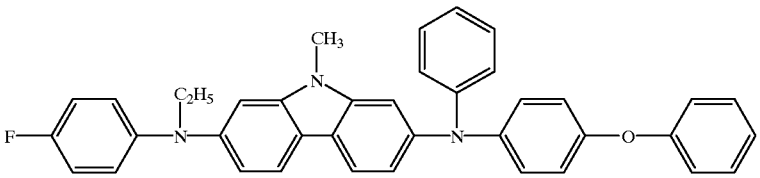 |
| 135 | 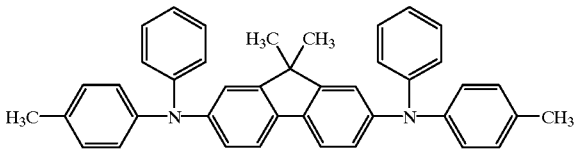 |
| 136 | 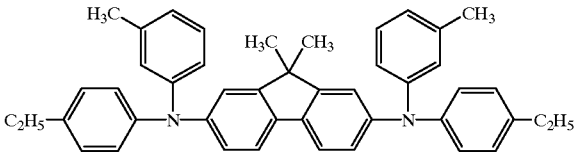 |
| 137 | 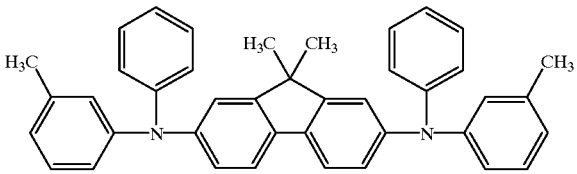 |

TABLE 1-continued
| Charge-transporting compounds | |
|---|---|
| No. | Structure |
| 138 | 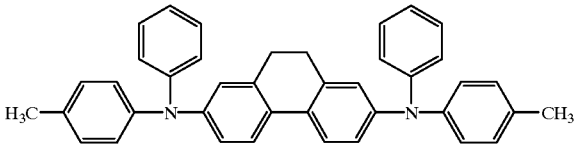 |
| 139 | 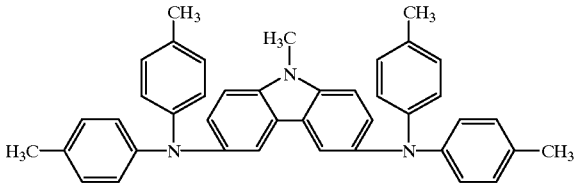 |
| 140 | 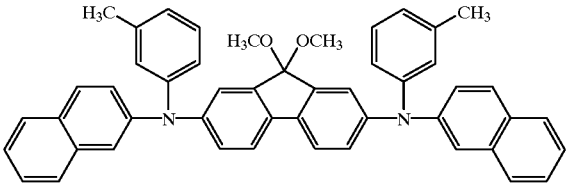 |
| 141 | 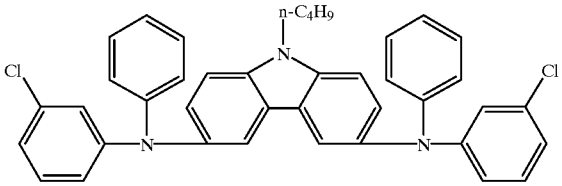 |
| 142 | 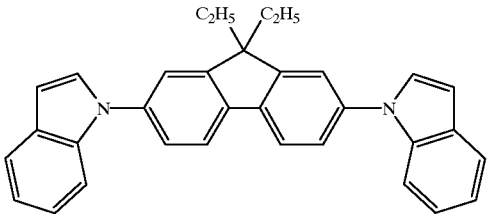 |
| 143 | 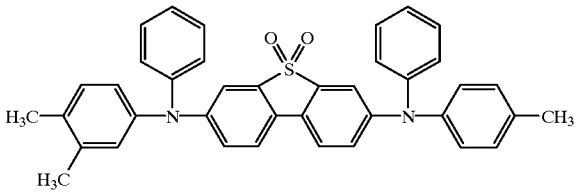 |
| 144 | 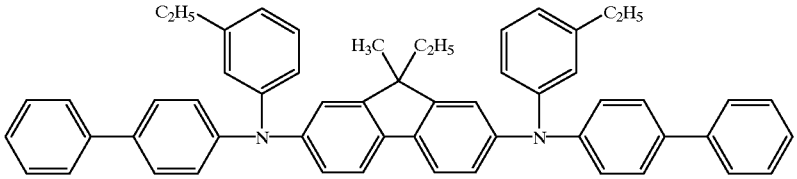 |

TABLE 1-continued
| Charge-transporting compounds | |
|---|---|
| No. | Structure |
| 145 | 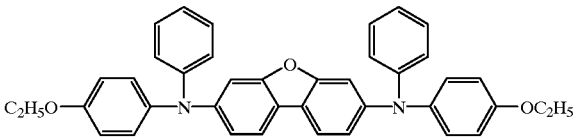 |
| 146 | 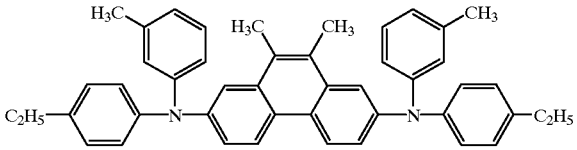 |
| 147 | 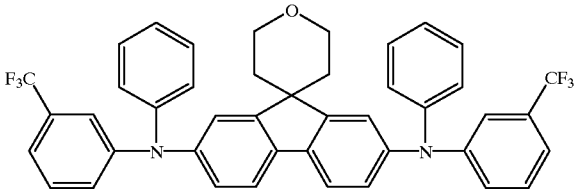 |
| 148 | 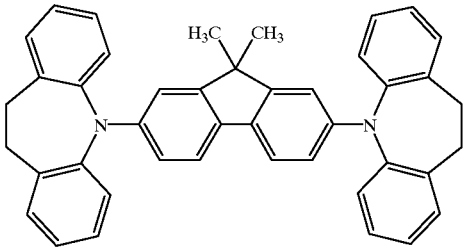 |
| 149 | 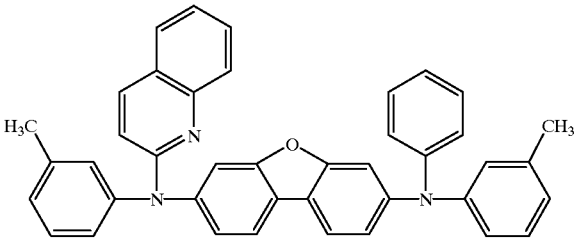 |
| 150 | 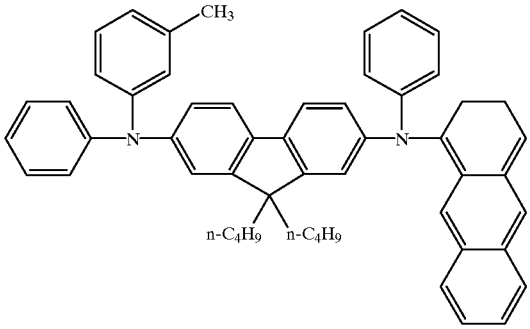 |

TABLE 1-continued
| Charge-transporting compounds | |
|---|---|
| No. | Structure |
| 151 | 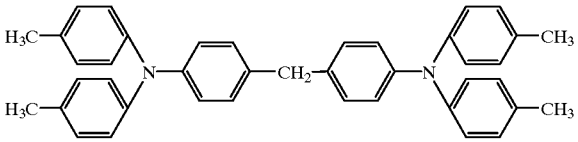 |
| 152 | 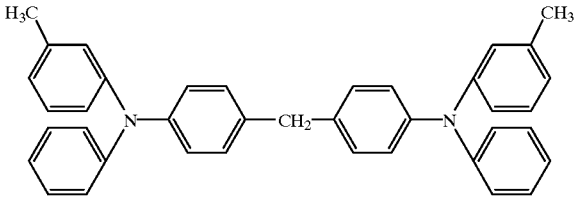 |
| 153 | 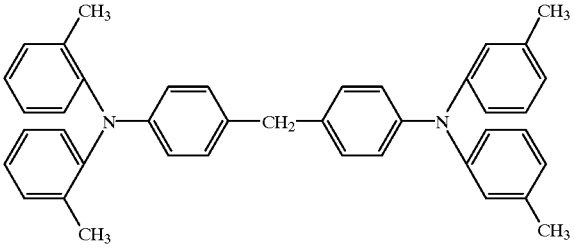 |
| 154 | 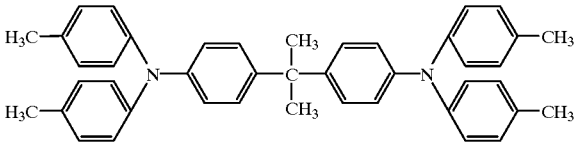 |
| 155 | 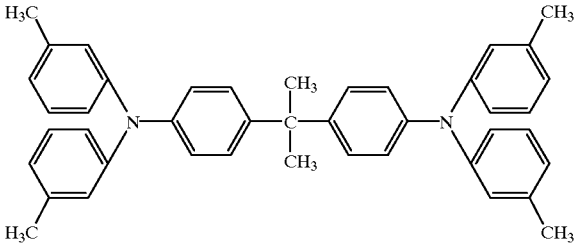 |
| 156 | 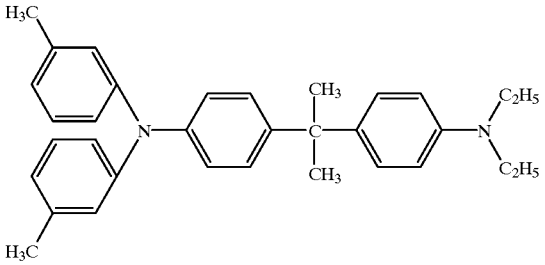 |

TABLE 1-continued
| Charge-transporting compounds | |
|---|---|
| No. | Structure |
| 157 | 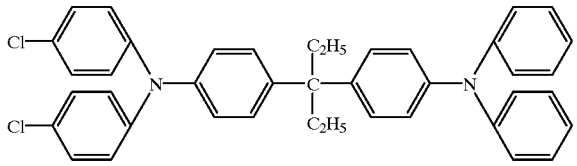 |
| 158 | 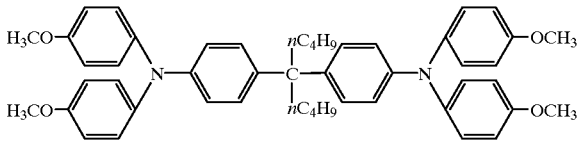 |
| 159 | 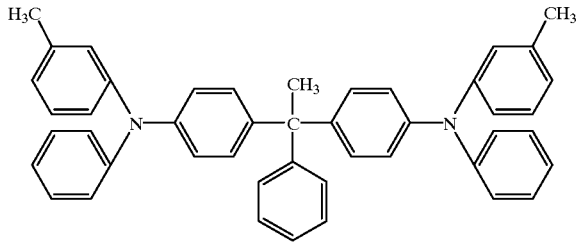 |
| 160 | 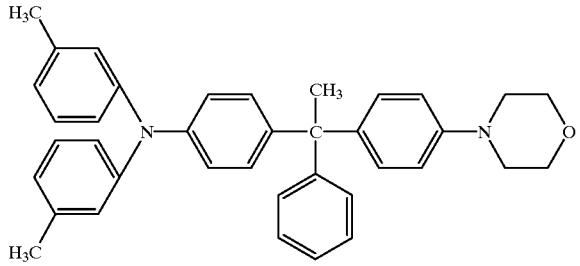 |
| 161 | 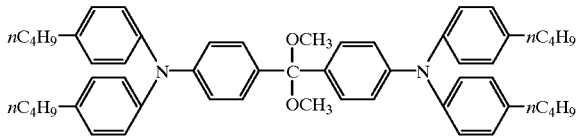 |
| 162 | 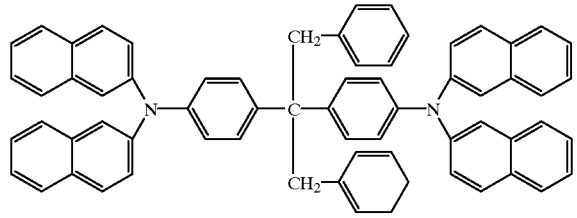 |

TABLE 1-continued
| Charge-transporting compounds | |
|---|---|
| No. | Structure |
| 163 | 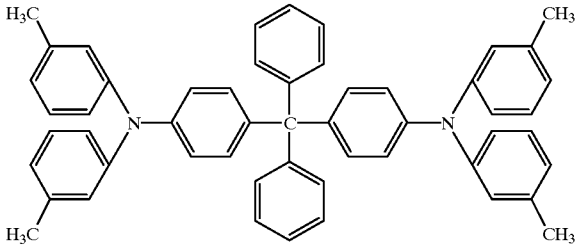 |
| 164 | 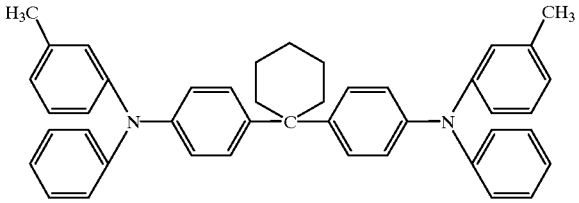 |
| 165 | 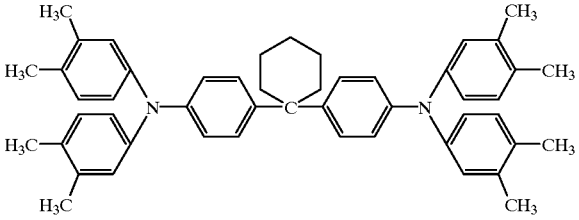 |
| 166 | 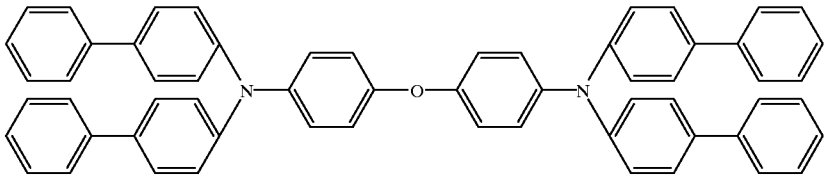 |
| 167 | 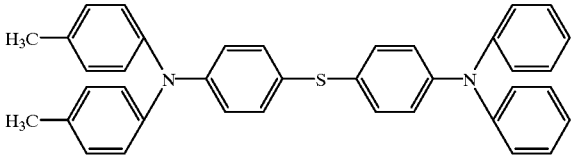 |
| 168 | 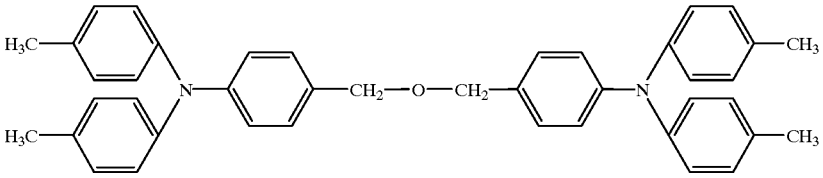 |
| 169 | 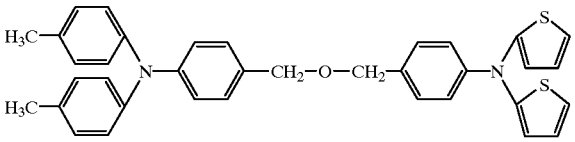 |

TABLE 1-continued
| Charge-transporting compounds | |
|---|---|
| No. | Structure |
| 170 | 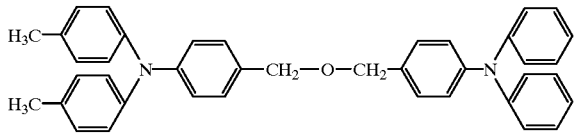 |
| 171 | 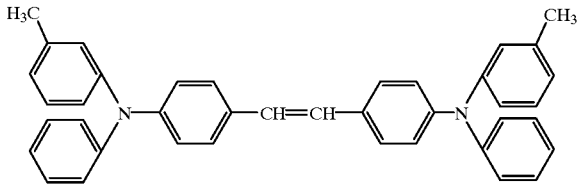 |
| 172 | 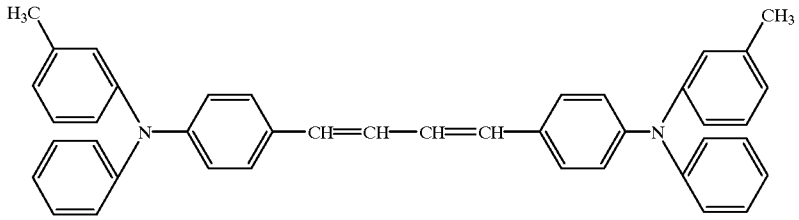 |
| 173 | 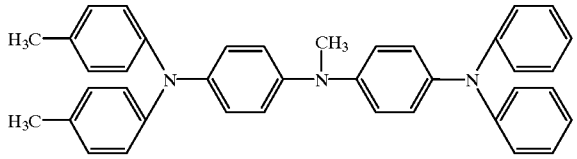 |
| 174 | 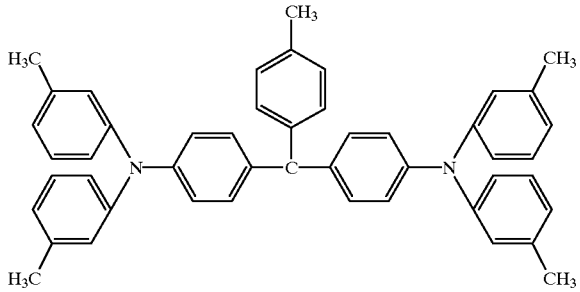 |
| 175 | 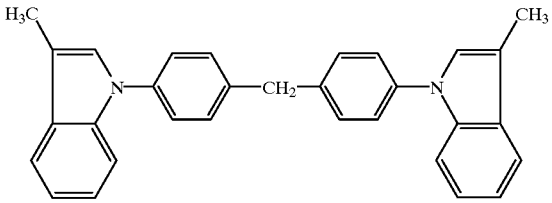 |

TABLE 1-continued
| No. | Charge-transporting compounds<br>Structure |
|---|---|
| 176 | 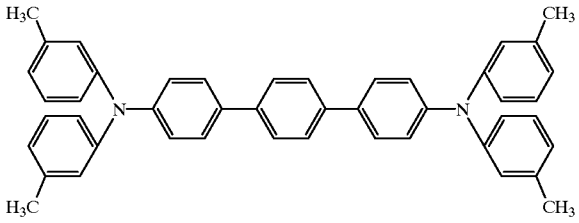 |
| 177 | 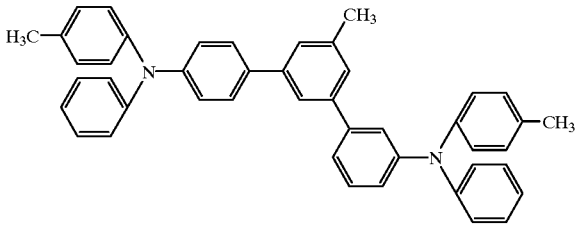 |
| 178 | 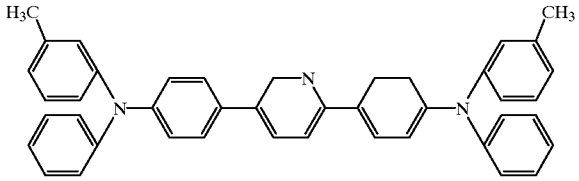 |
| 179 | 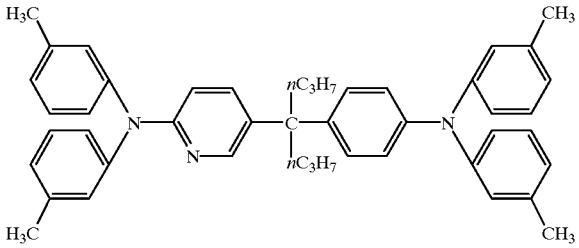 |
| 180 | 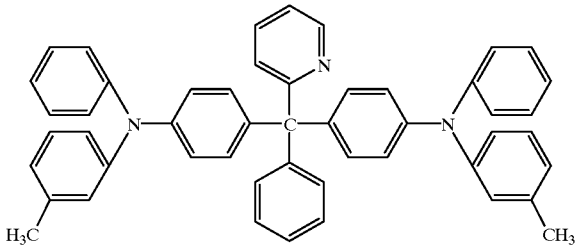 |
| 181 | 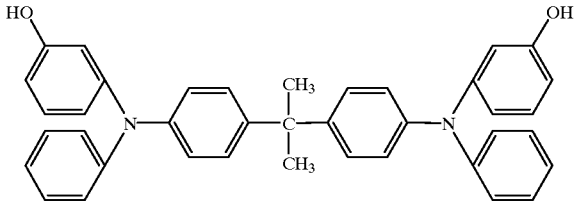 |

TABLE 1-continued
| Charge-transporting compounds | |
|---|---|
| No. | Structure |
| 182 | 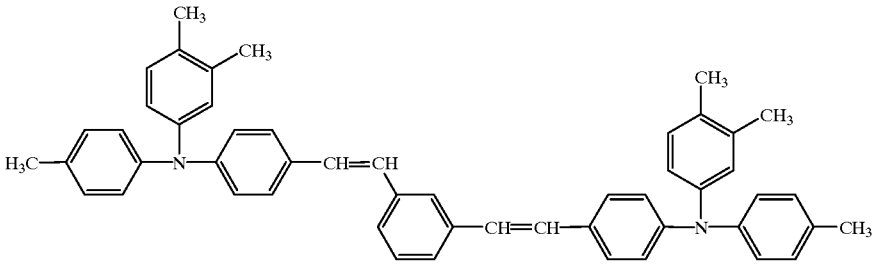 |
| 183 | 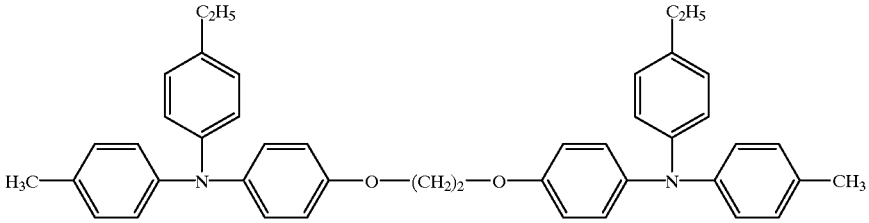 |
| 184 | 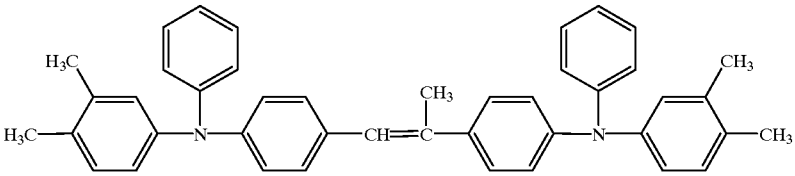 |
| 185 | 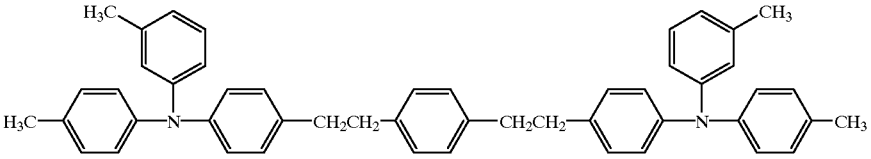 |
| 186 | 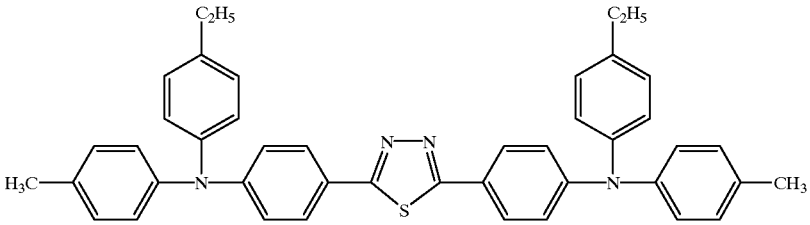 |
| 187 | 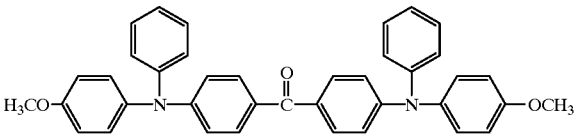 |

TABLE 1-continued
| Charge-transporting compounds | |
|---|---|
| No. | Structure |
| 188 | 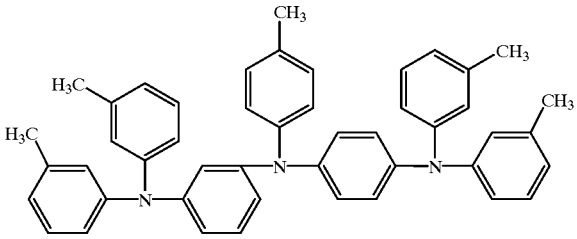 |
| 189 | 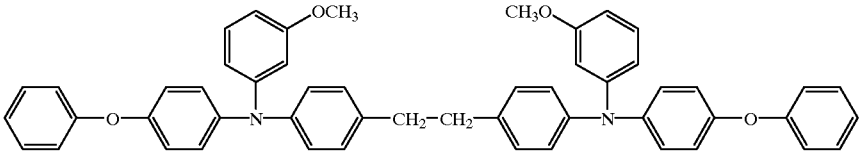 |
| 190 | 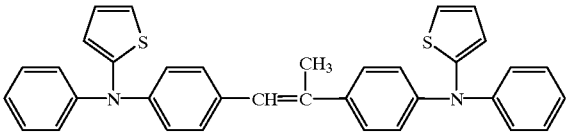 |
| 191 | 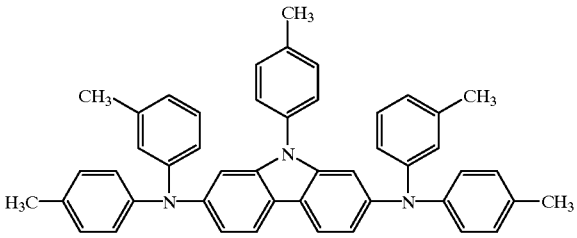 |
| 192 | 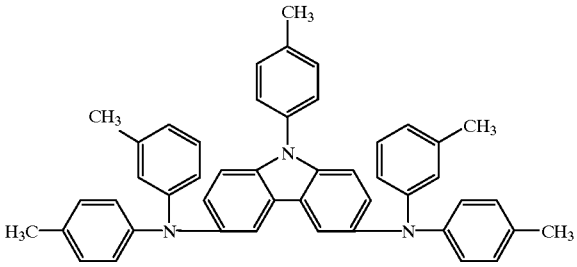 |
| 193 | 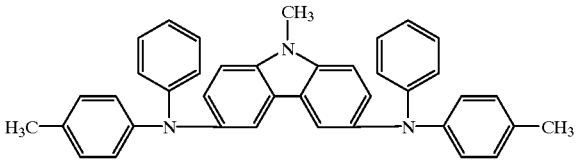 |
| 194 | 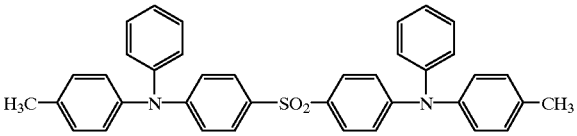 |

TABLE 1-continued
| Charge-transporting compounds | |
|---|---|
| No. | Structure |
| 195 | 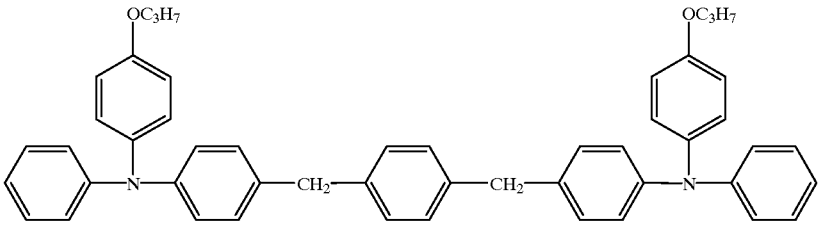 |
| 196 | 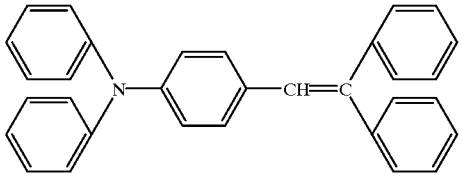 |
| 197 | 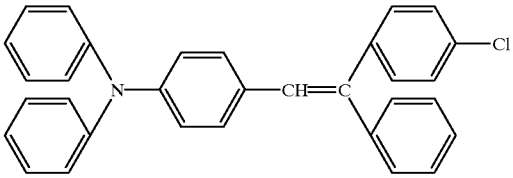 |
| 198 | 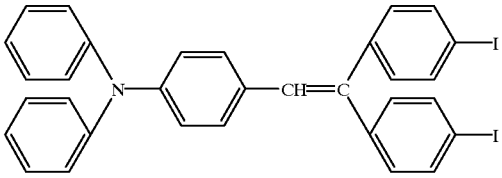 |
| 199 | 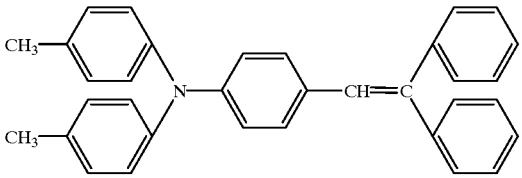 |
| 200 | 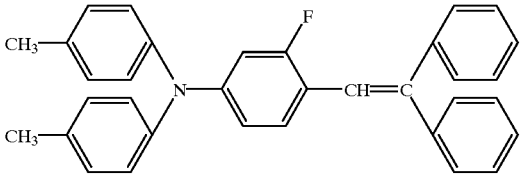 |
| 201 | 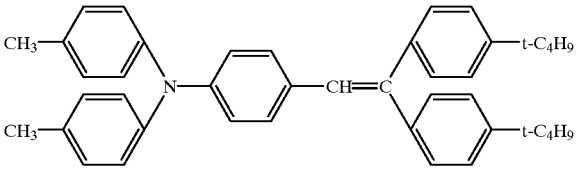 |

TABLE 1-continued
| No. | Charge-transporting compounds<br>Structure |
|---|---|
| 202 | 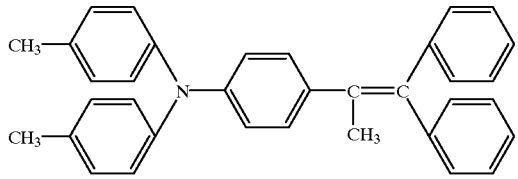 |
| 203 | 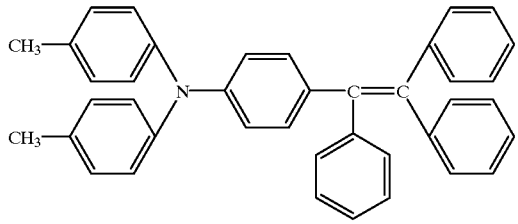 |
| 204 | 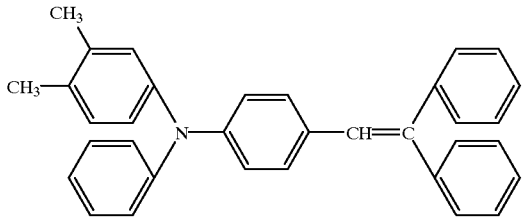 |
| 205 | 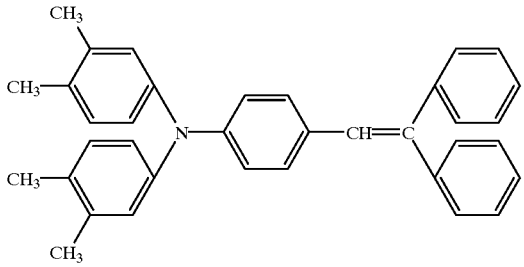 |
| 206 | 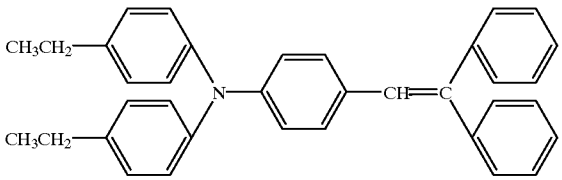 |
| 207 | 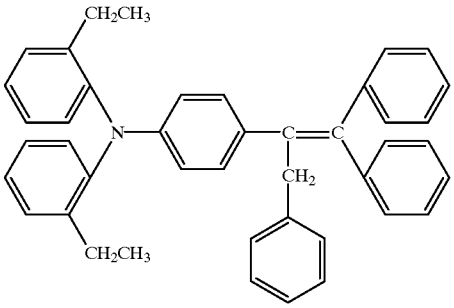 |

TABLE 1-continued
Charge-transporting compounds
| No. | Structure |
|---|---|
| 208 | 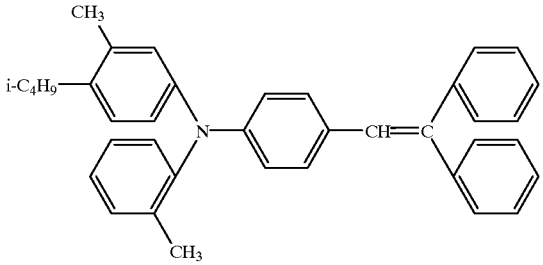 |
| 209 | 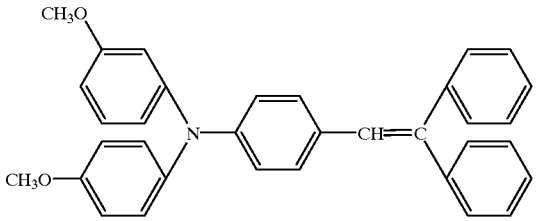 |
| 210 | 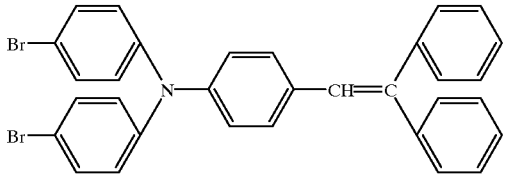 |
| 211 | 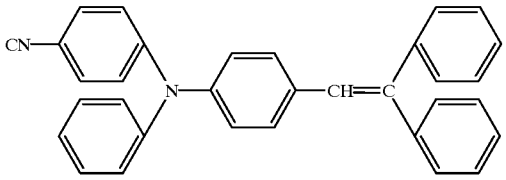 |
| 212 | 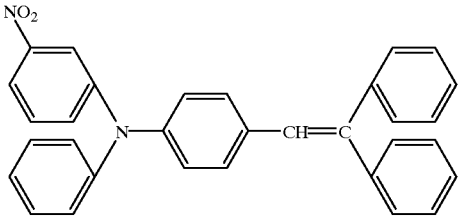 |
| 213 | 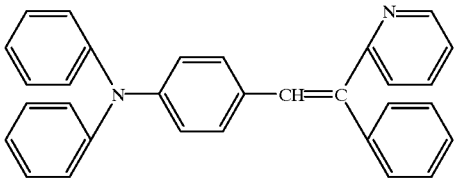 |
| 214 | 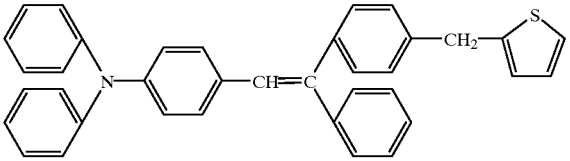 |

TABLE 1-continued
| Charge-transporting compounds | |
|---|---|
| No. | Structure |
| 215 | 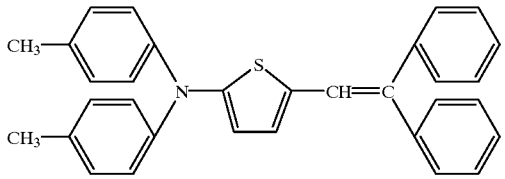 |
| 216 | 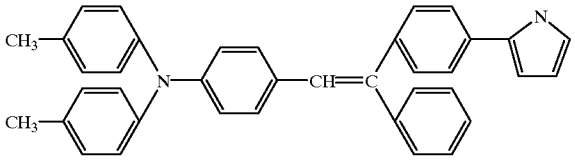 |
| 217 | 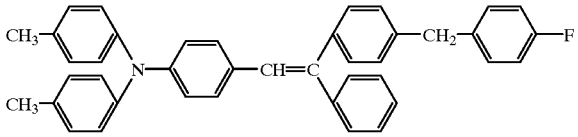 |
| 218 | 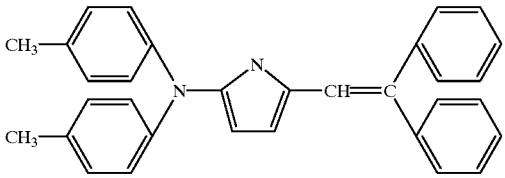 |
| 219 | 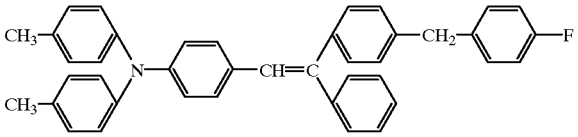 |
| 220 | 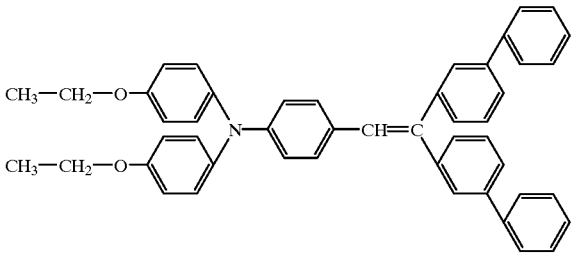 |
| 221 | 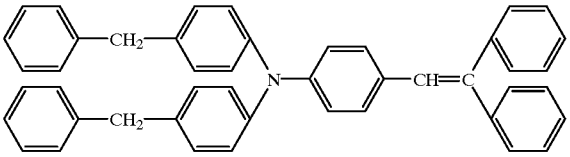 |
| 222 | 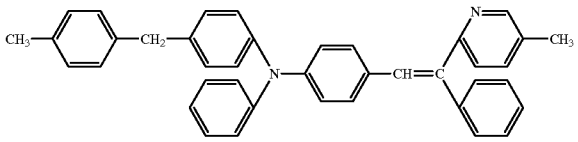 |

TABLE 1-continued
| Charge-transporting compounds | |
|---|---|
| No. | Structure |
| 223 | 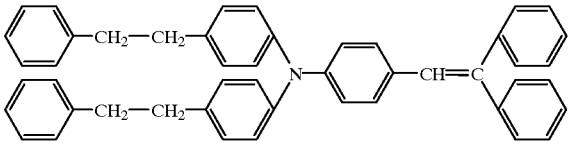 |
| 224 | 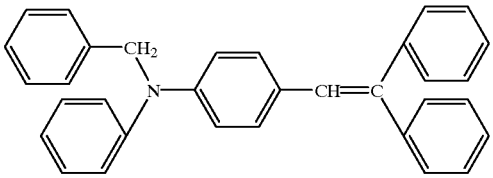 |
| 225 | 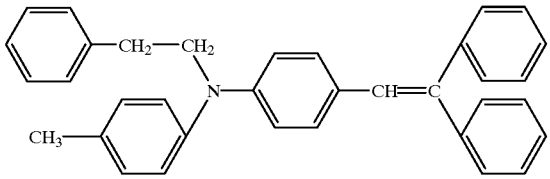 |
| 226 | 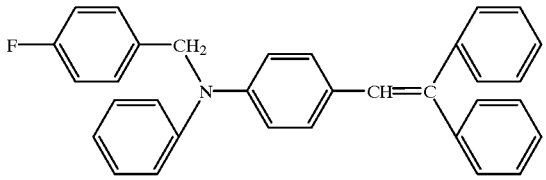 |
| 227 | 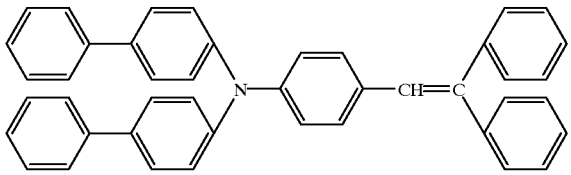 |
| 228 | 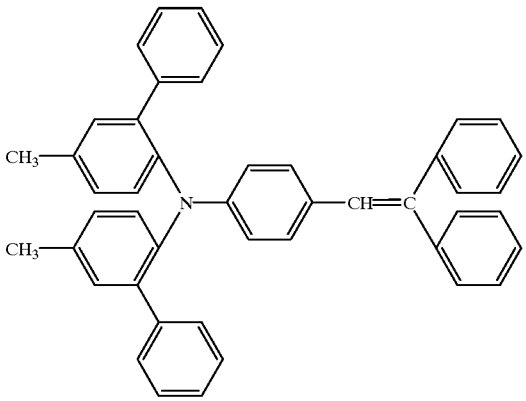 |

TABLE 1-continued
| Charge-transporting compounds | |
|---|---|
| No. | Structure |
| 229 | 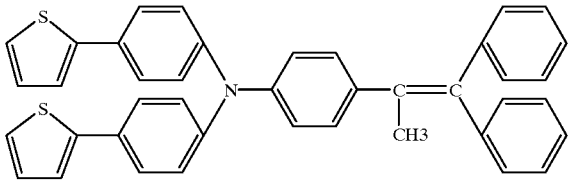 |
| 230 | 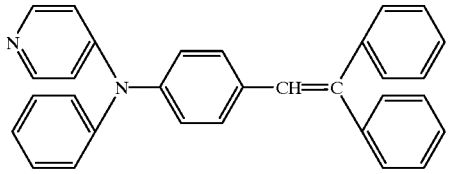 |
| 231 | 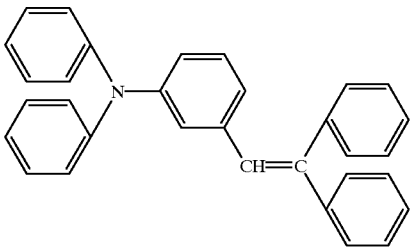 |
| 232 | 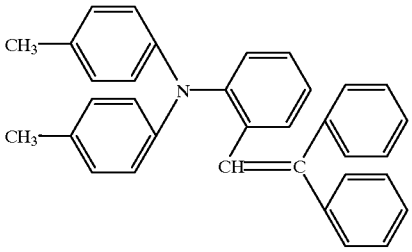 |
| 233 | 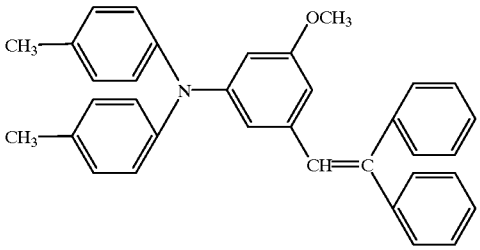 |

TABLE 1-continued
| Charge-transporting compounds | |
|---|---|
| No. | Structure |
| 234 | 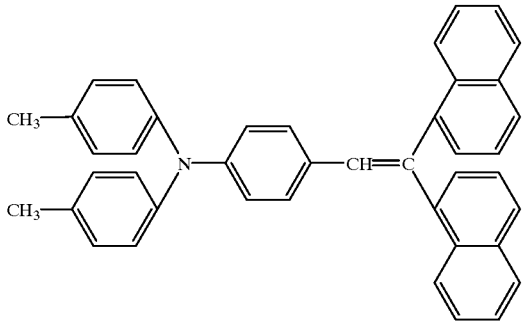 |
| 235 | 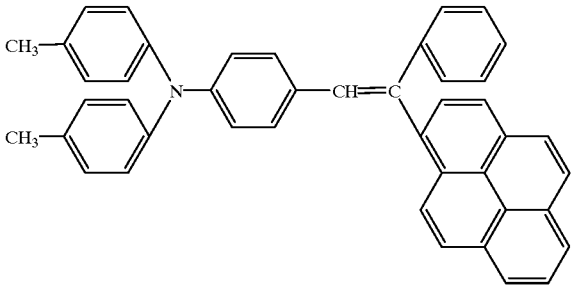 |
| 236 | 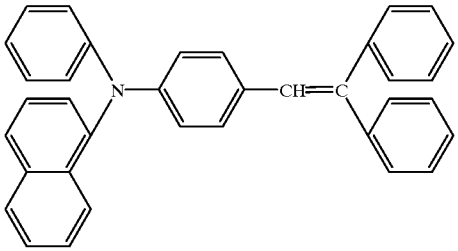 |
| 237 | 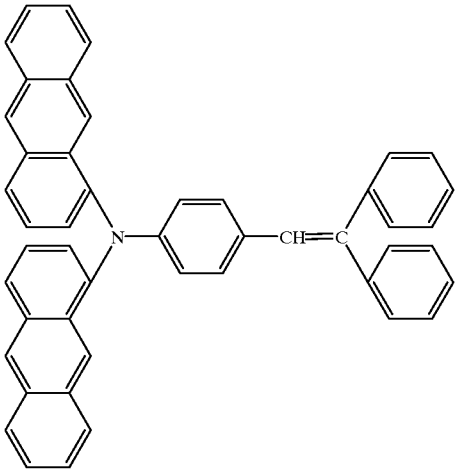 |

TABLE 1-continued
| Charge-transporting compounds | |
|---|---|
| No. | Structure |
| 238 | 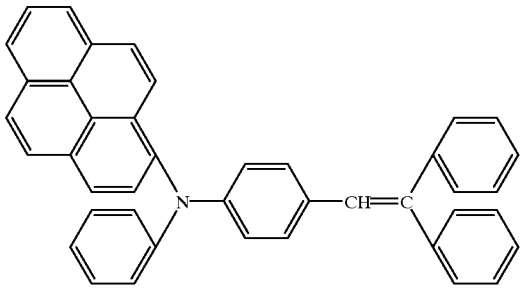 |
| 239 | 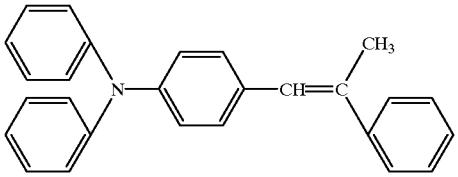 |
| 240 | 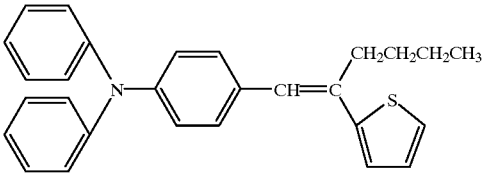 |
| 241 | 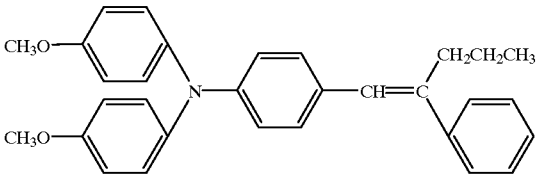 |
| 242 | 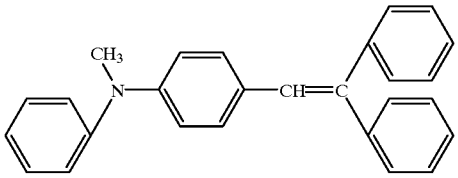 |
| 243 | 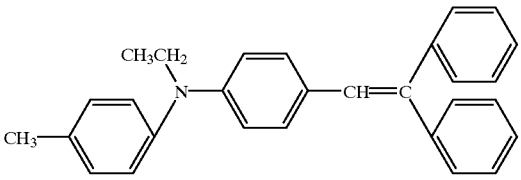 |

TABLE 1-continued
| No. | Charge-transporting compounds<br>Structure |
|---|---|
| 244 | 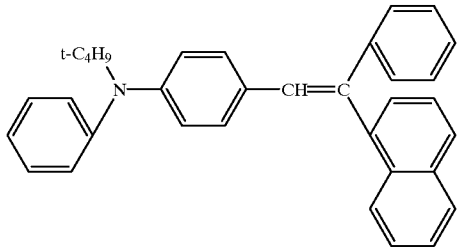 |
| 245 | 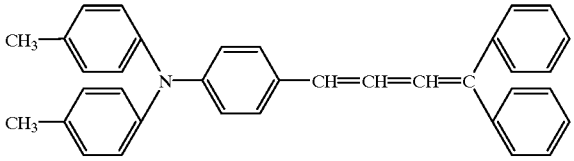 |
| 246 | 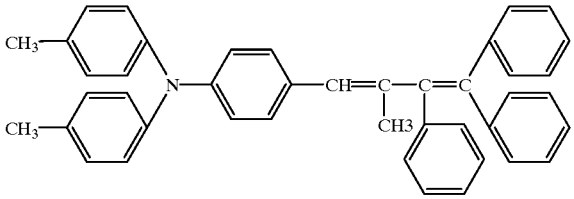 |
| 247 | 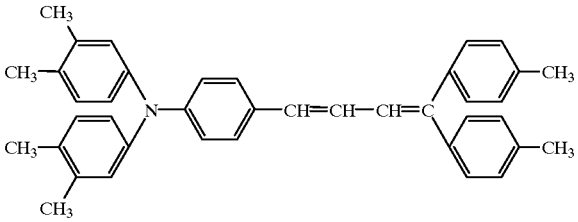 |
| 248 | 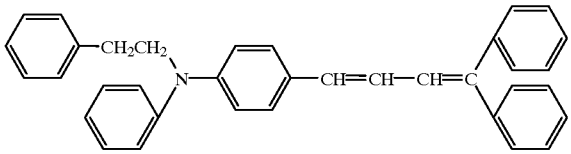 |
| 249 | 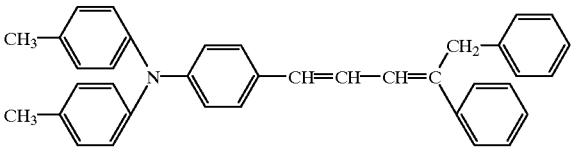 |
| 250 | 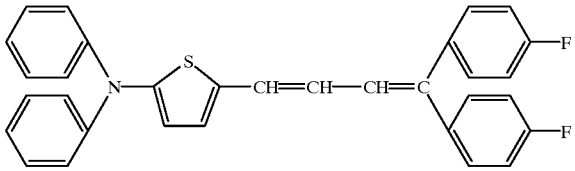 |

TABLE 1-continued
| Charge-transporting compounds | |
|---|---|
| No. | Structure |
| 251 | 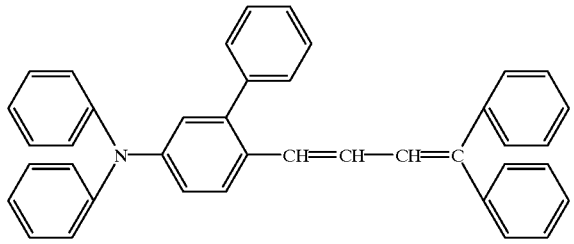 |
| 252 | 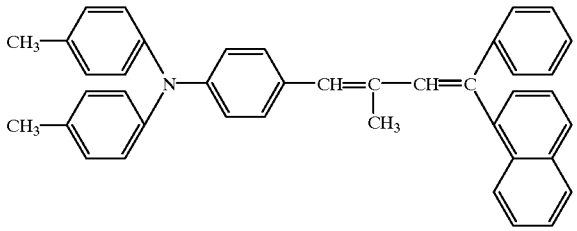 |
| 253 | 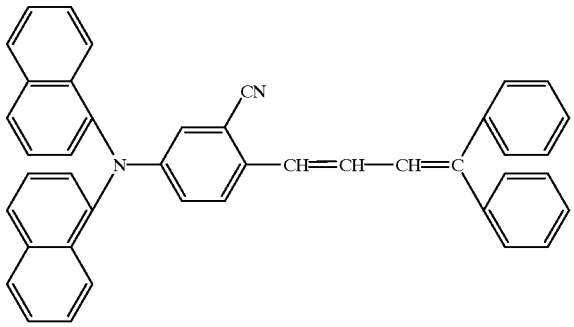 |
| 254 | 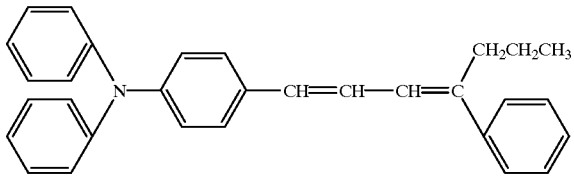 |
| 255 | 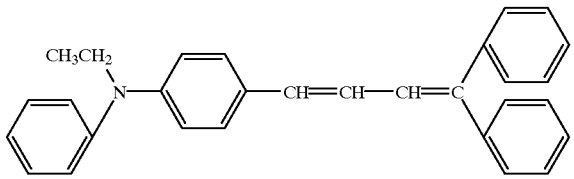 |
| 256 | 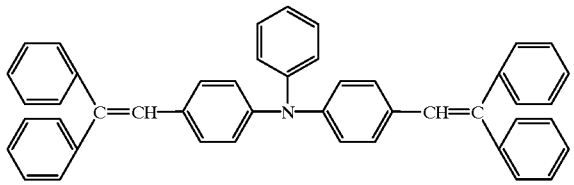 |

TABLE 1-continued
| Charge-transporting compounds | |
|---|---|
| No. | Structure |
| 257 | 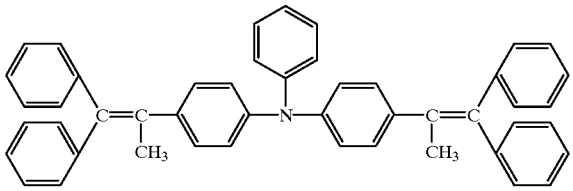 |
| 258 | 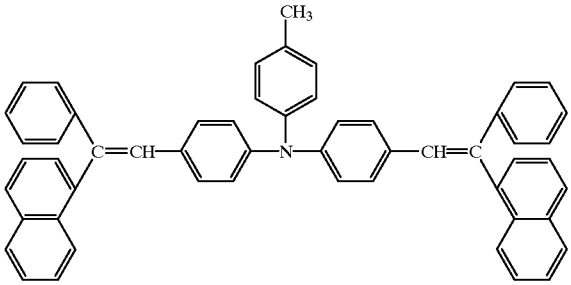 |
| 259 | 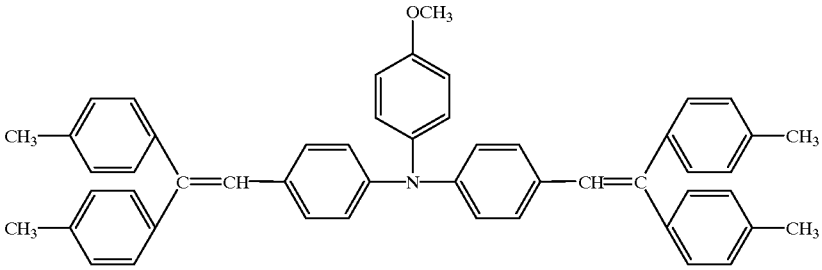 |
| 260 | 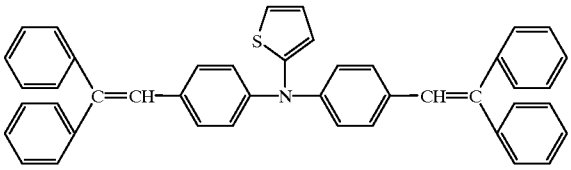 |
| 261 | 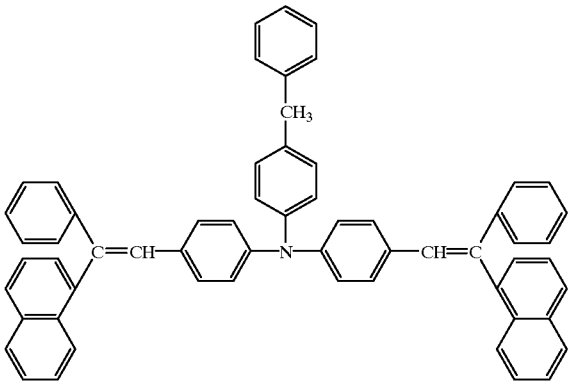 |

TABLE 1-continued
| Charge-transporting compounds | |
|---|---|
| No. | Structure |
| 262 | 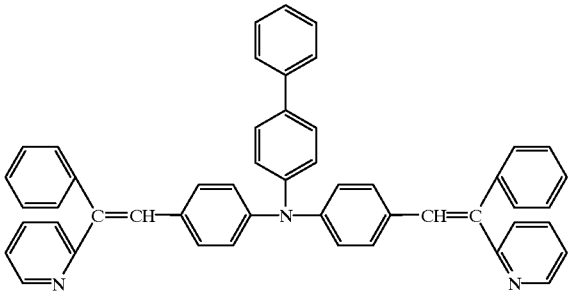 |
| 263 | 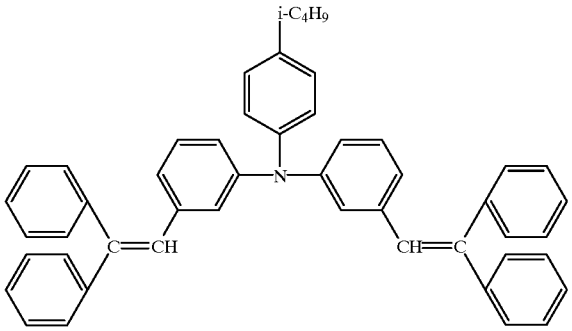 |
| 264 | 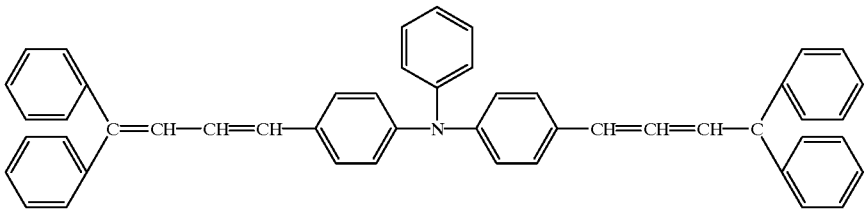 |
| 265 | 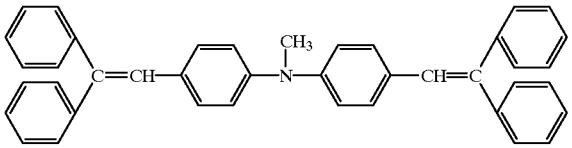 |
| 266 | 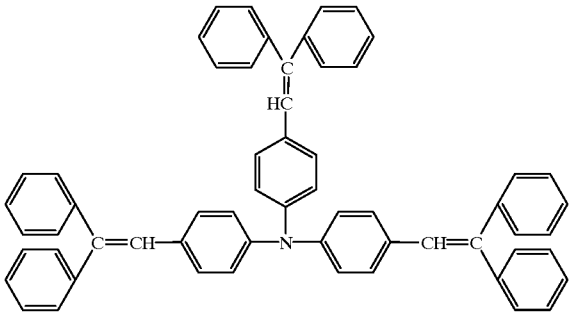 |

TABLE 1-continued
| Charge-transporting compounds | |
|---|---|
| No. | Structure |
| 267 | 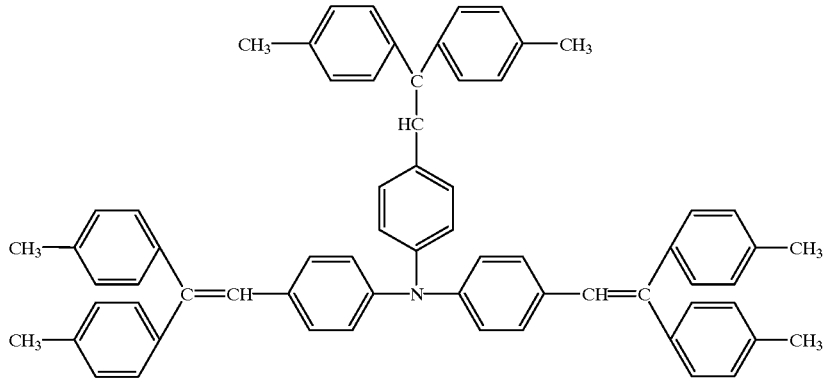 |
| 268 | 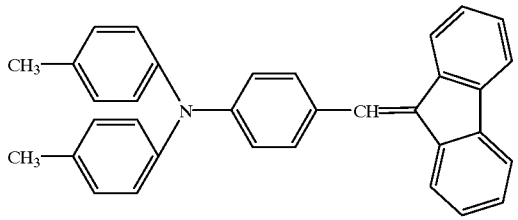 |
| 269 | 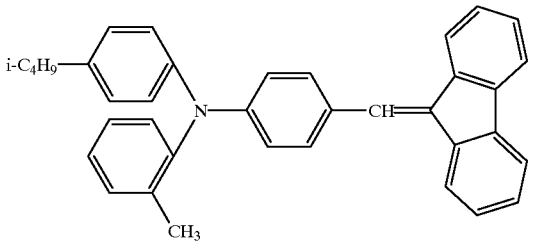 |
| 270 | 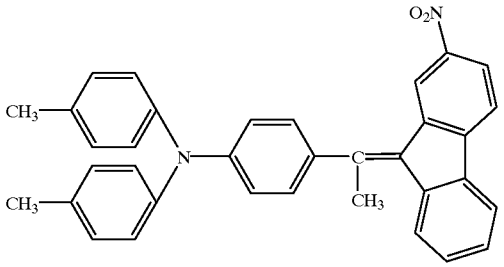 |
| 271 | 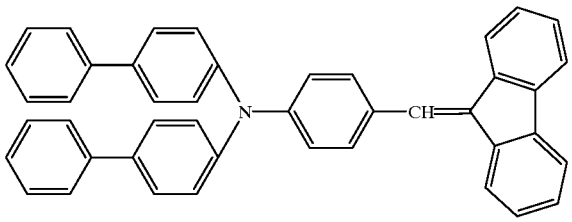 |

TABLE 1-continued
| Charge-transporting compounds | |
|---|---|
| No. | Structure |
| 272 | 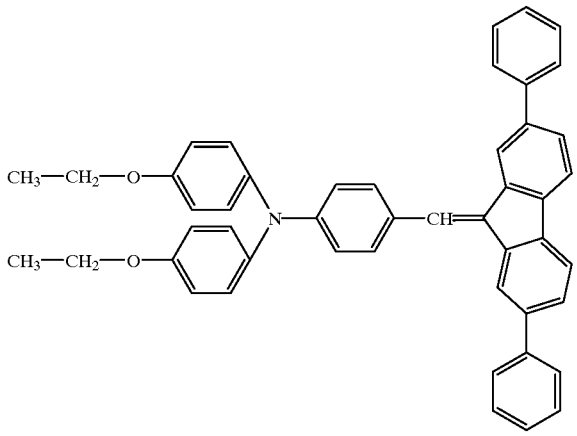 |
| 273 | 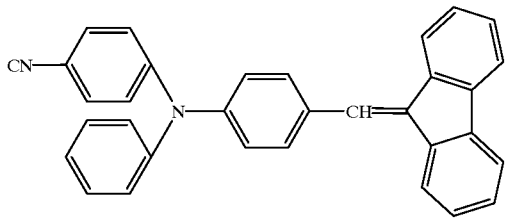 |
| 274 | 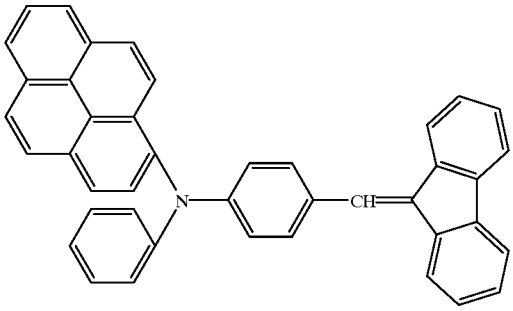 |
| 275 | 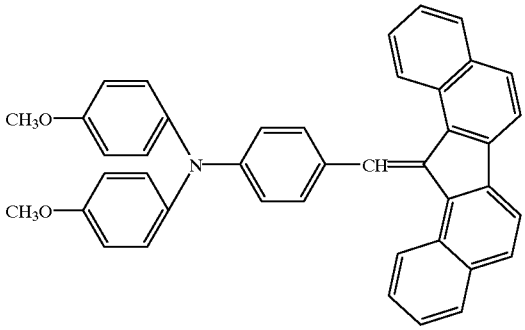 |

TABLE 1-continued
| Charge-transporting compounds | |
|---|---|
| No. | Structure |
| 276 | 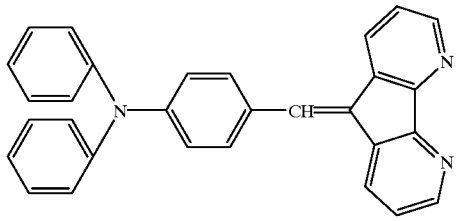 |
| 277 | 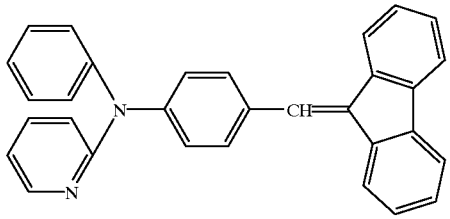 |
| 278 | 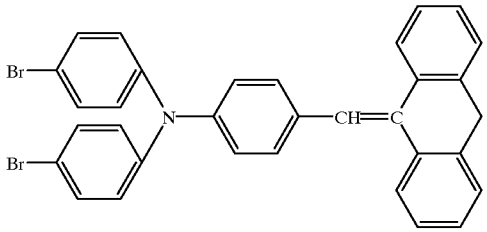 |
| 279 | 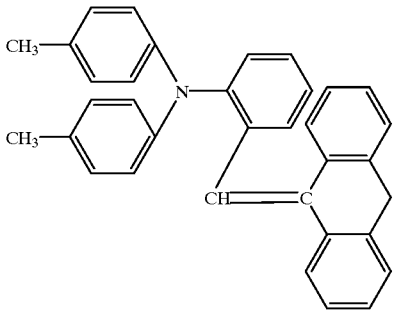 |
| 280 | 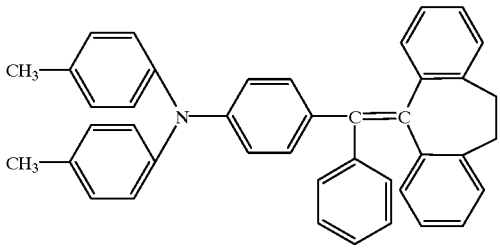 |

TABLE 1-continued
| Charge-transporting compounds | |
|---|---|
| No. | Structure |
| 281 | 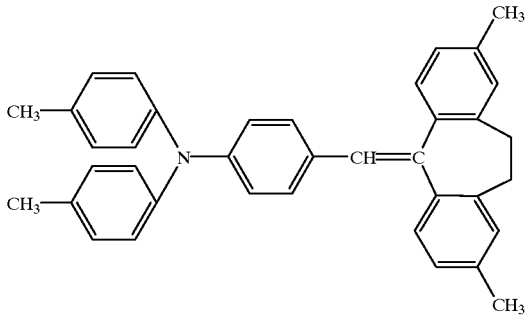 |
| 282 | 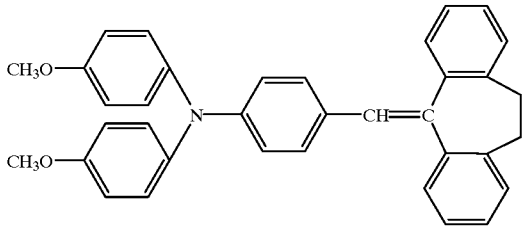 |
| 283 | 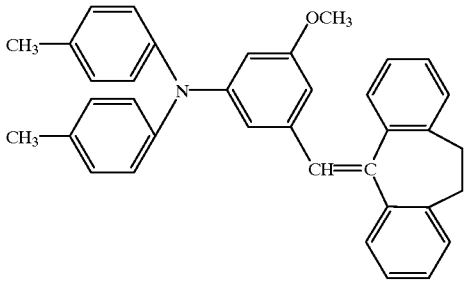 |
| 284 | 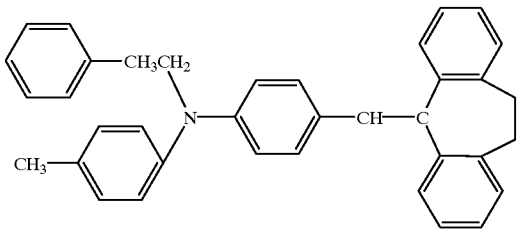 |
| 285 | 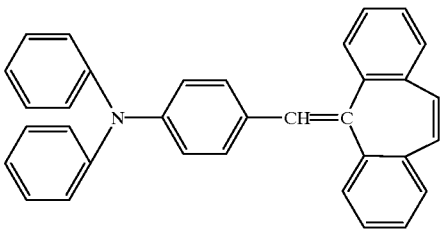 |

TABLE 1-continued
| Charge-transporting compounds | |
|---|---|
| No. | Structure |
| 286 | 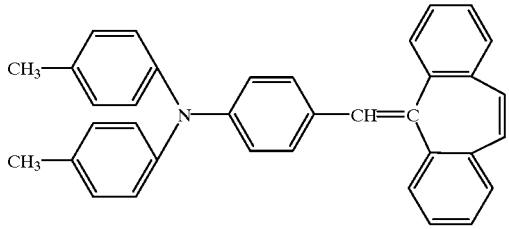 |
| 287 | 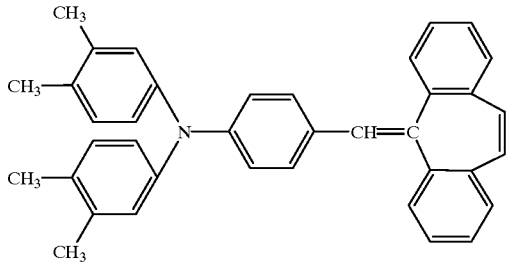 |
| 288 | 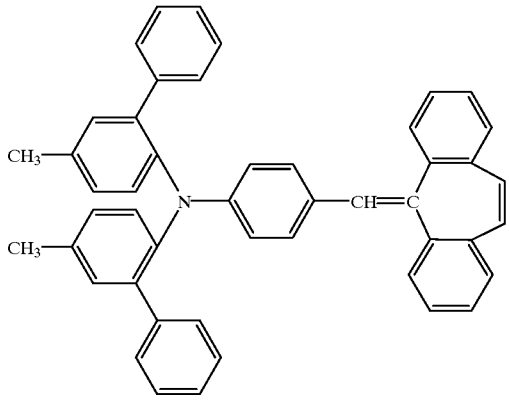 |
| 289 | 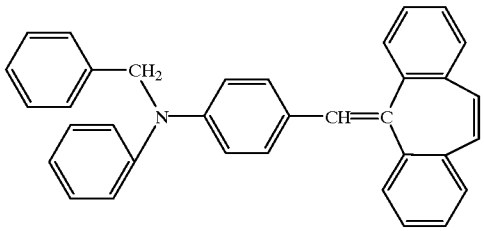 |
| 290 | 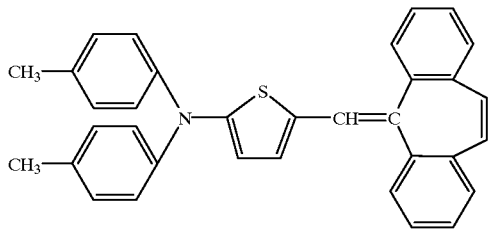 |

TABLE 1-continued
| Charge-transporting compounds | |
|---|---|
| No. | Structure |
| 291 | 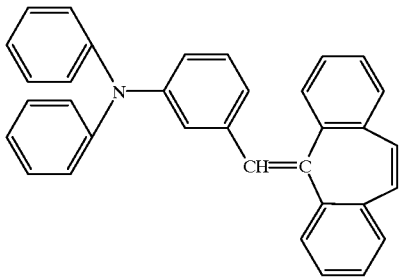 |
| 292 | 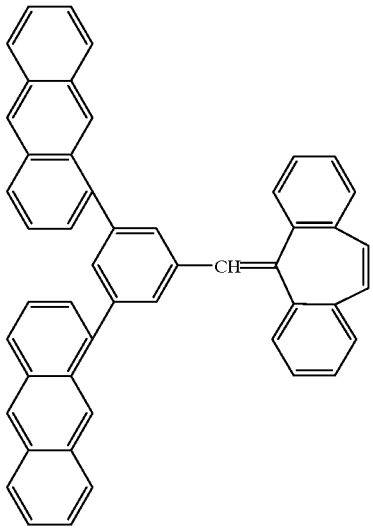 |
| 293 | 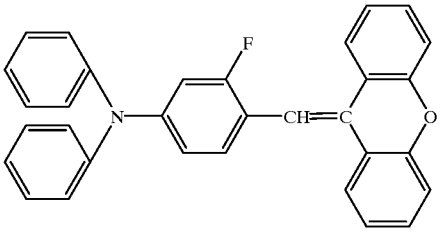 |
| 294 | 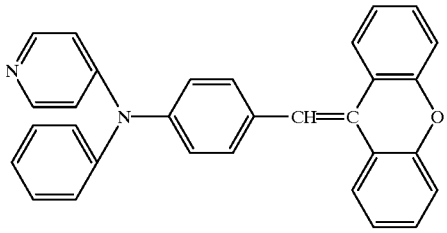 |

TABLE 1-continued
| No. | Charge-transporting compounds<br>Structure |
|---|---|
| 295 | 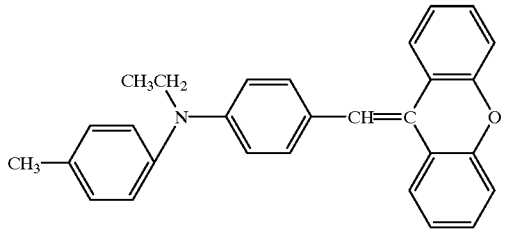 |
| 296 | 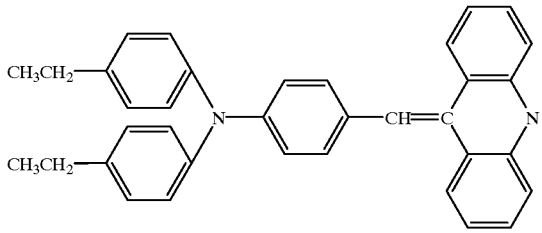 |
| 297 | 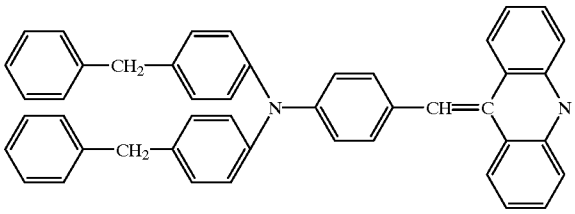 |
| 298 | 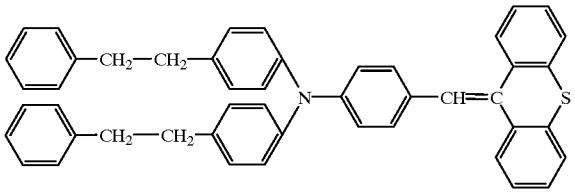 |
| 299 | 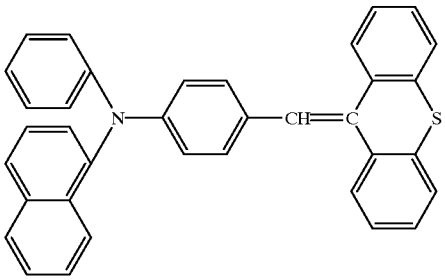 |
| 300 | 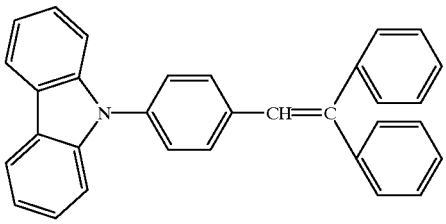 |

TABLE 1-continued
| No. | Charge-transporting compounds<br>Structure |
|---|---|
| 301 | 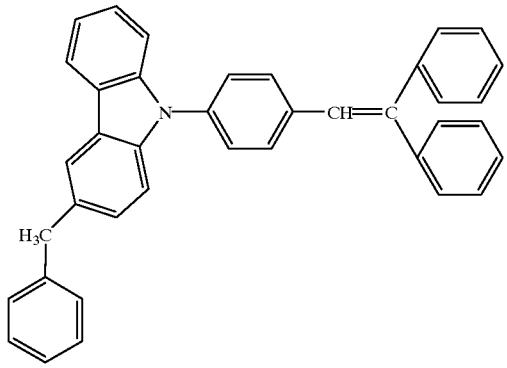 |
| 302 | 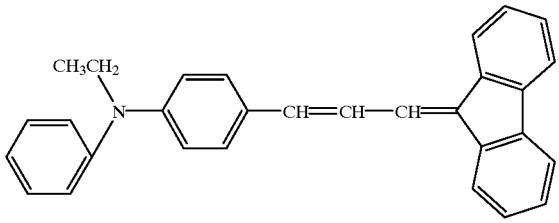 |
| 303 | 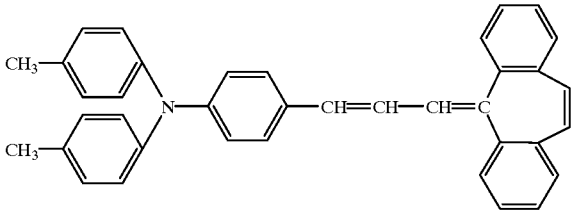 |
| 304 | 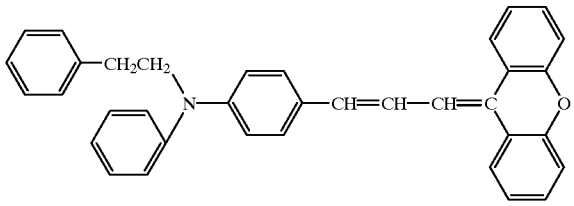 |
| 305 | 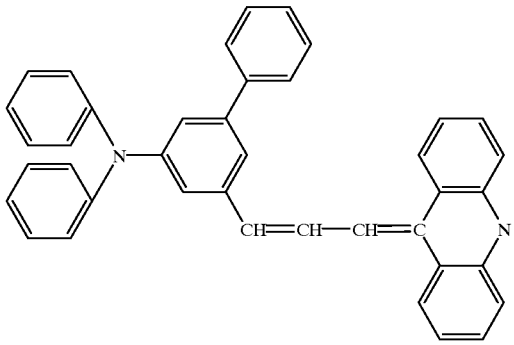 |

TABLE 1-continued
| Charge-transporting compounds | |
|---|---|
| No. | Structure |
| 306 | 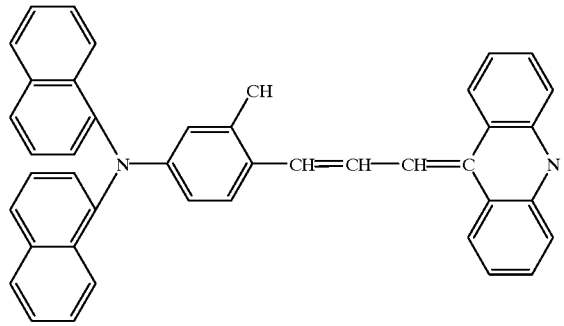 |
| 307 | 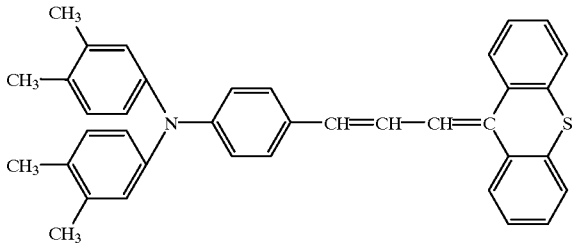 |
| 308 | 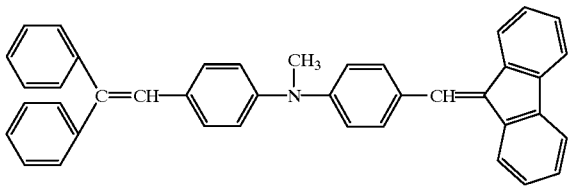 |
| 309 | 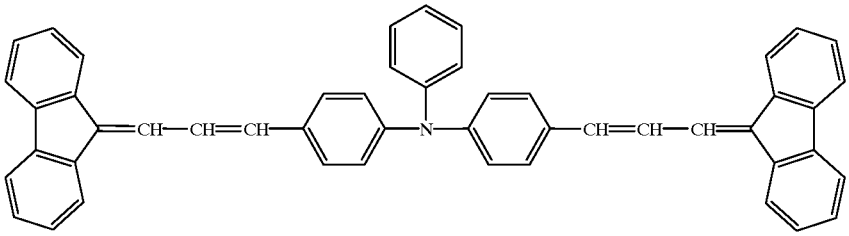 |
| 310 | 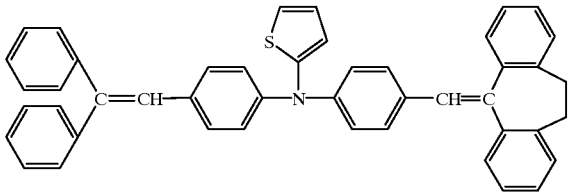 |
| 311 | 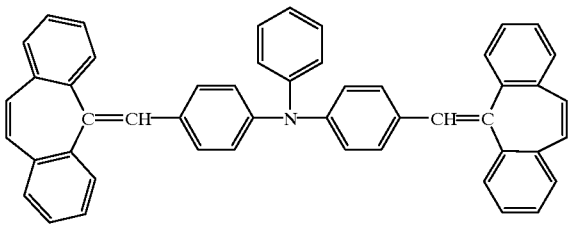 |

TABLE 1-continued
| Charge-transporting compounds | |
|---|---|
| No. | Structure |
| 312 | 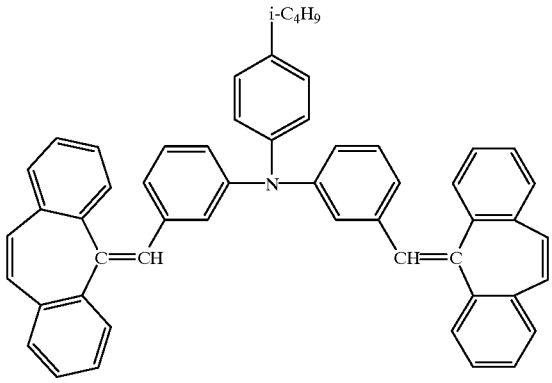 |
| 313 | 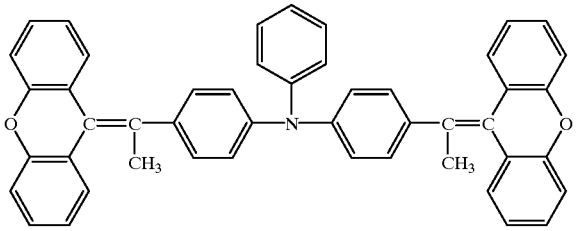 |
| 314 | 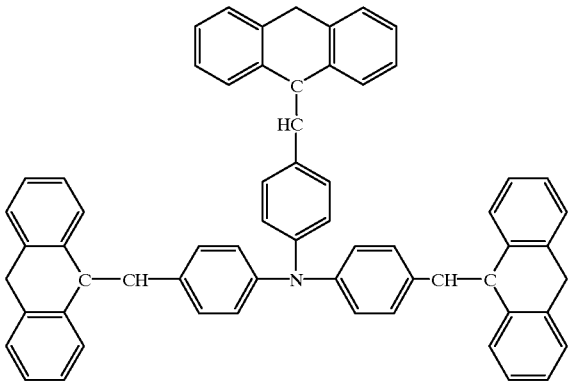 |
| 315 | 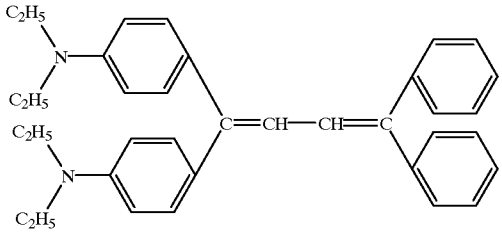 |

TABLE 1-continued
| Charge-transporting compounds | |
|---|---|
| No. | Structure |
| 316 | 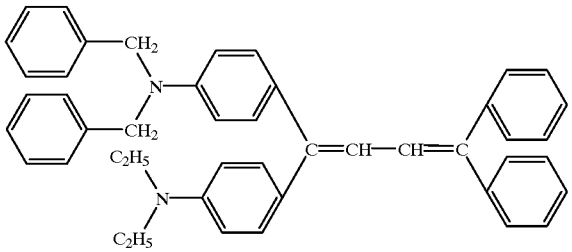 |
| 317 | 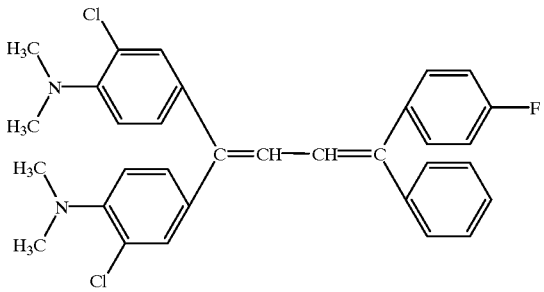 |
| 318 | 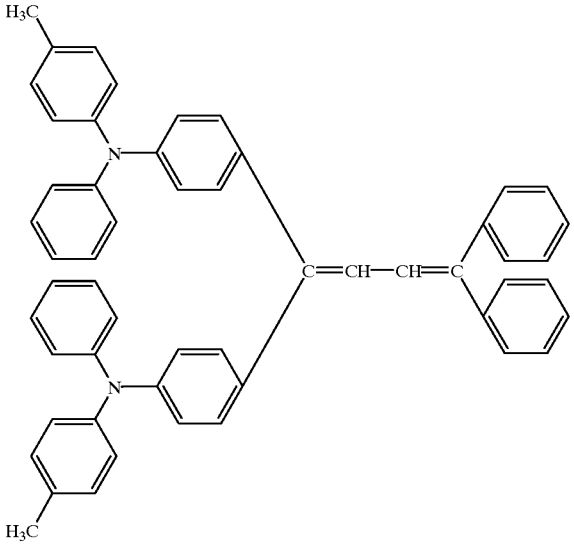 |
| 319 | 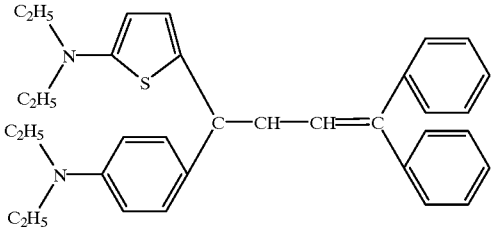 |

TABLE 1-continued
| Charge-transporting compounds | |
|---|---|
| No. | Structure |
| 320 | 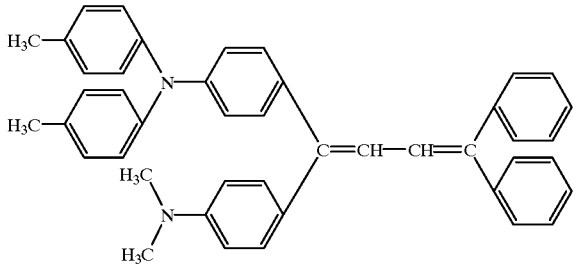 |
| 321 | 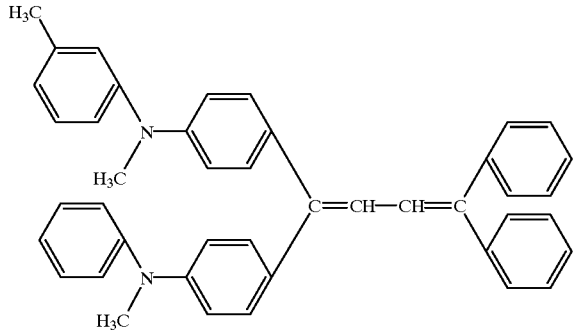 |
| 322 | 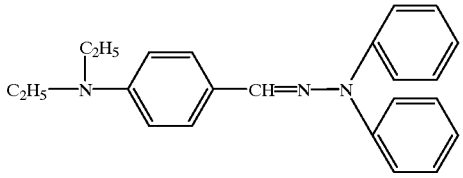 |
| 323 | 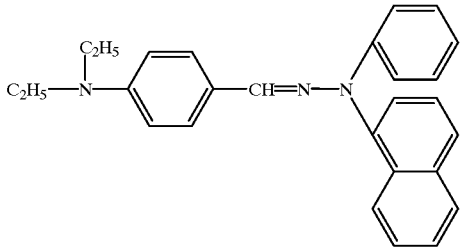 |
| 324 | 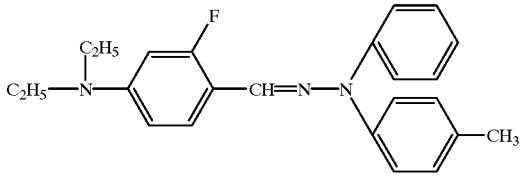 |
| 325 | 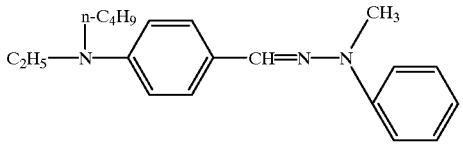 |

TABLE 1-continued
| Charge-transporting compounds | |
|---|---|
| No. | Structure |
| 326 | 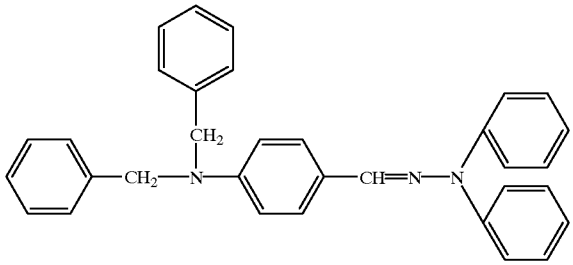 |
| 327 | 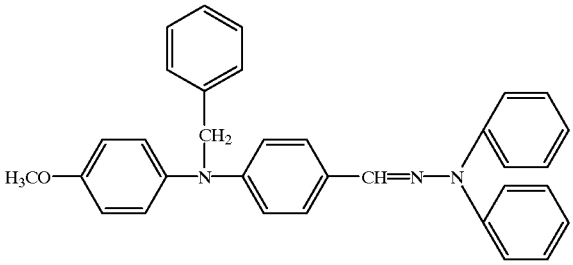 |
| 328 | 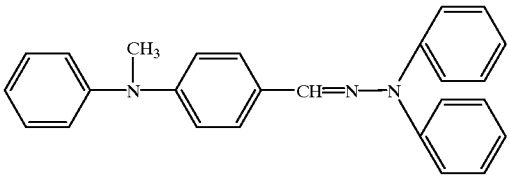 |
| 329 | 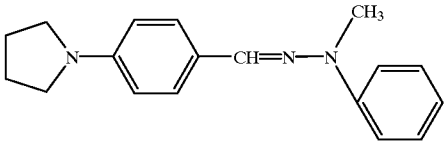 |
| 330 | 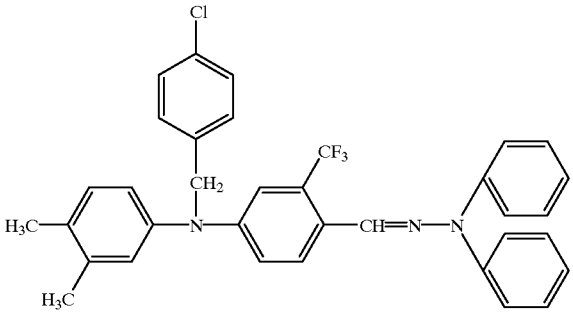 |
| 331 | 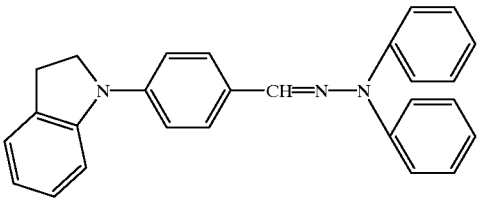 |

TABLE 1-continued
| Charge-transporting compounds | |
|---|---|
| No. | Structure |
| 332 | 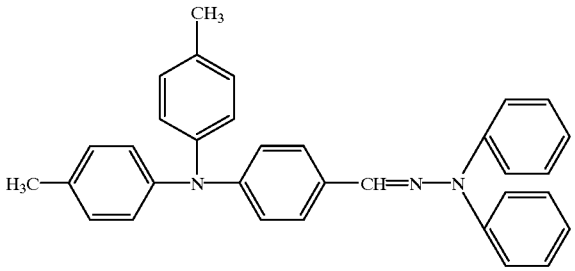 |
| 333 | 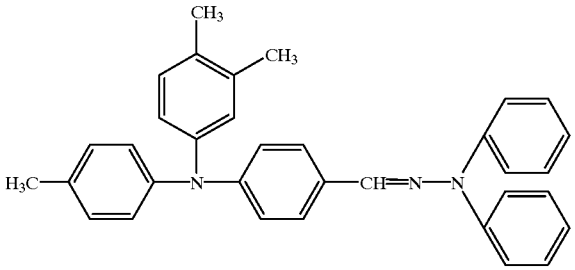 |
| 334 | 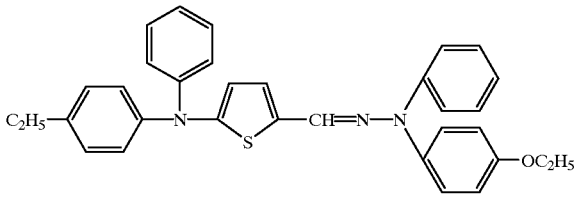 |
| 335 | 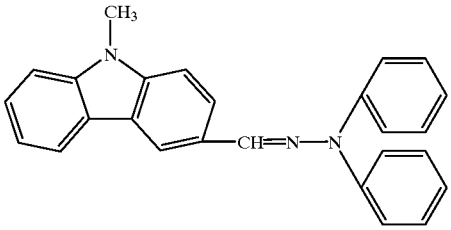 |
| 336 | 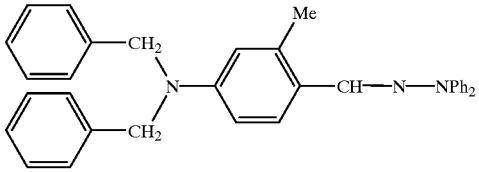 |
| 337 | 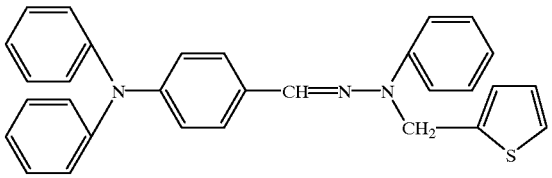 |

TABLE 1-continued
| Charge-transporting compounds | |
|---|---|
| No. | Structure |
| 338 | 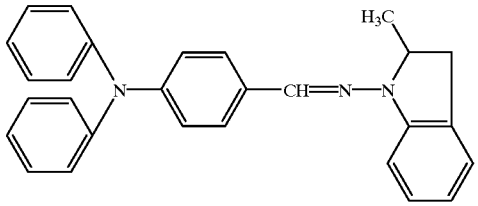 |
| 339 | 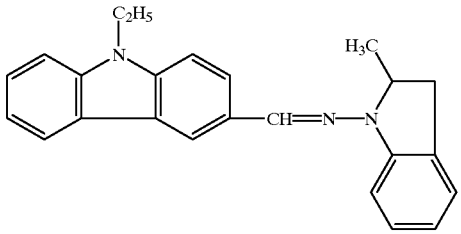 |
| 340 | 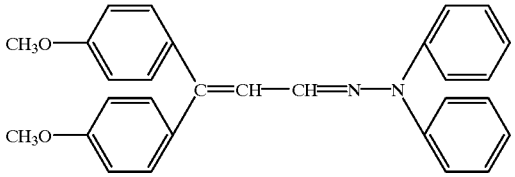 |
| 341 | 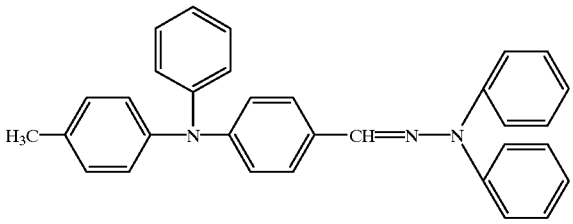 |
| 342 | 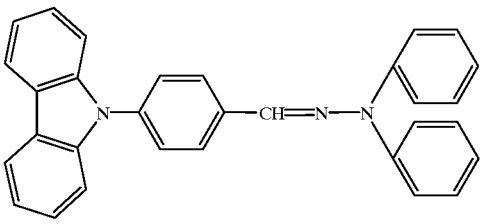 |
| 343 | 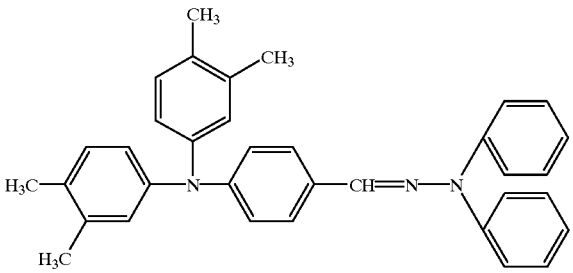 |

TABLE 1-continued
| Charge-transporting compounds | |
|---|---|
| No. | Structure |
| 344 | 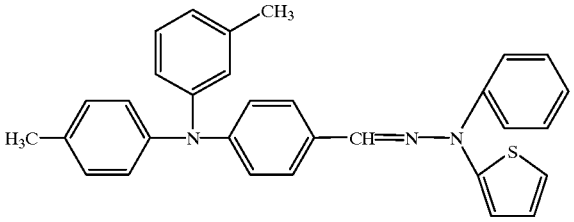 |
| 345 | 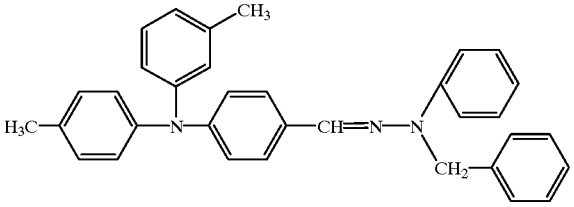 |
| 346 | 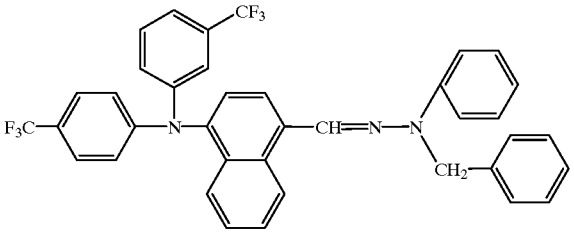 |
| 347 | 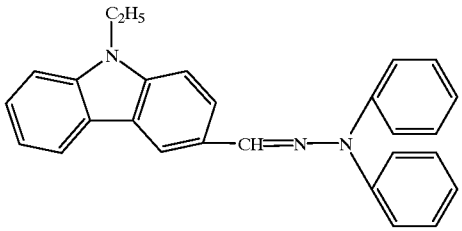 |
| 348 | 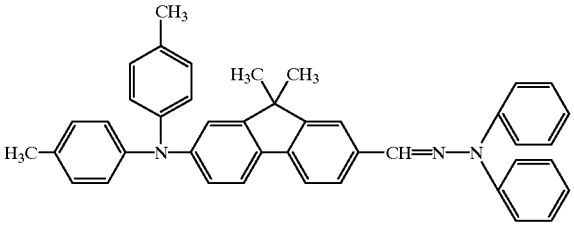 |
| 349 | 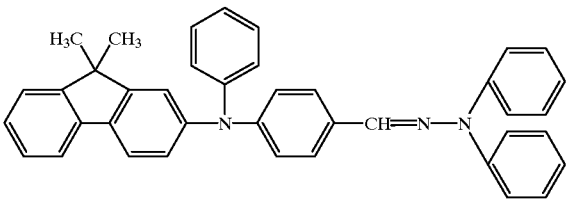 |

TABLE 1-continued
| Charge-transporting compounds | |
|---|---|
| No. | Structure |
| 350 | 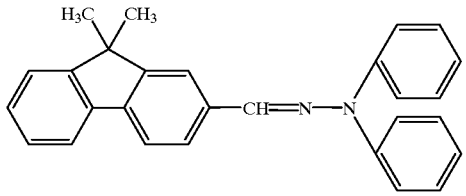 |
| 351 | 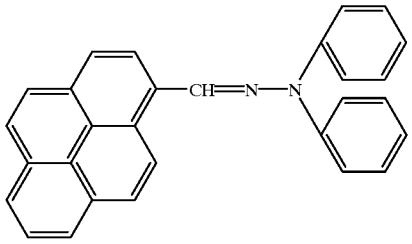 |
| 352 | 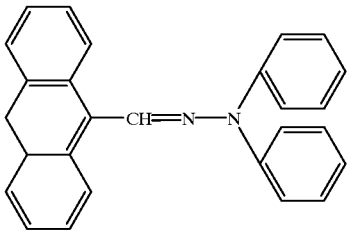 |
| 353 | 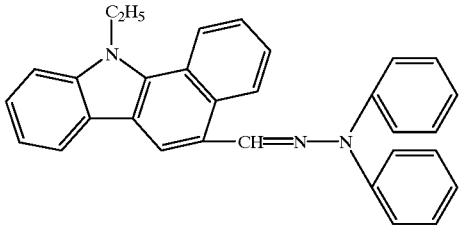 |
| 354 | 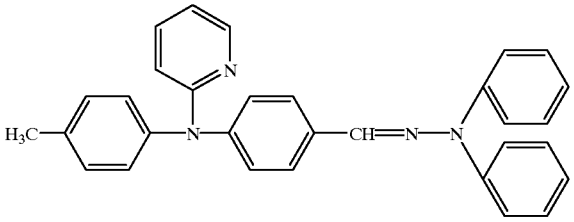 |
| 355 | 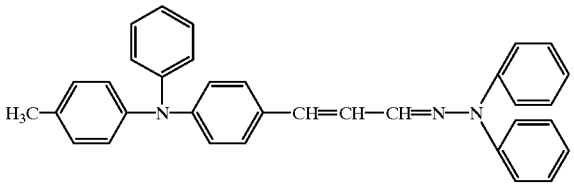 |

TABLE 1-continued
| Charge-transporting compounds | |
|---|---|
| No. | Structure |
| 356 | 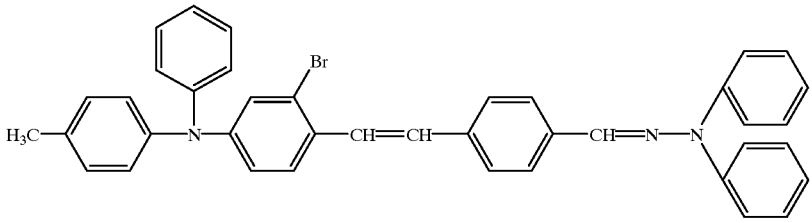 |
| 357 | 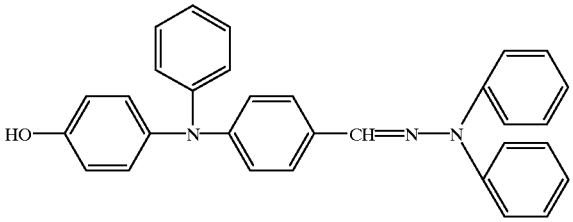 |
| 358 | 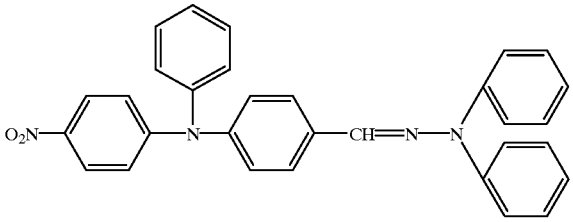 |
| 359 | 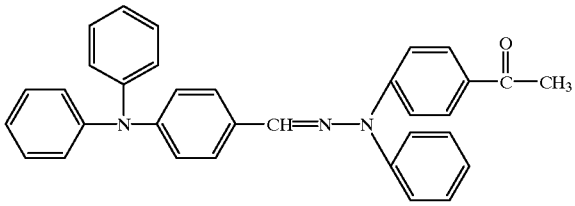 |
| 360 | 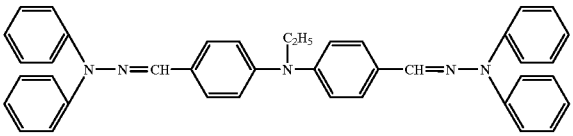 |
| 361 | 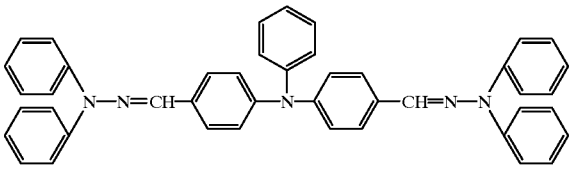 |

TABLE 1-continued
| Charge-transporting compounds | |
|---|---|
| No. | Structure |
| 362 | 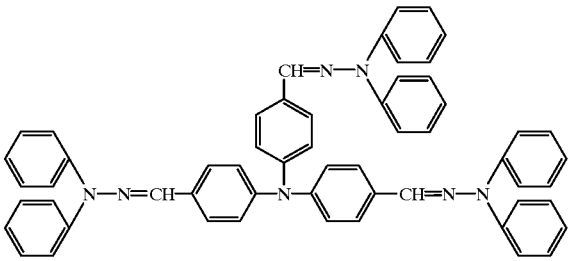 |
| 363 | 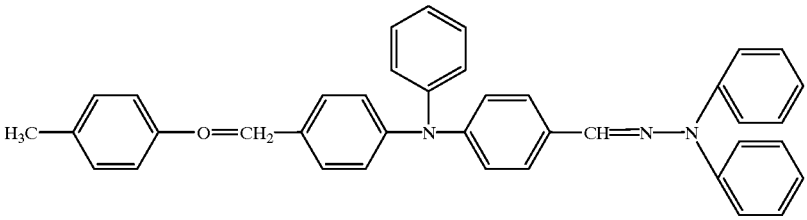 |
| 364 | 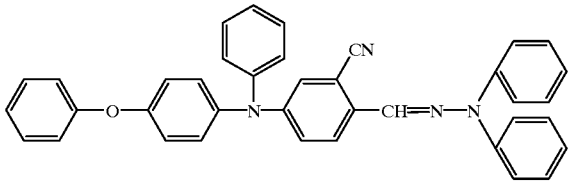 |
| 365 | 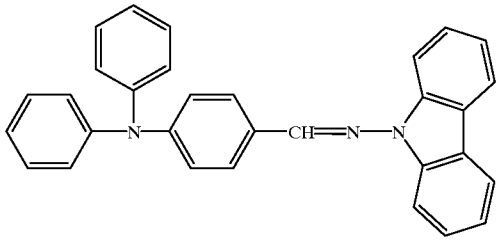 |
| 366 | 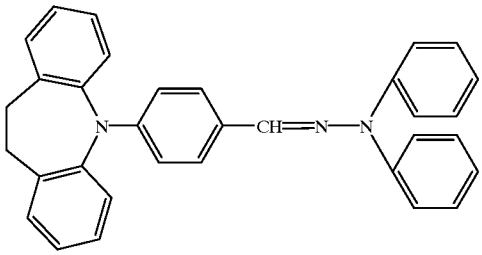 |
| 367 | 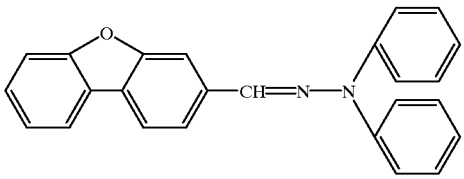 |

TABLE 1-continued
| Charge-transporting compounds | |
|---|---|
| No. | Structure |
| 368 | 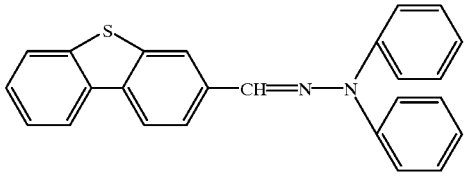 |
| 369 | 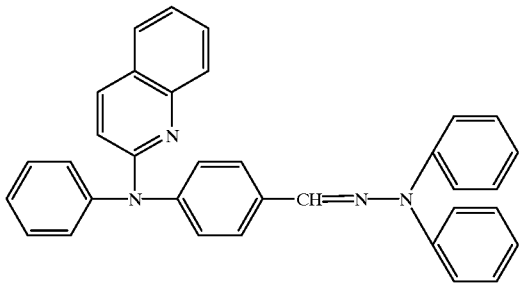 |
| 370 | 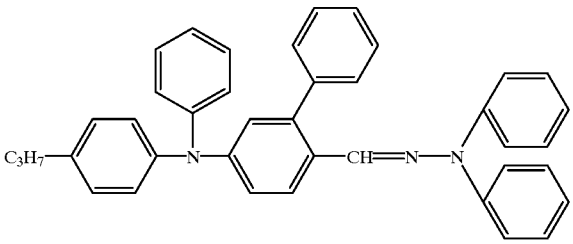 |
| 371 | 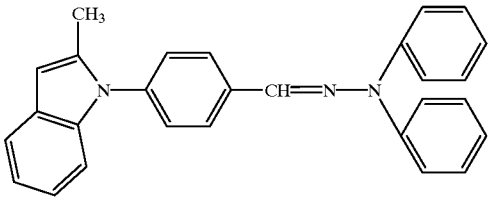 |
| 372 | 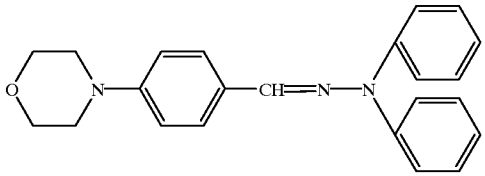 |
| 373 | 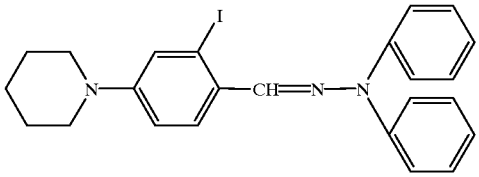 |

TABLE 1-continued

| Charge-transporting compounds | |
|---|---|
| No. | Structure |
| 374 | 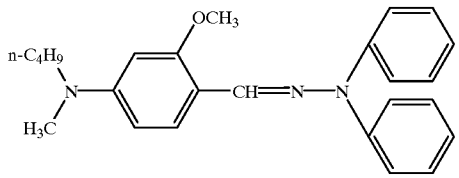 |

In order to effect stable injection charging under various environmental conditions ranging from low temperature/low humidity to high temperature/high humidity, it is preferred to incorporate the charge-transporting material in a surface layer comprising a binder resin having a dielectric constant (∈) in a limited range of 2.6–3.6.

Such a binder resin having a dielectric constant of 2.6–3.6 may be composed from a resin selected, for example, from polycarbonate resin, polyarylate resin, styrene-methacrylate copolymer resin, methacrylate resin, polyphenylene ether resin, polysulfone resin, and polyether-sulfone resin. These resins may be used in the form of homopolymers or singly, or in the form of copolymers having two or more structural units thereof at random or in blocks, or nay be used in the form of random or block copolymers with other structural units, such as silicone (or siloxane) units. It is also possible to use a blend of two or more different species of binder resins.

It is particularly preferred to use a binder resin comprising at least one of polycarbonate resin having a structural unit of formula (8) below, polyarylate resin having a structural unit of formula (9) below and styrene-methacrylate copolymer having a structural unit of formula (10) below:

[polycarbonate resin]

(8)

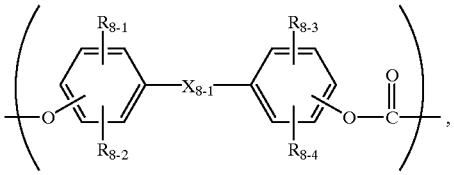

wherein $R_{8-1}$ to $R_{8-4}$ independently denote a hydrogen atom, an alkyl group capable of having a substituent, an aralkyl group capable of having a substituent, an alkoxy group or a halogen atom; and $X_{8-1}$ denotes a single bond (by which the two phenylene groups are directly bonded to each other), an alkylene groups capable of having a substituent, a phenylalkylidene group capable of having a substituent, a cycloalkylene group capable of having a substituent, a divalent aromatic cyclic group capable of having a substituent, a carbonyl group, a thiocarbonyl group, an oxygen atom, or a sulfur atom.

[polyarylate resin]

(9)

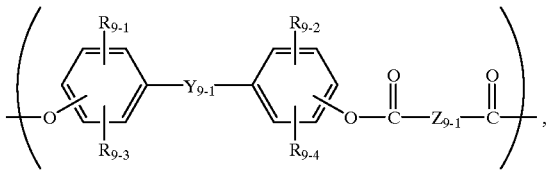

wherein $R_{9-1}$ to $R_{9-4}$ independently denote a hydrogen atom, an alkyl group capable of having a substituent, an aralkyl group capable of having a substituent, an alkoxy group or a halogen atom; $X_{9-1}$ denotes a single bond (by which the two phenylene groups are directly bonded to each other), an alkylene groups capable of having a substituent, a phenylalkylidene group capable of having a substituent, a cycloalkylene group capable of having a substituent, a divalent aromatic cyclic group capable of having a substituent, a carbonyl group, a thiocarbonyl group, an oxygen atom, or a sulfur atom; and $Z_{9-1}$ denotes an alkyl group capable of having a substituent, an alkylidene group capable of having a substituent, a phenylalkylidene group capable having a substituent, or a divalent aromatic cyclic group capable of having a substituent.

[styrene-methacrylate copolymer resin]

(10)

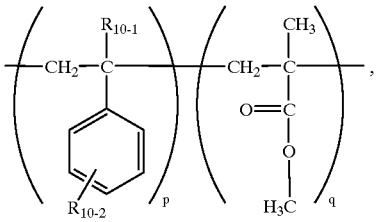

wherein $R_{10-1}$ and $R_{10-2}$ independently denote a hydrogen atom, an alkyl group capable of having a substituent, an aralkyl group capable of having a substituent, an aryl group capable of having a substituent, an alkoxy group, a halogen atom or a nitro group; and p/q represents a copolymerization ratio ranging from 9/1 to 3/7.

In the above notation to the formulae (8) to (10), examples of the alkyl group include: methyl, ethyl, propyl and butyl. Examples of the alkoxy group include: methoxy, ethoxy and phenoxy. Examples of the aralkyl group include: benzyl and phenetyl. Examples of the aryl group include: aromatic hydrocarbon groups, such as phenyl and naphthyl. Further, the halogen atoms include; fluorine, chlorine and bromine The alkylene groups include: methylene, ethylene and isopropylidene. The alkylidene groups include: vinylene. The phenylalkylidene groups include: diphenylmethylene and fluorenylidene The cycloalkylene groups include; cyclohexylidene and cyclopropylidene. The divalent aromatic cyclic groups include: those obtained by subtracting two hydrogen atoms from aromatic hydrocarbons, such as benzene, naphthalene, biphenyl and fluorene; heterocyclic compounds, such as thiophene, furan and oxadiazole; triphenylamine, and diphenyl sulfide.

Further, examples of the substituent optionally possessed by the above-mentioned groups may include: alkyl groups, such as methyl, ethyl, propyl, butyl and hexyl; alkoxy groups, such as methoxy, ethoxy and phenoxy; halogen atoms, such as fluorine, chlorine and bromine; aromatic hydrocarbon groups, such as phenyl, naphthyl and biphenyl; haloalkyl groups, such as trifluoromethyl; and nitro.

Incidentally, $R_{8-1}$ or $R_{8-2}$ can be bonded with $R_{8-3}$ or $R_{8-4}$ to form a 5-membered or 6-membered ring including $X_{8-1}$. Further, $R_{9-1}$ or $R_{9-2}$ can be bonded with $R_{9-3}$ or $R_{9-4}$ to form a 5-membered or 6-membered ring including $Y_{9-1}$.

The preferred binder resins having the structural unit of the formulae (8)–(10) may be homopolymers having one of these structural units, random or block copolymers having two or more species of these units or random or block copolymer also including another structural unit, such as that of silicone (or siloxane). The binder resin can also be a blend of two or more different resins.

The dielectric constants (∈) of binder resins described herein are based on values measured in the following manner. On an aluminum sheet, a solution of a sample binder resin is applied by a wire bar and dried to form a 10 μm-thick binder resin film. On the film, an electrode of gold is formed by vapor deposition. Then, the resultant sample is subjected to a measurement of dielectric constant at an AC frequency of 1 kHz by means of an impedance analyzer ("419A-LF", mfd. by Yokogawa HP K.K.).

Herein, some preferred but non-exhaustive examples of binder resins having a dielectric constant of 2.6–3.6 are enumerated hereinbelow, inclusive of some commercially available products:

[Binder No. B-1]

Polyphenylene ether ("X-9108" (trade name), made by Asahi Kasei Kogyo K.K.)

[Binder No. B-2]

Polyphenylene ether ("X-1711" (trade name), ditto)

[Binder No. B-3]

Polysulfone ("GF-120" (trade name), made by Teijin Acomo Engineering Plastic K.K.)

[Binder No. B-4]

Polysulfone ("P-1720" (trade name), ditto)

[Binder No. B-5]

Polyether sulfone ("A-200" (trade name), ditto).

Other examples are enumerated below together with recurring unit structural formulae with structural notations. More specifically, Table 2 below lists Binder resins of Formula (8) with the following positional notations, (8)

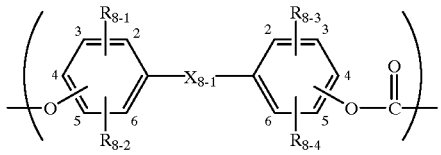

Table 3 list Binder resins of Formula (9) with the following positional notations:

(9)

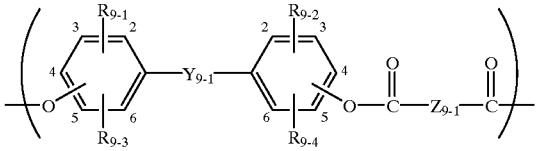

Table 4 lists Binder resins of Formula (10) with the following structural notations:

(10)

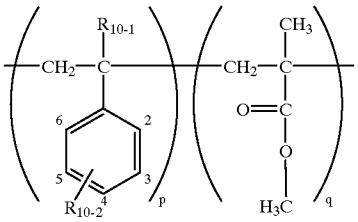

TABLE 2

Binder resins of Formula (8)

| No. | $R_{8-1}$ | $R_{8-2}$ | $R_{8-3}$ | $R_{8-4}$ | position of —O— | position of —O—C(=O)— | $X_{8-1}$ |
|---|---|---|---|---|---|---|---|
| B-5 | H | H | H | H | 4 | 4 | single bond |
| B-6 | H | H | H | H | 3 | 3 | single bond |
| B-7 | 3-$CH_3$ | H | 3-$CH_3$ | H | 4 | 4 | single bond |
| B-8 | 3-Cl | H | 3-Cl | H | 4 | 4 | single bond |
| B-9 | 3-$OCH_3$ | H | 3-$OCH_3$ | H | 4 | 4 | single bond |
| B-10 | 3- 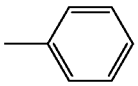 | H | 3- 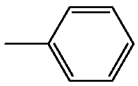 | H | 4 | 4 | 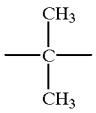 |

TABLE 2-continued
Binder resins of Formula (8)
| No. | $R_{8-1}$ | $R_{8-2}$ | $R_{8-3}$ | $R_{8-4}$ | position of —O— | position of —O—C(=O)— | $X_{8-1}$ |
|---|---|---|---|---|---|---|---|
| B-11 | 3- 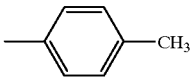 | H | 3- 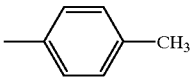 | H | 4 | 4 | 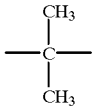 |
| B-12 | H | H | H | H | 4 | 4 | 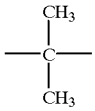 |
| B-13 | H | H | H | H | 2 | 2 | 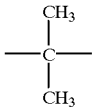 |
| B-14 | 3-$CH_3$ | H | 3-$CH_3$ | H | 4 | 4 | 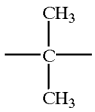 |
| B-15 | 3-F | H | 3-F | H | 4 | 4 | 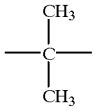 |
| B-16 | 3-$OCH_3$ | H | 3-$OCH_3$ | H | 4 | 4 | 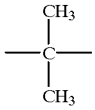 |
| B-17 | 3-$CH_3$ | 5-$CH_3$ | H | H | 4 | 4 | 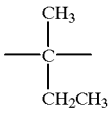 |
| B-18 | H | H | H | H | 4 | 4 | 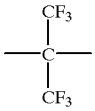 |
| B-19 | H | H | H | H | 3 | 3 | 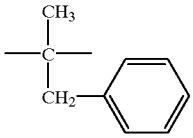 |
| B-20 | 2-$CH_3$ | H | 2-$CH_3$ | H | 4 | 4 | 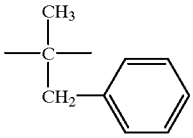 |

TABLE 2-continued
Binder resins of Formula (8)
| No. | $R_{8-1}$ | $R_{8-2}$ | $R_{8-3}$ | $R_{8-4}$ | position of —O— | position of —O—C(=O)— | $X_{8-1}$ |
|---|---|---|---|---|---|---|---|
| B-21 | H | H | H | H | 4 | 4 | 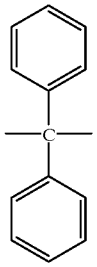 |
| B-22 | 3-$CH_3$ | H | 2-$CH_3$ | H | 4 | 4 | 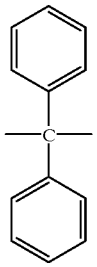 |
| B-23 | H | H | H | H | 4 | 4 | 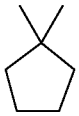 |
| B-24 | H | H | H | H | 4 | 4 | 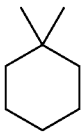 |
| B-25 | 3- 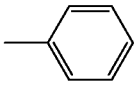 | H | 3- 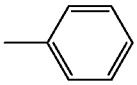 | H | 4 | 4 | 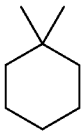 |
| B-26 | H | H | H | H | 4 | 4 | 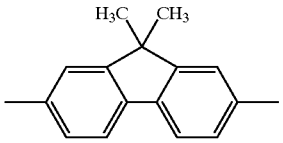 |
| B-27 | H | H | H | H | 4 | 4 | 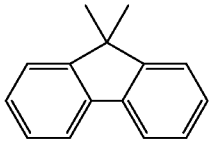 |
| B-28 | H | H | H | H | 4 | 4 | —O— |
| B-29 | 3-Br | H | 3-Br | H | 4 | 4 | —O— |
| B-30 | H | H | H | H | 4 | 4 | —S— |

TABLE 2-continued

Binder resins of Formula (8)

| No. | $R_{8-1}$ | $R_{8-2}$ | $R_{8-3}$ | $R_{8-4}$ | position of —O— | position of —O—C(=O)— | $X_{8-1}$ |
|---|---|---|---|---|---|---|---|
| B-31 | H | H | H | H | 4 | 4 | —C(=O)— |
| B-32 | H | H | H | H | 4 | 4 | —CH=CH— |
| B-33 | 3-$CH_3$ | 6-$CH_3$ | 3-$CH_3$ | 6-$CH_3$ | 4 | 4 | —$CH_2CH_2$— |
| B-34 | H | H | H | H | 4 | 4 | 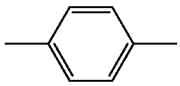 |
| B-35 | H | H | H | H | 3 | 3 | —C($CH_3$)$_2$— |
| B-36 | H | 6-6 bond* H | H | H | 3 | 3 | —C(n-$C_4H_9$)$_2$— |
| B-34 | H | 6-6 bond* H | H | H | 3 | 3 | —C(=O)— |
| B-35 | H | 6-6 bond* H | H | H | 3 | 3 | —C(=S)— |
| B-36 | H | 6-6 bond* H | H | H | 3 | 3 | —CH=CH— |
| B-37 | H | 6-6 bond* H | H | H | 3 | 3 | —C($H_3C$)=C($CH_3$)— |
| B-38 | 3- 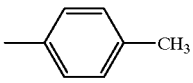 | 6-6 bond* H | 3- 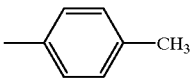 | H | 4 | 4 | 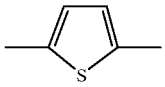 |
| BB-39 | H | H | H | H | 4 | 4 | 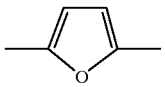 |
| B-40 | H | H | H | H | 2 | 2 | 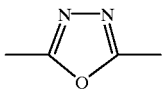 |
| B-41 | 3-$CH_3$ | H | 3-$CH_3$ | H | 4 | 4 | —C(H)$_2$— |

*6-position carbons of two benzene rings and directly bonded to form an additional ring including $X_{8-1}$.

TABLE 3
Binder resins of Formula (9)
| No. | $R_{9-1}$ | $R_{9-2}$ | $R_{9-3}$ | $R_{9-4}$ | position of —O— | position of O —O—C—$Z_{9-1}$ | $Y_{9-1}$ | $Z_{9-1}$ |
|---|---|---|---|---|---|---|---|---|
| B-45 | H | H | H | H | 4 | 4 | single bond | 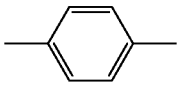 |
| B-46 | 3-F | H | 3-F | H | 4 | 4 | single bond | 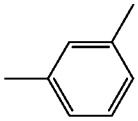 |
| B-47 | H | H | H | H | 4 | 4 | 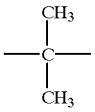 | 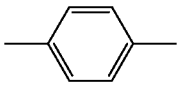 |
| B-48 | 3-$CH_3$ | H | 3-$CH_3$ | H | 4 | 4 | 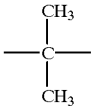 | 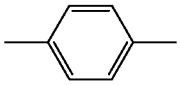 |
| B-49 | H | H | H | H | 4 | 4 | 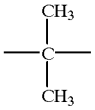 | 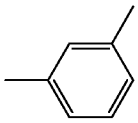 |
| B-50 | 3-$CH_3$ | H | 3-$CH_3$ | H | 4 | 4 | 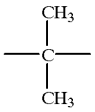 | 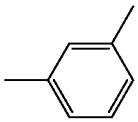 |
| B-51 | H | H | H | H | 4 | 4 | 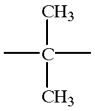 | 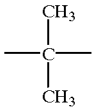 |
| B-52 | 3-$CF_3$ | H | 3-$CF_3$ | H | 4 | 4 | 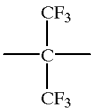 | 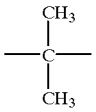 |
| B-53 | H | H | H | H | 4 | 4 | 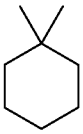 | 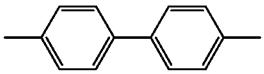 |
| B-54 | 3-$CH_3$ | H | 3-$CH_3$ | H | 4 | 4 | 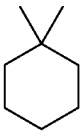 | 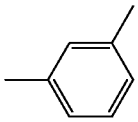 |

TABLE 3-continued
| | | | | | Binder resins of Formula (9) | | | |
|---|---|---|---|---|---|---|---|---|
| No. | $R_{9-1}$ | $R_{9-2}$ | $R_{9-3}$ | $R_{9-4}$ | position of —O— | position of O —O—C—$Z_{9-1}$ | $Y_{9-1}$ | $Z_{9-1}$ |
| B-55 | 3-$OCH_3$ | H | 3-$OCH_3$ | H | 4 | 4 | 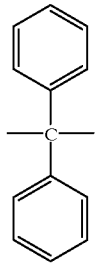 | 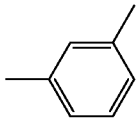 |
| B-56 | H | H | H | H | 4 | 4 | 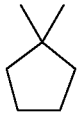 | 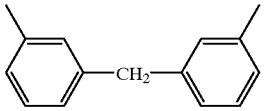 |
| B-57 | 3-$CH_3$ | H | 3-$CH_3$ | H | 4 | 4 | 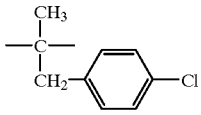 | 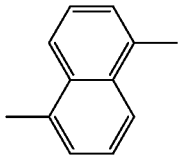 |
| B-58 | H | H | H | H | 4 | 4 | 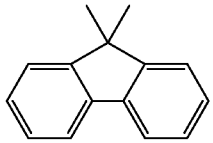 | 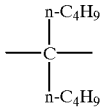 |
| B-59 | H | H | H | H | 4 | 4 | —O— | 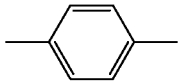 |
| B-60 | 3-$CH_3$ | H | 3-$CH_3$ | H | 4 | 4 | —S— | 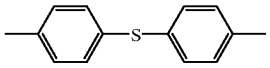 |
| B-61 | H | H | H | H | 4 | 4 | 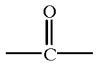 | 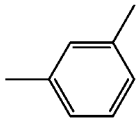 |
| B-62 | 3- 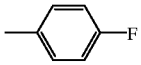 | H | 3- 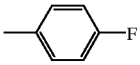 | H | 4 | 4 | —CH═CH— | 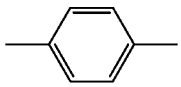 |
| B-63 | H | H | H | H | 3 | 3 | 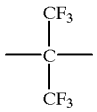 | 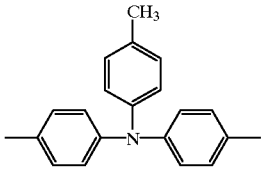 |

TABLE 3-continued

Binder resins of Formula (9)

| No. | $R_{9-1}$ | $R_{9-2}$ | $R_{9-3}$ | $R_{9-4}$ | position of —O— | position of O —O—C—$Z_{9-1}$ | $Y_{9-1}$ | $Z_{9-1}$ |
|---|---|---|---|---|---|---|---|---|
| B-64 | H | H | H | H | 4 | 4 | 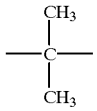 | 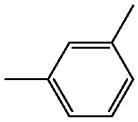 |
| | | 6-6 bond | | | | | | |

TABLE 4

Binder resins of Formula (10)

| No. | $R_{10-1}$ | $R_{10-2}$ | p | q |
|---|---|---|---|---|
| B-65 | H | H | 9 | 1 |
| B-66 | H | H | 8 | 2 |
| B-67 | H | H | 5 | 5 |
| B-68 | H | H | 3 | 7 |
| B-69 | $CH_3$ | H | 8 | 2 |
| B-70 | $CH_3$ | H | 4 | 6 |
| B-71 | $CH_3$ | 4-$NO_2$ | 7 | 3 |
| B-72 | 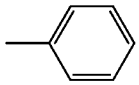 | 2-$NO_2$ | 8 | 2 |
| B-73 | 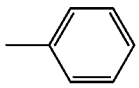 | 4- 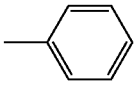 | 8 | 2 |
| B-74 | 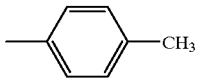 | H | 5 | 5 |
| B-75 | 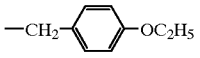 | H | 8 | 2 |
| B-76 | 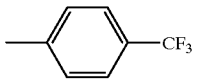 | 4-$CF_3$ | 8 | 2 |
| B-77 | H | 4-Br | 7 | 3 |
| B-78 | $CF_3$ | 3-$CH_3$ | 3 | 7 |
| B-79 | $CH_3$ | 4- 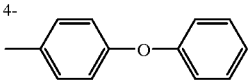 | 8 | 2 |
| B-80 | t-$C_4H_9$ | H | 4 | 6 |
| B-81 | H | 4-$OCH_3$ | 4 | 6 |
| B-82 | 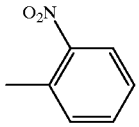 | 2-$NO_2$ | 8 | 2 |

TABLE 4-continued

Binder resins of Formula (10)

| No. | $R_{10-1}$ | $R_{10-2}$ | p | q |
|---|---|---|---|---|
| B-83 | 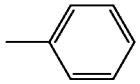 | 4- 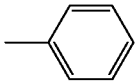 | 8 | 2 |
| B-84 | 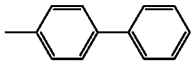 | 4- 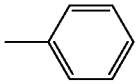 | 7 | 3 |

In the present invention, owing to the presence of charging promoter particles at mutually contacting surfaces (i.e., nip portions) of the electrophotographic photosensitive member and the contact charging member, the contact charging member is allowed to intimately contact the photosensitive member, and the charging promoter particles constantly rub the photosensitive member surface, whereby charges are directly injected into the photosensitive member at a furthermore high efficiency due to the presence of a charge-transporting material having an oxidation potential of 0.4–1.0 volt in the surface layer of the photosensitive member.

The charging promoter particles may comprise electroconductive inorganic fine particles of metal oxide or a mixture thereof with an organic material. A preferred example thereof comprise zinc oxide particles. It is also preferred that the charging member is moved at a peripheral speed that differs from that of the photosensitive member so as to provide a higher contact frequency advantageous for high-efficiency charge injection.

More specifically, in the charging of the photosensitive member by means of the contact charging member, the presence of charging promoter particles and the use of a photosensitive member having a surface layer having a specified property improve the problem of the insufficient contact of the charging member and the injection performance between the charging member and the photosensitive member, whereby the charging uniformity is remarkably improved, and the injection charging mechanism becomes predominant, without being seriously governed by the charging performance of the charging member per se. Accordingly, it has become possible to attain a high charging efficiency that cannot be realized by conventional fur-brush charging or roller charging, and provide the photosensitive member with a potential that is comparable to the applied voltage.

As a result, even in the case of using a fur brush or charging roller that is a simple contact charging member, it becomes possible to realize a stable and safe charging system not relying on discharge phenomenon but applying to the contact-charging member a charging bias voltage that is comparable to a potential necessary for the photosensitive member. Thus, it becomes possible to realize ozoneless injection charging at a low application voltage, i.e., a contact charging system that is excellent in charging uniformity and long term stability, by using a contact charging member of a simple structure.

Further, it is possible to realize uniform charging performance without difficulties of ozonic products and an image forming apparatus of a simple structure and a low production cost without suffering from charging failure. Further, by providing a means for supplying electroconductive charging promoter particles, the charging can be stably performed even when the apparatus is used for a long term.

In the present invention, it is preferred that the electroconductive charging promoter particles are present on the photosensitive member at a density of at least 100 particles/$mm^2$ and have a resistivity of at most $1\times10^{12}$ ohm.cm, more preferably at most $1\times10^{10}$ ohm.cm, so as to realize more uniform and stable injection charging The charging promoter particle may preferably have an average particle size (50%-average particle size as measured according to a method described hereinafter) in a range of 10 nm–5 $\mu$m so as to realize an image forming apparatus Iree from hindrance to imagewise exposure and providing good images.

The present invention will be described more specifically based on preferred embodiments and working examples.

First Embodiment

FIG. 1 is a schematic illustration of an embodiment of the electrophotographic apparatus (image forming apparatus) equipped with a contact charging device according to the present invention. The image forming apparatus is a laser beam printer including a releasable process cartridge and a transfer-type electrophotographic system.

(1) Overall Organization of the Printer

The printer includes an electrophotographic photosensitive member 1 of a rotation drum-type as an image-bearing member (also an object to be charged) which, in this embodiment, is a 30 mm-dia. OPC photosensitive member and is driven in rotation at a process speed (peripheral speed) of 100 mm/sec. A roll-form charging brush (fur brush charger) 2 as a contact charging member is abutted against the photosensitive member 2 to form a charging nip n in a width of 3 mm, and rotated at 180 rpm in an indicated clockwise direction reverse to that of the photosensitive member 1. Thus, the charging brush 2 as a contact charging member is caused to contact the photosensitive member 1 with a peripheral speed difference, thereby rubbing the photosensitive member 1. The charging brush 2 is supplied with a DC charging bias voltage of −700 volts from a charging bias voltage supply S1 to substantially uniformly injection-charge the outer surface of the rotating photosensitive member 1 to −680 volts.

The charged surface of the rotating photosensitive member 1 is exposed to laser beam scanning light L that has been emitted from a laser beam scanner 3 including a laser diode, a polygonal mirror, etc., with an intensity modification corresponding to a time serial electrical, digital image signal based on objective image data, thereby forming an electrostatic latent image corresponding to the objective image data on the peripheral surface of the photosensitive member 1. The electrostatic latent image is then developed with a magnetic monocomponent insulating toner (negative toner) t, in this embodiment, by a reversal development device 4 to form a toner image.

The development device 4 includes a nonmagnetic developing sleeve 4*a* of 16 mm in diameter, as a developer-carrying member, enclosing a magnet 4*b* therein. The developing sleeve 4*a* is disposed opposite to the photosensitive member 1 with a gap of 300 $\mu$m from the photosensitive member 1 and rotated in a direction identical to the rotation direction of the photosensitive member 1 at a developing region a opposite to the photosensitive member 1.

Onto the rotating developing sleeve 4*a*, the developer (toner) t is applied in a thin layer by a regulating blade 4*c*. The developer on the rotating developing sleeve 4 is formed in a layer with a thickness regulated by the regulating blade 4C and simultaneously supplied with a charge. The layer of developer applied on the rotating developing sleeve 4*a* is conveyed to the developing region a opposite to the photosensitive member 1 by the rotation of the sleeve 4*a*. The sleeve 4*a* is also supplied with a developing bias voltage from a developing bias voltage supply S2. The developing bias voltage is a superposition of a DC voltage of −500 volts and a rectangular AC voltage with a frequency of 1800 Hz and a peak-to-peak voltage of 1600 volts, whereby monocomponent jumping development is effected between the developing sleeve 4*a* and the photosensitive member 1.

The developer (toner) t is one formed from a known binder resin, magnetic particles and a charge control agent through the steps of melt-kneading, pulverization and classification. The toner t in this embodiment has a weight-average particle size (D4) of 7 $\mu$m.

On the other hand, a transfer material P as a recording medium is supplied from a supply unit (not shown) at a prescribed time to a pressure nip (transfer region) b between the rotating photosensitive member 1 and a transfer roller 5 of a medium resistivity as a contact transfer means abutted against the photosensitive member 1 with a prescribed pressing force. The transfer roller 5 is supplied with a prescribed transfer bias voltage from a transfer bias voltage supply S3. In this embodiment, the transfer roller has a resistance of $5\times10^8$ ohm and is supplied with a DC voltage of +200 volts to effect the transfer.

The transfer material P is conveyed while being nipped through the transfer region b to receive a toner image formed on the surface of the rotating photosensitive member 1 by transfer under the action of an electrostatic force and a pressing force. The transfer material having received the toner image is separated from the photosensitive member 1 and introduced into a fixing device 6 of the heat-fixation type, etc., where the toner image is fixed onto the transfer material P to provide an image product (print or copy) that is then discharged out of the apparatus The surface of the photosensitive member 1 after the toner image transfer is subjected to cleaning and removal of attached soling materials, such as residual toner, by a cleaning device 7, and then recycled to a new image forming cycle.

The surface of the photosensitive member 1 after the cleaning is subjected to the application of a prescribed amount of charging promoter particles m by a charging promoter particle applicator 8 disposed between the cleaning device 7 and the charging brush 2. The charging promoter particles m applied onto the surface of the photosensitive member 1 by the applicator 8 are brought along with the rotation of the photosensitive member 1 to the charging nip n where the photosensitive member 1 and the charging brush 2 as a contact charging member contact each other, whereby the photosensitive member 1 is subjected to contact charging by the charging brush 2 in the presence of the charging promoter particles m at the charging nip n.

The printer in this embodiment includes a cartridge PC enclosing 5 process devices of the photosensitive member 1, the charging brush 2, the developing device 4, the cleaning device 7, and the charging promoter particle applicator 8. The process cartridge PC as an apparatus unit integrally supporting the process devices is detachably mountable to a main assembly of the printer along a guide and protecting member 9 The combination of process devices included in a process cartridge is not limited to the above but is arbitrary. Incidentally, the electrophotographic apparatus according to the present invention is not limited to one of a cartridge type as described above.

(2) Photosensitive Member

Figure 2:
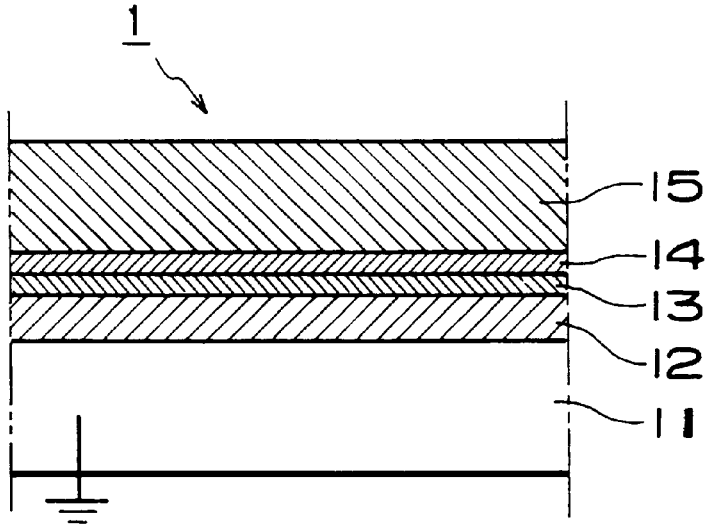
FIG. 2 illustrates a sectional laminate structure of a photosensitive member.

The negatively chargeable OPC photosensitive member 1 used in this embodiment has a laminate layer structure as shown in FIG. 2 including a 30 mm-dia aluminum-made drum substrate (Al substrate) 11, on which the following first to fourth functional layers 12–15 are successively disposed in this order.

First layer 12 is an undercoating layer, a ca. 20 m-thick electroconductive layer, for smoothening defects, etc., on the aluminum drum and for preventing the occurrence of moire due to the reflection of exposure laser beam.

Second layer 13 is a positive charge injection-preventing layer for preventing a positive charge injected from the Al substrate 11 from dissipating the negative charge imparted by charging the photosensitive member surface and is formed as a ca. 1 $\mu$m-thick medium resistivity layer of ca. $10^{10}$ ohm.cm formed of amilan resin and methoxymethylated nylon.

Third layer 14 is a charge generation layer, a ca. 0.2 $\mu$m-thick resinous layer containing a disazo pigment dispersed therein, for generating positive and negative charge pairs on receiving exposure laser light.

Fourth layer 14 is a charge transport layer formed by dispersing a hydrazone compound (Charge-transporting compound No. 332) having an oxidation potential of 0.69 volt in a polycarbonate resin (Binder No. B-12, dielectric constant $\in$=3.0) in a weight ratio of 1:1. The negative charge imparted to the surface of the photosensitive member cannot be moved through the layer but only the positive charge generated in the charge generation layer is transported to the photosensitive member surface.

(3) Charging Brush

The charging brush 2 used in this embodiment as a contact charging member is of a roll form, more specifically a roll brush of 14 mm in outer diameter formed by spirally winding a tape 2*b* of piled electroconductive rayon fiber ("REC-B", mfd. by Unitika K.K.) comprising yarns of 300 denir/50 filaments about a 6 mm-dia. core metal at a density of 155 yarns/mm$^2$ so as to provide a brush resistance of $1\times10^5$ ohm for an applied voltage of 1–1000 volts (more specifically, as a calculated value from an electric current value flowing under application of 100 volts while the brush is abutted against a 30 mm-dia. metal drum at a nip width of 3 mm).

The charging brush 2 may preferably exhibit a resistance of at least $10^4$ ohm so as to prevent an excessively large leakage-current flow even at defects, such as pinholes, on the photosensitive member 1, leading to image defects due to charging failure at the charging nip On the other hand, the resistance may preferably be at most $10^7$ ohm so as to effect sufficient charge injection to the photosensitive member surface.

As for the material of the charging brush, in addition to "REC-B" of Unitika K.K., it is also possible to use "REC-C", "REC-M1", "REC-M10" of Unitika K.K.; "SA-7" of Toray K.K.: "THUNDERRON" of Nippon Sanmo K.K.; "BELTRON" of Kanebo K.K.; "KURACARBO" (carbon-dispersed rayon) of Kurary K.K.; and "ROABAL" of Mitsubishi Rayon K.K. In view of the environmental stability, it is preferred to use "REC-B", "REC-C", "REC-M1" or "REC-M10" of Unitika K.K.

In this embodiment, the charging brush 2 is rotated at 180 rpm In a counter direction with respect to the rotation direction of the photosensitive member surface, but the rotation speed is not restricted thereto, and an optimum speed thereof may vary if related conditions are changed, such as the charging nip width n, the brush yarn arranged density, the surface resistivity of the photosensitive member and the process speed (i.e., peripheral speed of the photosensitive member).

It is possible to rotate the charging brush in an identical direction as the photosensitive member surface. However, as the charging performance of the charging brush depends to some extent on a peripheral speed ratio or difference between the photosensitive member 1 and the charging brush 2, the counter rotation as described above capable of realizing a certain peripheral speed difference at a relatively low rotation speed of the charging brush than in the rotation in the same direction as the photosensitive member surface.

Herein, the term peripheral speed ratio refers to a ratio of the peripheral speed of the charging brush (Sbrush) to that of the photosensitive member (i.e., (Sbrush-Sdrum)/Sdrum) at the charging nip. (The peripheral speed (Sbrush) of the charging brush is allotted with a positive (+) value when it is rotated in the same direction as the photosensitive member at the nip.) The relative peripheral speed (=Sbrush-Sdrum) of the charging brush with respect to the photosensitive member may also be termed a peripheral speed difference between the charging brush and the photosensitive member at the charging nip.

(4) Charge-promoting Particles m and Injection Charging

Figure 3:
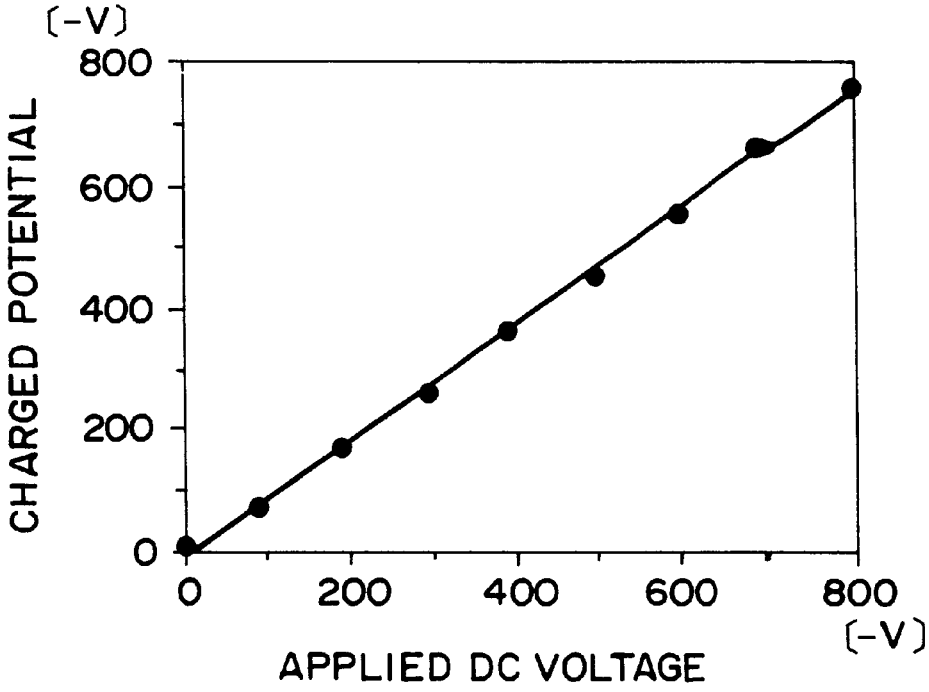
FIG. 3 is a graph showing a charging characteristic according to injection charging.

Injection charging (or charge-injection charging) is a scheme of charging a photosensitive member surface by directly injecting charges to the photosensitive member surface without causing a discharge phenomenon by using a contact charging member of a medium resistance level. Accordingly, even when a voltage applied to the contact charging member is below a discharge threshold voltage, the photosensitive member as an object to be charged can be charged to a potential comparable to the applied voltage. The relationship between the applied DC voltage and the charged potential of the photosensitive member in this case is shown in FIG. 3.

Figure 9:
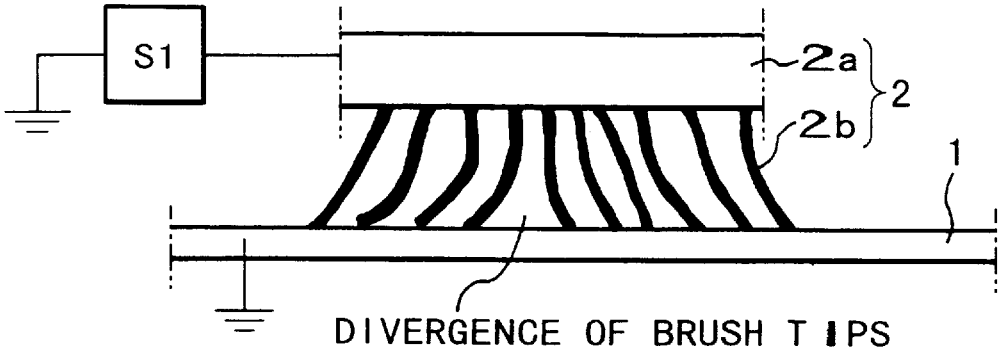
FIG. 9 schematically illustrates a state of contact between a charging brush and a photosensitive member accompanied with divergence of brush tips.
Figure 10:
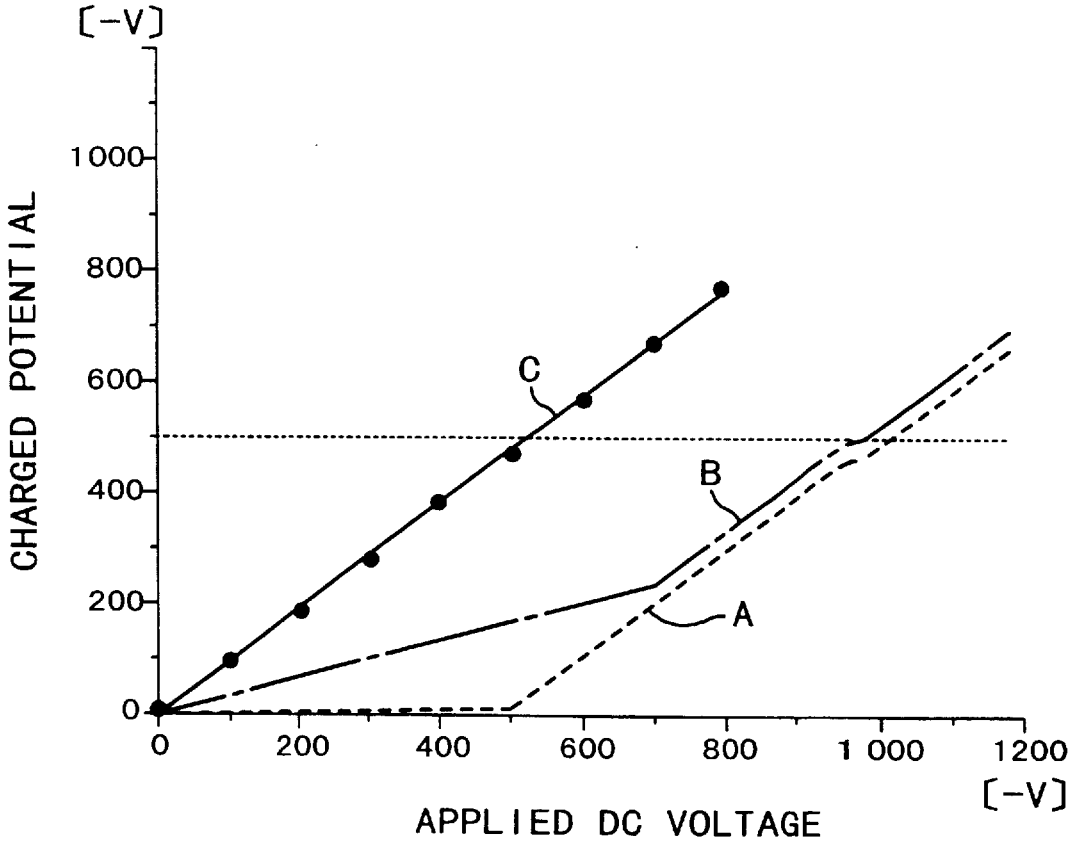
FIG. 10 is a graph showing typical charging characteristics according to roller charging, fur brush charging and magnetic brush charging.

However, in order to realize such an ideal injection-charging relationship, a sufficient contact between the photosensitive member surface and the charging member has to be realized. However, as already explained before, the use of a charging brush alone is liable to fail in uniform charging of the photosensitive member surface due to the divergence of brush tips, as shown in FIG. 9, causing local failure of contact.

Accordingly, in this embodiment, a device 8 for applying charging promoter particles m on the surface of the photosensitive member 1 as an object to be charged at a rate of preferably at least $10^2$ particles/mm$^2$ as shown in FIG. 1, thereby solving the above-mentioned problem of contact failure. The charging promoter particle-application device 8 may adopt an ordinary powder application scheme, of e.g., once applying the particles onto an application roller 8*a* and then transferring the applied particles onto the photosensitive member by contact or jumping under application of an electric field.

Figure 4:
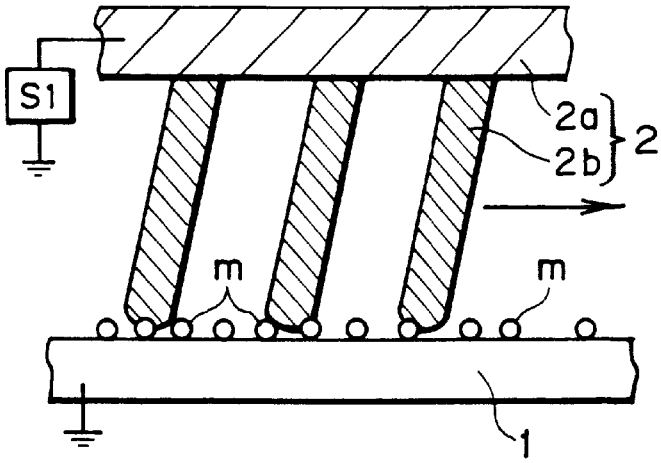
FIG. 4 schematically illustrates a contact state between a charging fur brush and a photosensitive member in the presence of charging promoter particles.

The presence of the charging promoter particles m on the photosensitive member 1 improves the opportunity of contact of the charging member (i.e., fur brush tips 2*b* in this case) as schematically illustrated in FIG. 4. The density of the presence of the charging promoter particles m on the photosensitive member in the present invention has been determined so as to attain the effect of uniform charging based on a consideration on visual characteristics of human eyes and experiments based thereon.

The recordable resolution of laser beam printers has been increased to 300 dpi, to 600 dpi, or even up to 1200 dpi in recent years. It is of course necessary to realize a uniform contact charging exceeding at least such a recording resolution.

Figure 5:
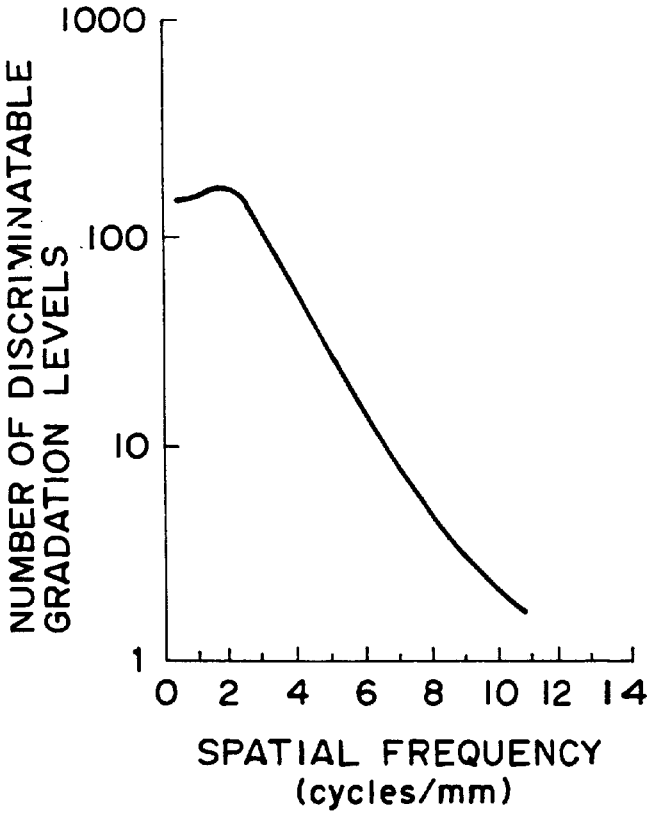
FIG. 5 is a graph showing a human eye's visual characteristic.

A human eye's visual characteristic curve is shown in FIG. 5. As shown in FIG. 5, at spatial frequencies exceeding 10 cycles/mm, the number of discriminatable gradation levels approaches infinitely to 1, that is, the discrimination of density irregularity becomes impossible. As a positive utilization of this characteristics in the case of attachment of the charge-transporting materials m on the photosensitive member 1, it is effective to dispose the charging promoter particles m at a density of at least 10 cycles/mm and perform contact injection charging through the particles m. Even if charging failure is caused at sites with no particles m, an image density irregularity caused thereby occurs at a spatial frequency region exceeding the human visual sensitivity, so that no practical problem is encountered.

Table 1 below shows the result of evaluation regarding recognizability of density irregularities on images as a result of charging irregularity at various application densities of charging promoter particles m, wherein the image evaluation is based on the following standard.

A: No image irregularity recognized at all.

B: Almost no image irregularity observed.

C: Image irregularity recognized.

TABLE 1

| Application density (particles/mm$^2$) | Chargeability improvement effect | Image evaluation |
|---|---|---|
| 0 | no | c |
| $10^1$ | yes | C |
| $10^2$ | yes | B |
| $10^3$ | yes | A |
| $10^4$ | yes | A |
| $10^5$ | yes | A |

The application density of charging promoter particles on the photosensitive member was measured by observation through an optical or electron microscope.

More specifically, in a state of applying no charging bias voltage, the rotation of the photosensitive member 1 and the charging member was stopped, and the surface of the photosensitive member 1 was observed through a video microscope ("OVM1000N", mfd. by Olympus K.K.) with an objective lens at a magnification of 1000 and photographed by a digital still recorder ("SR-3100", mfd. by Deltis Co.). At least 10 photographs were taken at respectively different portions. The resultant digital images were subjected to binary processing for regional separation of particles with prescribed thresholds corresponding to density levels, whereby the numbers (densities) of regions with the presence of particles were measured according to an appropriate image software to calculate the application density.

Completely unlike the discharge-based charging scheme, in the injection-charging scheme, the charging is ensured by intimate contact of the charging member on the photosensitive member, but even if the charging promoter particles m are present on the photosensitive member, non-contacting sites are inevitably present. However, in the present invention, by dispersing the charging promoter particles at an appropriate density in positive utilization of the human visual characteristic, it has become possible to practically solve the problem.

The upper limit of the application density of the particles m is determined in association with the density realizing the densest packing in a single layer of the particles m. A larger application density does not enhance the charging performance improvement effect but rather obstructs the transmission of or causes the scattering of exposure light. Thus, the upper limit of the application density of the particles depends on the particle size thereof and may be determined as a density providing the densest packing of a monoparticle layer of particles having an average particle size of the particles m, if a definite expression is boldly sought.

For example, in this embodiment, if the density of the charging promoter particles exceeds $5\times10^5$ particles/mm$^2$, the shortage of exposure light quantity to the photosensitive member 1 is liable to occur regardless of the light transmissivity of the particles per se. This difficulty can be alleviated below the above limit. Accordingly, the application density of the charging promoter particles may preferably be in the range of $10^2$–$10^5$ particles/mm$^2$, in view of both the image evaluation results and exposure performance.

The charging brush, as a charging member used in this embodiment, may preferably have a higher brush density within a possible extent, but the density adopted in this embodiment is sufficient, since the number of charging point is principally determined by the application density of the charging promoter particles and not by the density of the charging member. Thus, the latitude of selection of the charging member has been substantially broadened.

In a specific example of this embodiment, electroconductive zinc oxide particles having a resistivity of $10^3$ ohm.cm and an average particle size of 3 $\mu$m inclusive of secondary agglomerate were used as the charging promoter particles. As for materials of the charging promoter particles, however, it is also possible to use various electroconductive particles, inclusive of electroconductive inorganic particles including those of other metal oxides, such as magnesium oxide, titanium oxide, tin oxide and copper oxide, or metal oxides doped with other inorganic substances, and mixtures thereof with organic particles.

In order to achieve charge transfer via the particles, the charging promoter particles m may preferably have a resistivity of at most $10^{12}$ ohm.cm, and more preferably at most $10^{10}$ ohm.cm. The resistivity values described herein are based on values measured according to the tablet method wherein 0.5 g of a powdery sample is placed on a lower electrode in a cylinder having a sectional area of 2.26 cm$^2$ (=S) and supplied with a pressure of 15 kg between the lower electrode an upper electrode placed thereon to measure a resistance (R ohm) under application of 100 volts. From the measured value, the resistivity (Rs) is calculated as a normalized value, i.e., according to the formula of Rs=RxS/H, wherein H is a distance between the upper and lower electrodes.

It is generally preferred that the charging promoter particles have an average particle size of at most 50 $\mu$m In order to exhibit a good uniform-charging performance, more preferably at most 5 $\mu$m, for utilizing the human visual characteristic so that the local (minute) charging failure is not allowed to leave a visually recognizable image irregularity.

The average particle size of the charging promoter particles described herein are based on values measured by taking at least 100 particles (inclusive of agglomerates as such) on optical-microscopic or electromicroscopic photographs thereof and measuring the particle size (longer axis diameters horizontal direction) thereof to derive a volume-basis particle size distribution, from which the average particle size is determined as a particle size giving an accumulative volume of 50% on the distribution.

As is understood from the above description, the charging promoter particles m may be present not only in primary particles but also in agglomerated secondary particles without a substantial problem. If the charging promoter particles can exhibited a required function thereof in their agglomerated form, any agglomerate form can be accepted, and the more important is the application density of the particles.

Second Embodiment

Figure 6:
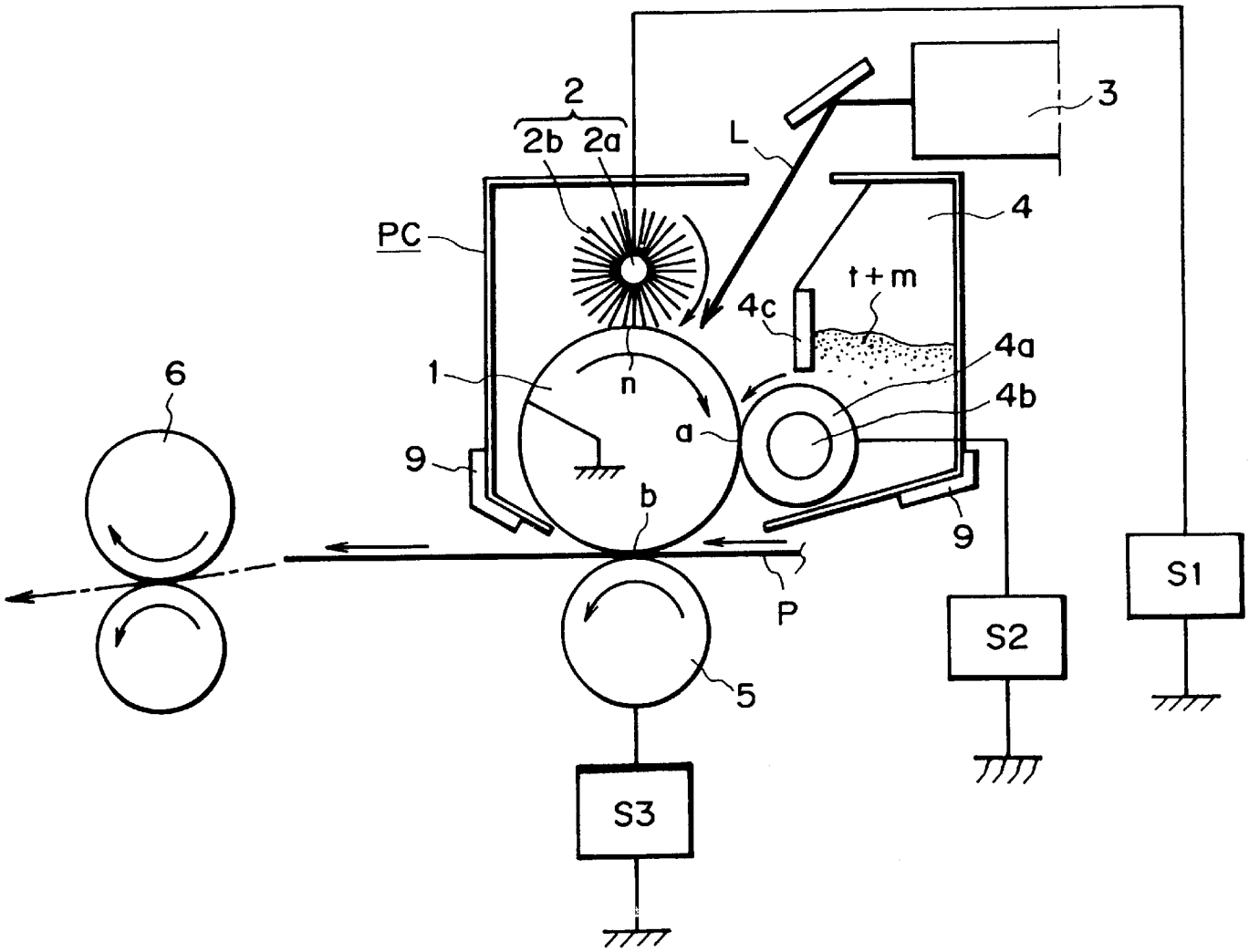
FIG. 6 is a schematic illustration of a cleanerless electrophotographic apparatus according to the invention including a fur brush charging means.

FIG. 6 illustrates an organization of an electrophotographic (image forming) apparatus according to this embodiment. The image forming apparatus (printer) of this embodiment is different from the above-described printer of FIG. 1 in that the cleaning device 7 has been omitted to provide a cleanerless system, the charging promoter particles application device 8 has been omitted, and instead thereof, charging promoter particles m are externally added to the developer (toner) t in the developing device 4 so that the developing device 4 is designed to also function as a means for supplying and applying charging promoter particles onto the photosensitive member 1.

The toner t is one formed from known binder resin, magnetic particles and charge control agent through the steps of melt-kneading, pulverization and classification, similarly as in the preceding embodiment, and is blended with the above-mentioned charging promoter particles m as an external additive. The toner t has a weight-average particle size (D4) of 7 $\mu$m, whereas the charging promoter particles m comprise electroconductive zinc oxide particles having an average particle size of 3 $\mu$m.

The charging promoter particles m may generally have an average particle size that is 10 nm or larger and smaller than the toner particle size so as to also function as a flowability improver for the toner t. The amount of the charging promoter particles may generally be set to 0.01–20 wt. parts per 100 wt. parts of the toner t.

In case of the cleanerless system, the residual toner remaining on the photosensitive member 1 surface after transfer of a toner image onto the transporting material P is not removed by a cleaner but moves via a charging nip n to reach a developer region a, where the residual toner is recovered by the developing device 4 while simultaneously effecting development (toner recycle process).

As mentioned before, the simultaneous developing and cleaning process is a process wherein the toner remaining on the photosensitive member 1 after transfer is subsequently recovered under the acting of a fog-removal bias voltage (i.e., a potential difference between a DC voltage applied to the developing device and the surface potential of the step after charging and exposure of the photosensitive member to form a latent image, in the image forming process. In the case of reversal development as in a printer of this embodiment, the simultaneous developing and cleaning process is effected under the action of an electric field for recovering the toner from the dark part on the photosensitive member to the developing sleeve and an electric field for attaching the toner from the developing sleeve to the light part on the photosensitive member.

During the development of the electrostatic latent image on the photosensitive member 1, an appropriate amount of the charging promoter particles m present in mixture with the developer t in the developing device 4 are transferred together with the toner onto the photosensitive member 1. At a transfer position b, the toner image on the photosensitive member 1 is positively transferred to a transfer material P as a recording medium under the action of a transfer bias voltage, but the charging promoter particles m are not positively transferred onto the transfer material P because of their electroconductivity but substantially remain in attachment on the photosensitive member.

Then, as no cleaning device is included, the transfer residual toner and the charging promoter particles m remaining on the photosensitive member 1 after the transfer are brought as they are along with the rotation of the photosensitive member 1 to the charging nip n where the photosensitive member 1 and the charging brush 2 as a contact charging material contact each other. Accordingly, contact charging is effect in the presence of the charging promoter particles m at the mutual contact region n between the photosensitive member 1 and the charging brush 2.

The transfer residual toner and the charging promoter particles m present after the charging nip n or attached to the charging brush 2 are gradually discharged out of the charging brush 2 onto the photosensitive member 1 to reach the developing region a along with the rotation of the photosensitive member 1, and are recovered by the developing device 4 (simultaneous developing and cleaning).

In case of the electrophotographic apparatus of the cleanerless system, along with the operation of the apparatus, the charging promoter particles m commingled with the developer t in the developing device 4 are transferred onto the photosensitive member 1 surface at the developing position a, and are brought by the rotation of the photosensitive member via the transfer position b to the charging position n so that fresh particles m are successively supplied to the charging position. As a result, even if the charging promoter particles are reduced by falling etc., from or deteriorated at the charging nip n, the lowering in charging performance is prevented to retain good and stable charging performance. As the charging promoter particles applied on the photosensitive member are not removed by a cleaning device, the charging promoter particles m are allowed to be always present in a sufficient amount on the photosensitive member, so that the charging performance can be remarkably improved by externally adding only a small amount of charging promoter particles m to the toner in the developing device 4.

Further, as the transfer residual toner is re-utilized, an effective utilization of toner is also achieved. As no charging promoter particles are supplied to the contact nip n between the charging brush 2 and the photosensitive member 1 at the Initial stage of image formation, it is possible to apply an appropriate amount of charging promoter particles In advance at the contact nip n.

Third Embodiment

Figure 7:
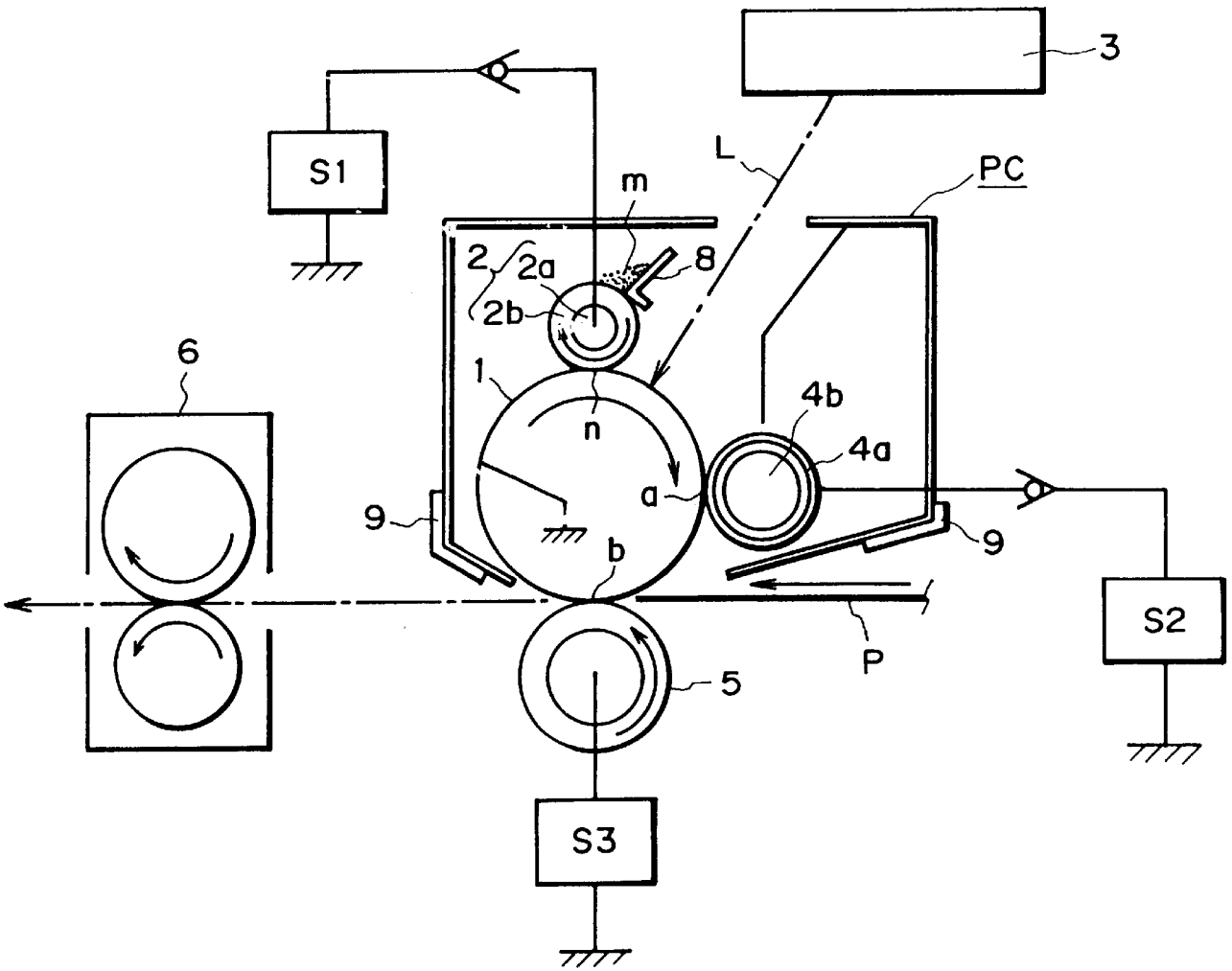
FIG. 7 is a schematic illustration of a cleanerless electrophotographic apparatus according to the invention including a roller charging means.

FIG. 7 illustrates an organization of an electrophotographic apparatus (printer) according to this embodiment. The printer of this embodiment is different from the above-described printer of Second embodiment (FIG. 6) in that an electroconductive elastic roller 2 is used as a contact charging material instead of the charging brush 2, and a means 8 for supplying charging promoter particles to the charging member 2 is also provided.

In this embodiment, the supply of charging promoter particles is effected by using a regulating blade 8, which is abuts against the charging roller 2 so as to store and hold the charging promoter particles m between the regulating blade 8 and the charging roller 2, thereby applying and supplying the charging promoter particles m onto the charging roller 2 surface. Along with the rotation of the charging roller 2, the charging promoter particles m are brought at a certain rate to the charging nip h, thus uniformly supplying the charging promoter particles m to the charging nip n.

The charging roller 2, as a contact-charging member, is rotated with a speed difference relative to a photosensitive member 1 as an object to be charged. As a result, compared with a case where the charging roller is rotated following the rotation of the photosensitive member 1, a portion of the charging roller 2 composed of an elastic material near the charging nip n is deformed in a larger degree, so that the charging promoter particles m attached onto the charging roller 2 surface are liable to be transferred onto the photosensitive member 1, thus reducing the amount of the charging promoter particles on the charging-roller surface with continuation of the apparatus use. Accordingly, the charging promoter particles supply means 8 is designed to apply the charging promoter particles at a constant rate onto the charging roller 2 surface and supply the charging-promoter particles to the charging nip n between the charging roller 2 and the photosensitive member 1.

The charging roller 2 is prepared by coating a core metal 2*a* with a medium resistivity layer 2*b* of a resilient materials such as rubber or foam, for example, with a mixture of a resin (e.g., urethane resin), electroconductive particles (e.g., carbon black), a vulcanizing agent and a foaming agent, optionally followed by surface polishing, to provide an electroconductive elastic roller of 12 mm in diameter and 250 mm in length, in a specific example.

The roller 2 in the specific example exhibited a resistance of $10^5$ ohm as measured in a state where the roller 2 was pressed against a 30 mm–dia. aluminum drum so as to apply a total load of 1 kg to the core metal 2*a* and a voltage of 100 volts was applied between the core metal 2*a* and the aluminum drum.

It is important for the electroconductive elastic roller 2 to function as an electrode. Thus, the roller 2 Is required to have a resilience so as to be in sufficient contact with the photosensitive member 1 and also a sufficiently low resistance so as to charge the rotating photosensitive member 1. It is also necessary to prevent a voltage leakage even when a defect, such as a pinhole, is present on the photosensitive member surface. In order to attain sufficient charging performance and leakage resistance, it is preferred that the charging roller 2 exhibits a resistance of $10^4$–$10^7$ ohm.

As for the hardness of the charging roller 2, too low a hardness obstructs the shape stability, thus resulting in a poor contact with the photosensitive member, and too high a hardness fails in ensuring a charging nip with the photosensitive member and results in a poor microscopic contact with the photosensitive member surface, so that a hardness (Asker C hardness) in a range of 25 deg. to 50 deg. is preferred.

The material of the charging roller 2 is not restricted to an elastic foam body, but other elastic materials may also be used, inclusive of a rubbery material, such as EFDM, urethane rubber, NBR, silicon rubber or isoprene rubber, with an electroconductive material, such as carbon black or metal oxides, dispersed therein, and foamed products of these elastic materials. Further, it is also possible to adjust the resistivity by using an tonically conductive material and without dispersing an electroconductive material.

The charging roller 2 is abutted against the photosensitive member 1 as an object to be charged under an elastic pressure. In a specific example, the photosensitive member 1 and the charging roller 2 were contacted to each other with a charging nip n in a width of 3 mm. The charging roller 2 was rotated at 160 rpm in an indicated clockwise arrow direction so as to move at the charging nip n at an equal speed in an opposite direction with respect to the photosensitive member. Thus, the charging roller 2, as a contact-charging member, was moved with a surface speed difference with the photosensitive member 1 surface. The core metal 2*a* of the charging roller 2 was supplied with a DC voltage of −700 volts as a charging-bias voltage from a charging bias voltage supply S1.

Too small an amount of the charging promoter particles m at the charging nip between the photosensitive member I and the charging roller 2 fails to exhibit a sufficient lubricating effect, so that the movement of the charging roller 2 with a speed difference from the photosensitive member 1 becomes difficult because of too large a friction between the charging roller 2 and the photosensitive member 1. In other words, the drive torque becomes excessively large, and a forcible rotation results in peeling of a surface layer of the charging roller 2 or the photosensitive member 1. Further, the contact-opportunity improving effect owing to the particles can be insufficient to fail in accomplishing a sufficient charging performance. On the other hand, in case of the presence of too much charging promoter particles, the amount of the particles falling from the charging roller 2 is liable to increase, thus resulting in an adverse effect to resultant images.

Based on experimental results, the charging promoter particles are preferably present in a density of at least $10^3$ particles/mm$^2$ on the charging roller 2. Below $10^3$ particles/mm$^2$, it becomes difficult to attain sufficient lubricating effect and contact-opportunity-increasing effect. A range of $10^3$–$5\times10^5$ particles/mm$^2$ is further preferred. As already mentioned in first embodiment, in case of the presence of charging promoter particles in excess of $5\times10^5$ particles/mm$^2$ on the photosensitive member, the exposure light quantity onto the photosensitive member 1 is liable to be insufficient regardless of the light-transmissibity of the particles. If the amount of charging-promoter particles on the charging roller does not exceed $5\times10^5$ particles/mm$^2$, the amount of the particles falling off the charging roller 2 is suppressed low, thus preventing an adverse effect to the resultant images. Taking these factors into consideration, it is preferred that charging-promoter particles are present in a density of $10^3$–$5\times10^5$ particles/mm$^2$ on the charging member 2 so that the particles are present in a density of $10^2$–$5\times10^5$ particles/mm$^2$ on the photosensitive member 1.

The above-mentioned values of the density of charging-promoter particles on the photosensitive member are based an values measured in the same manner as described in first embodiment. As for the density on the charging roller 2, the charging roller 2 was abutted against a slide glass sheet under the same conditions as being abutted against the photosensitive member, and the particles on the surface of the charging roller 2 were observed at at least 10 positions through the slide glass sheet by a video microscope at a magnification of 1000. The thus-obtained digital images were subjected to image processing in the same manner as in first embodiment to obtain a density of the particles on the charging-roller.

Thus, in the presence of the charging promoter particles at the charging nip n between the photosensitive member 1 as an object to be charged and the charging roller 2 as a contact charging material, the photosensitive member 1 is contact-charged As a result, the charging roller 2 densely contacts the photosensitive member 1 via the charging-promoter particles m at the charging nip n. In other words, the charging promoter particles present at the charging nip n between the charging roller 2 and the photosensitive member 1 rub the photosensitive member 1 surface without spacings to directly inject charges to the photosensitive member. Thus, the charging of the photosensitive member 1 by the charging roller 1 is effected dominantly by the injection-charging mechanism.

As a result, it becomes possible to attain a high charging efficiency not attainable by conventional roller charging so that the photosensitive member 1 can be charged to a potential substantially identical to a voltage applied to the charging roller 2. In a specific example according to this embodiment, the photosensitive member 1 was charged to a potential of −680 volts substantially identical to a DC voltage of −700 volts applied to the charging roller 2.

Thus, even in the case of using a charging roller having a relatively simple structure as a contact charging material, it becomes possible to realize a stable and safe charging scheme not relying on the discharge phenomenon (i.e., injection charging scheme) wherein only a charging bias voltage comparable to a potential given to the photosensitive member 1 as an object to be charged is applied to the charging roller 2. In other words, even if a charging roller having a simple structure is used as a contact charging member in a contact charging device, it becomes possible to realize an ozoneless infection-charging scheme that exhibits better charging performance and is stable over a long term.

Fourth Embodiment

This embodiment is presented to clarify the effect of the oxidation potential of charge-transporting material contained in the surface layer of the photosensitive member 1 used in first to third embodiment.

Table 2 summarizes experimental results regarding image defects associated with injection charging uniformity obtained by using 8 charge-transporting materials having different oxidation potentials.

In this embodiment, 8 electrophotographic apparatuses were prepared by using 8 photosensitive members including surface most charge-transporting layers containing 8 charge-transporting materials respectively shown in Table 2. The other organization and structures of each electrophotographic apparatus, were identical to those of a specifically disclosed example in first embodiment, inclusive of the photosensitive layer, the other printer members, the charging member, etc. These electrophotographic apparatus were subjected to evaluation of uniformity of charge injection to the photosensitive layers based on an halftone image in a normal temperature/normal humidity (25° C./50%RH) environment. In case of unsatisfactory injection charging, the resultant several development images were accompanied with image defects, such as black streaks and positive ghost, which was a portion of increased image density on a halftone image caused by an increased charged potential on a second revolution of the photosensitive member due to the influence of the history of exposure in a preceding first revolution of the photosensitive member. As shown in Table 2, there was found a correlation between image defects and oxidation potential of charge-transporting materials used, and it has been found possible to provide an electrophotographic apparatus exhibiting an excellent injection performance by using a charge-transporting material showing an oxidation potential in a range of 0.4–1.0 volt, and preferably 0.5–0.95.

Incidentally, the structures of charge-transporting materials Nos. 1–8 shown in Table 2 and the method of measurement of the oxidation potential thereof are clarified after Table 2.

TABLE 2

| Charge-transporting material No. | Oxidation potential (V) | Image defect: black streaks | Image defect: positive ghost |
|---|---|---|---|
| 1 | 0.76 | no problem | no problem |
| 2 | 0.50 | " | " |
| 3 | 0.63 | " | " |
| 4 | 0.95 | " | " |
| 5 | 0.35 | " | problematic |
| 6 | 0.40 | " | slight |
| 7 | 1.00 | slight | no problem |
| 8 | 1.10 | problematic | " |

<Charge transporting material>

No. 1

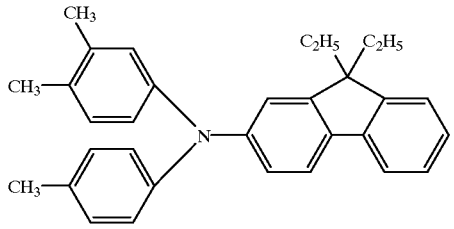

No. 2

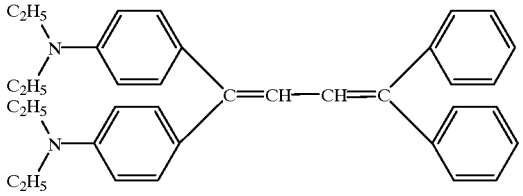

No. 3

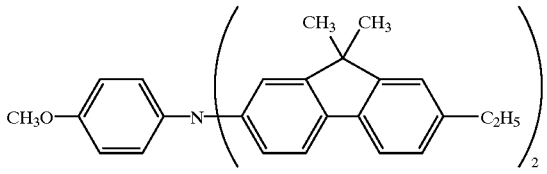

No. 4

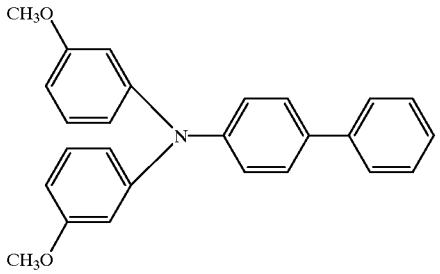

No. 5

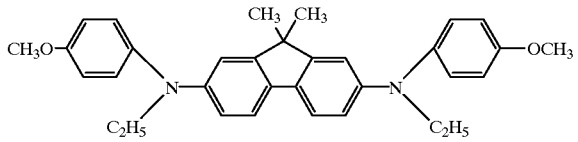

TABLE 2-continued

No. 6

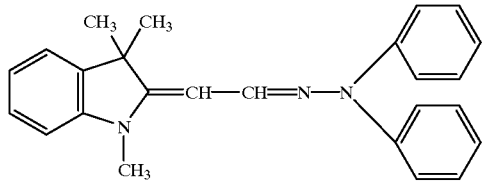

No. 7

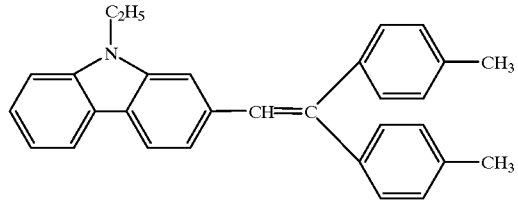

No. 8

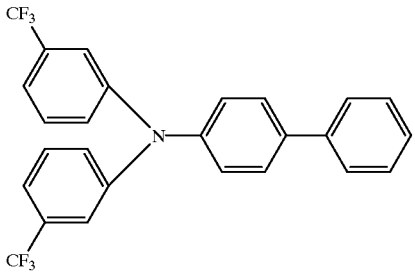

<oxidation potential measurement>

Measurement was performed by using a saturated calomel electrode as a reference electrode and a 0.1N-$(n\text{-}Bu)_4N^+ ClO_4^-$ acetonitrile solution as an electrolytic solution, and sweeping the potentials applied to an operating electrode (of platinum) by means of a potential sweeper to obtain a current-potential curve, on which a peaktop potential was taken as an oxidation potential. More specifically, a sample charge-transporting material was dissolved in 0.1N-$(n\text{-}Bu)_4N^+ClO_4^-$ acetonitrile solution to provide a concentration of 5–10 mmol %. Then, the sample solution was supplied with linearly increasing voltages of from 0 volt to +1.5 volts between the operating electrode and the reference electrode dipped in the sample solution to measure current changes, from which a current-potential curve was obtained. On the current-potential curve, a peak (a first peak in case of plural peaks) was determined and a peak-top potential of the peak was taken as an oxidation potential.

Fifth Embodiment

In a specific example of this embodiment, an apparatus identical to the one used in third embodiment (FIG. 7) was used but operated in a different manner. That is, the electroconductive elastic roller charger 2 was rotated following the rotation of the photosensitive member 1, instead of rotation with a peripheral speed difference by rotation in a reverse direction with respect to the photosensitive member 1 as in third embodiment, to evaluate the injection-charging performance. The other features, inclusive of the photosensitive layer, the printer structure, the charging member, the charging promoter particles, etc., were the same as in third embodiment.

By using the electrophotographic apparatus, the injection-charging uniformity onto the photosensitive layer was evaluated based on an halftone image in a normal temperature/normal humidity environment in the same manner as described in fourth embodiment.

As a result of the evaluation of the injection-charging performance, the resultant images exhibited no problem regarding the positive ghost defect, but exhibited slight black streaks while they were at a practically acceptable level. These were somewhat inferior results compared with no problems at all regarding both positive ghost and black streaks, wherein the roller charger 2 was rotated with a peripheral speed difference with respect to the photosensitive member 1.

Sixth Embodiment

Figure 8:
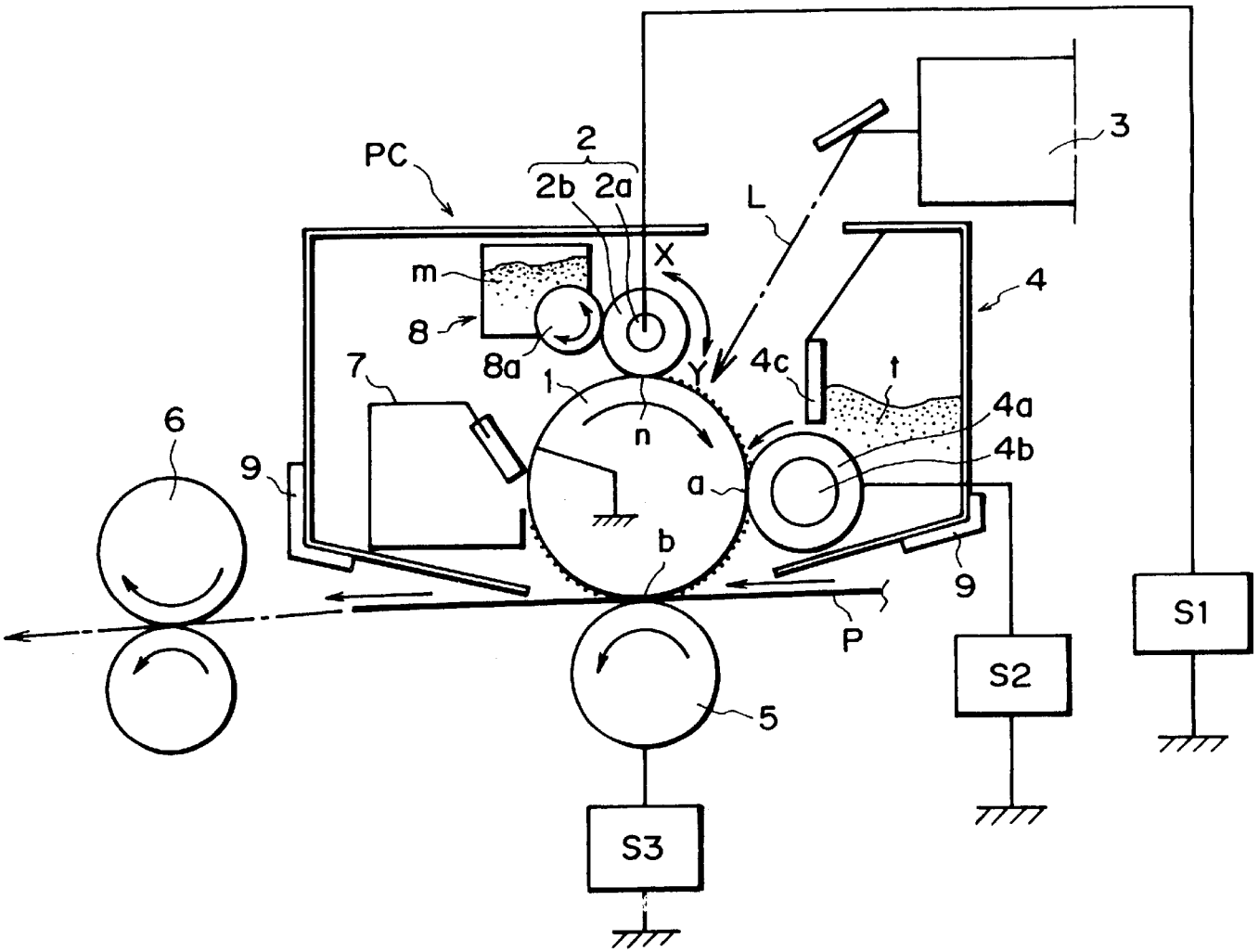
FIG. 8 is a schematic illustration of an electrophotographic apparatus according to the invention including a roller charging means and a cleaning device.

FIG. 8 illustrates an electrophotographic apparatus according to this embodiment wherein an electroconductive elastic roller 2 is included as a contact-charging member instead of the charging brush 2 in the apparatus (printer) of the above-described first embodiment (FIG. 1).

In this embodiment, the charging roller 2 is caused to contact a photosensitive member 1 with a charging nip n and, at the charging nip n, is driven in rotation in a direction (X-direction) identical to or a direction (Y-direction) reverse to that of the photosensitive member 1. The charging roller 2 is pressed against the photosensitive member 1 with a prescribed elastic pressure so as to form a charging nip width of 4 mm between the photosensitive member 1 and the charging roller 2.

In the printer of this embodiment, charging-promoter particles m are applied at a prescribed density onto the charging roller 2 surface from a charging-promoter-particle application device 8 via an application roller 8*a*. The charging-promoter particles applied on the charging roller 2 surface from the device 8 are brought along with the rotation of the charging roller 2 to the charging nip n, where the photosensitive member 1 is contact-charged by the charging roller 2 in the presence of the charging promoter particles m.

The other organization, inclusive of the charging roller and the charging promoter particles, is identical to that in third embodiment.

Similarly as in third embodiment, a stable injection charging exhibiting an excellent performance can be realized by using a charging roller of a simple structure.

Hereinbelow, the present invention will be described more specifically based on examples, wherein "parts" and "%" indicating relative amounts of ingredients are by weight unless otherwise noted specifically.

Example 7

50 parts of titanium oxide powder coated with tin oxide containing 10%-antimony oxide, 25 parts of resol-type phenolic resin, 30 parts of methyl cellosolve, 30 parts of methanol and 0.002 part of silicone oil (polydimethylsiloxane-polyoxyalkylene copolymer, Mw (weight-average molecular weight)=3000), were dispersed for 2 hours in a sand mill device containing 1 mm-dia. glass beads to obtain an electroconductive paint, which was then applied onto a 30 mm-dia. aluminum cylinder by dip coating, followed by drying at 140° C. for 30 min. to form a 20 μm-thick electroconductive layer.

Then, 5 parts of 6-66-610-12 quaternary amide copolymer was dissolved in a mixture solvent of methanol 70 parts/butanol 25 parts to form a solution, which was then applied by dip coating on the electroconductive layer, followed by drying, to form a 1 μm-thick undercoating layer.

Then, 10 parts of oxytitanium phthalocyanine (as a charge-generating agent) and 10 parts of polyvinyl butyral ("Eslec BX-1" (trade name)., mfd. by Sekisui Kagaku K.K.) dissolved in 400 parts of cyclohexanone were dispersed for 5 hours in a sand mill device containing 400 parts of 1 mm-dia. glass beads, followed by dilution with 400 parts of ethyl acetate, to form a charge-generation layer-forming coating liquid, which was then applied by dip coating on the undercoating layer and dried at 80° C. for 10 min. to form a 0.2 μm-thick charge generation layer.

Then, 10 parts of amine-type Charge-transporting compound No. 41 (Pox (oxidation potential)=0.82 volt) and 10 parts of polycarbonate (Binder No. B-12; Mw=46000, ∈ (dielectric constant)=3.0) were dissolved in a mixture solvent of dichloromethane 20 parts/monochlorobenzene 50 parts to form a coating liquid, which was then applied by dip coating an the charge generation layer and dried at 110° C. for 6 min., to form a 20 μm-thick charge transport layer, whereby an electrophotographic photosensitive member was prepared.

The thus-prepared photosensitive member was incorporated as a photosensitive member 1 in an electrophotographic apparatus of first embodiment (FIG. 1), which had been remodeled by removing the reversal development device 4 and substituting therefor a potential measurement probe. Then, the charged potential of the photosensitive member was measured while applying DC voltages of from 0 volt to 800 volts under the following conditions.

Peripheral speed of the photosensitive member=100 mm/sec

Peripheral speed difference=−200 mm/sec (charging brush was rotated in the indicated arrow direction (counterward with respect to the photosensitive member at a peripheral speed of 100 mm/sec))

Charging nip width=3 mm

Application density of charging-promoter particles m=$10^3$ particles/$mm^2$.

Figure 11:
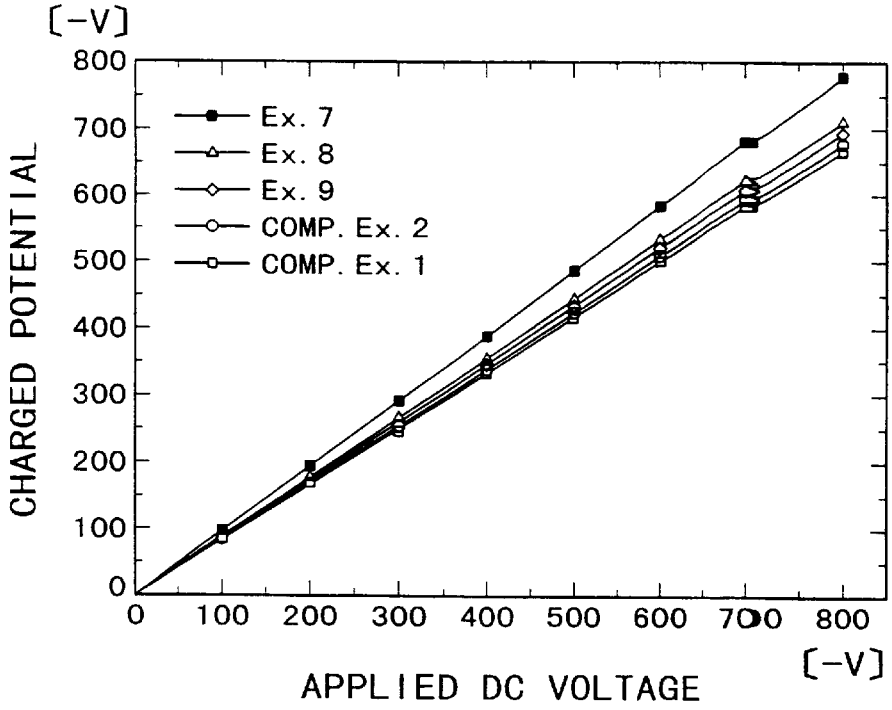
FIG. 11 is a graph showing charging characteristics according to Examples 7–9 and Comparative Examples 1–2.

The results are shown in FIG. 11 together with those of the following examples and comparative examples.

Examples 8–9 and Comparative Examples 1–2

Photosensitive members were prepared in the same manner as in Example 7 except for replacing Charge-transporting compound NO. 41 (Pox=0.82 volt) with the following compounds CTM1 (Pox=1.05 volt, Comparative Example 1), CTM2 (Pox=0.88 volt, Example 8), CTM3 (Pox=0.74 volt, Example 9) and CTM4 (Pox=0.29 volt, Comparative Example 2), respectively, and evaluated in the same manner as in Example 7. The results are also shown in FIG. 11.

As is understood from the results shown in FIG. 11, according to the electrophotographic apparatus of the present invention, the photosensitive member can be charged to a potential that increases linearly corresponding to voltages applied to the charging brush even at voltages below the discharge threshold voltage and at excellent injection charging performances.

Example 10

10 parts of amine-type Charge-transporting Compound No. 4 (Pox=0.76 volt) and 10 parts of polycarbonate (Binder No. B-12; Mw=46000, ∈=3.0) were dissolved in 100 parts of monochlorobenzene to form a coating liquid Separately, a 12 μm-thick polyethylene terephthalate film coated on its one surface with a vapor-deposited aluminum film was provided, and the above-prepared coating liquid was applied onto the other (non-coated) surface of the polyethylene terephthalate film and dried at 110° C. for 60 min. to form a 20 μm-thick charge transport layer. The coated polyethylene terephthalate film was then wound about a 30 mm-dia. aluminum cylinder so as to expose the charge transport layer outside, thereby providing a coated aluminum cylinder.

The coated aluminum cylinder was incorporated as a photosensitive member in the remodeled electrophotographic apparatus used in Example 7 and was charged in environments of normal temperature/normal humidity (N/N=23° C./50% RH), high temperature/high humidity (H/H=35° C./85% RH) and low temperature/low humidity (15° C./10% RH) under the following conditions.

Coated aluminum cylinder peripheral speed=100 mm/sec

Peripheral speed difference=0 and −200 mm/sec (the charging brush was rotated at a peripheral speed of 100 mm in directions identical to and opposite to the direction of the coated aluminum cylinder, respectively)

Charging nip width=3 mm

Application density of charging-promoter particles=103 particles/$mm^2$

Charge efficiency (%) was measured as a percentage of a charged potential in a first revolution relative to an applied voltage (=−700 volts).

The measured results are shown in Table 3 together with those of the following examples and comparative examples.

Examples 11–19

Coated aluminum cylinders were prepared in the same manner as in Example 10 except for replacing Charge-transporting Compound No. 4 with those shown in Table 3, respectively, and evaluated in the same manner as in Example 10. The results are also shown in Table 3.

Incidentally, charge-transporting compounds used in these examples all had oxidation potentials (Pox) in the range of 0.4–1.0 volt, inclusive of, e.g., No. 42 (0.81 volt), No. 83 (0.70 volt), No. 104 (0.78 volt), No. 122 (0.70 volt), No. 145 (0.79 volt) and No. 155 (0.90 volt).

Examples 20–21 and
Comparative Examples 3 and 4

Coated aluminum cylinders were prepared in the same manner as in Example 10 except for replacing Charge-transporting compound No. 4 with the above-mentioned CTM1 (Comparative Example 3), CTM2 (Example 20), CTM3 (Example 21) and CTM4 (Comparative Example 4), respectively, and evaluated in the same manner as in Example 10. The results are also shown in Table 3.

TABLE 3

| Ex. or Comp. Ex. | Charge-transporting compound No. | Charging efficiency (%) 23° C./50% RH 0 mm/sec | 23° C./50% RH −200 mm/sec | 35° C./85% RH 0 mm/sec | 35° C./85% RH −200 mm/sec | 15° C./10% RH 0 mm/sec | 15° C./10% RH −200 mm/sec |
|---|---|---|---|---|---|---|---|
| Ex. 10 | 4 | 87 | 99 | 87 | 99 | 85 | 97 |
| Ex. 11 | 32 | 85 | 97 | 86 | 99 | 84 | 96 |
| Ex. 12 | 42 | 86 | 99 | 87 | 99 | 85 | 97 |
| Ex. 13 | 66 | 84 | 96 | 85 | 97 | 83 | 93 |
| Ex. 14 | 83 | 85 | 97 | 86 | 98 | 83 | 95 |
| Ex. 15 | 104 | 85 | 97 | 85 | 98 | 83 | 93 |
| Ex. 16 | 122 | 87 | 99 | 88 | 99 | 85 | 97 |
| Ex. 17 | 145 | 84 | 96 | 85 | 96 | 83 | 93 |
| Ex. 18 | 155 | 85 | 98 | 86 | 99 | 83 | 95 |
| Ex. 19 | 164 | 85 | 97 | 85 | 98 | 83 | 94 |
| Comp. Ex. 3 | CTM1 | 74 | 86 | 75 | 87 | 72 | 82 |
| Ex. 20 | CTM2 | 78 | 89 | 79 | 90 | 75 | 85 |
| Ex. 21 | CTM3 | 78 | 88 | 79 | 89 | 76 | 85 |
| Comp Ex. 4 | CTM4 | 75 | 86 | 77 | 88 | 73 | 83 |

Examples 22–31

The electrophotographic apparatus of sixth embodiment (FIG. 8) was remodeled by replacing the reversal development device 4 with a potential measurement probe. Separately, coated aluminum cylinders were prepared in the same manner as in Example 10 except for replacing Charge-transporting compound No. 4 with those shown in Table 4 below. The charge-transportation compounds used in these Examples all had oxidation potentials in the range of 0.4–1.0 volt, inclusive of, e.g., No. 1 (0.83 volt), No. 22 (0.90 volt), No. 60 (0.84 volt) and No. 106 (0.73 volt). Each coated aluminum cylinder was incorporated in place of the photosensitive member 4 in the remodeled electrophotographic apparatus and subjected to measurement of charging efficiency in the same manner as in Example 10 under the following condition:

Coated aluminum cylinder peripheral speed=100 mm/sec

Peripheral speed difference=0 and −150 mm/sec (charging brush was rotate din X-direction at 100 mm sec and rotated in Y-direction at 50 mm/sec)

Charging nip width=4 mm

Application density of charging promoter particles=$10^3$ particles/$mm^2$

Charge efficiency (%) was measured as a percentage of a charged potential in a first revolution relative to an applied voltage (=−700 volts).

The measured results are shown in Table 4 together with those of the following Examples and Comparative Examples.

Examples 32–33 and Comparative Examples 5 and 6

Coated aluminum cylinders were prepared in the same manner as in Example 22 except for replacing Charge-transporting compound No. 1 with the above-mentioned CTM1 (Comparative Example 5), CTM2 (Example 32), CTM3 (Example 33) and CTM4 (Comparative Example 6), respectively, and evaluated in the same manner as in Example 22. The results are also shown in Table 4.

TABLE 4

| Ex. or Comp. Ex. | Charge-transporting compound No. | Charging efficiency (%) 23° C./50% RH 0 mm/sec | 23° C./50% RH −150 mm/sec | 35° C./85% RH 0 mm/sec | 35° C./85% RH −150 mm/sec | 15° C./10% RH 0 mm/sec | 15° C./10% RH −150 mm/sec |
|---|---|---|---|---|---|---|---|
| Ex. 22 | 1 | 87 | 99 | 88 | 99 | 85 | 98 |
| Ex. 23 | 22 | 86 | 97 | 87 | 98 | 84 | 95 |
| Ex. 24 | 39 | 84 | 96 | 85 | 97 | 83 | 93 |
| Ex. 25 | 60 | 85 | 97 | 86 | 98 | 83 | 95 |
| Ex. 26 | 72 | 85 | 98 | 86 | 99 | 83 | 96 |
| Ex. 27 | 106 | 87 | 99 | 88 | 99 | 85 | 97 |
| Ex. 28 | 128 | 86 | 99 | 88 | 99 | 85 | 98 |
| Ex. 29 | 148 | 85 | 97 | 86 | 98 | 83 | 95 |
| Ex. 30 | 171 | 85 | 97 | 86 | 97 | 83 | 93 |
| Ex. 31 | 188 | 85 | 96 | 86 | 98 | 83 | 94 |
| Comp. Ex. 5 | CTM1 | 73 | 85 | 74 | 86 | 71 | 82 |
| Ex. 32 | CTM2 | 77 | 88 | 79 | 89 | 75 | 84 |

TABLE 4-continued

| Ex. or Comp. Ex. | Charge-transporting compound No. | Charging efficiency (%) 23° C./50% RH 0 mm/sec | 23° C./50% RH −150 mm/sec | 35° C./85% RH 0 mm/sec | 35° C./85% RH −150 mm/sec | 15° C./10% RH 0 mm/sec | 15° C./10% RH −150 mm/sec |
|---|---|---|---|---|---|---|---|
| Ex. 33 | CTM3 | 78 | 88 | 79 | 89 | 75 | 85 |
| Comp. Ex. 6 | CTM4 | 74 | 86 | 75 | 88 | 71 | 82 |

Example 34

The electrophotographic photosensitive member prepared in Example 7 was incorporated as a photosensitive member 1 in the electrophotographic apparatus of second embodiment (FIG. 6) and subjected to continuous image formation on about 1000 sheets in the normal temperature/normal humidity (N/N) environment under the following conditions.

Peripheral speed of the photosensitive member=100 mm/sec

Peripheral speed difference=−200 mm/sec (charging brush was rotated in the indicated arrow direction (counterward with respect to the photosensitive member at a peripheral speed of 100 mm/sec))

Charging nip width=3 mm

Amount of charging-promoter particles in the toner=3 wt. %.

The resultant solid white images and halftone images at the initial stage and after 1000 sheets were evaluated, and the results are shown in Table 1 together with those of the following examples and comparative examples.

Examples 35–40

Electrophotographic photosensitive members were prepared in the same manner as in Example 7 except for replacing Charge-transporting compound No. 41 with those shown in Table 5, and each of the photosensitive members was evaluated otherwise in the same manner as in Example 34. The results are also shown in Table 5.

Incidentally, Charge-transporting compounds used in these Examples all had oxidation potentials (Pox) in the range of 0.4–1.0 volt, inclusive of, e.g., No. 41 (0.82 volt), No. 7 (0.90 volt), No. 26 (0.83 volt), No. 73 (0.77 volt), No. 105 (0.76 volt) and No. 137 (0.63 volt).

Examples 41–42 and Comparative Examples 7 and 8

Coated aluminum cylinders were prepared in the same manner as in Example 7 except for replacing Charge-transporting compound No. 4 with the above-mentioned CTM1 (Comparative Example 7), CTM2 (Example 41), CTM3 (Example 42) and CTM4 (Comparative Example 8), respectively, and evaluated in the same manner as in Example 34. The results are also shown in Table 5.

TABLE 5

| Ex. or Comp. Ex. | Charge-trans-porting compound | Initial solid white | Initial half-tone | After 1000 sheets solid white *1 | After 1000 sheets half-tone *2 |
|---|---|---|---|---|---|
| Ex. 34 | 41 | good | good | good | good |
| Ex. 35 | 7 | good | good | good | good |
| Ex. 36 | 26 | good | good | good | good |
| Ex. 37 | 73 | good | good | good | good |
| Ex. 38 | 105 | good | good | good | good |
| Ex. 39 | 137 | good | good | good | good |
| Ex. 40 | 176 | good | good | good | good |
| Comp. | | | | | |
| Ex. 7 | CTM1 | good | good | F100 | B100 |
| Ex. 41 | CTM2 | good | good | F400 | B300 |
| Ex. 42 | CTM3 | good | good | F600 | B500 |
| Ex. 8 | CTM4 | good | good | F200 | B200 |

*1: Fn represents that fog occurred on about n-th sheet. (n = 100, 200, etc.)
*2: Bm represents that black streaks occurred on about m-th sheet. (m = 100, 200, etc.)

Example 43–44

Photosensitive members were prepared and evaluated in the same manner as in Example 7 except for using a styryl-type Charge-transporting compound (Pox=0.76 volt, Example 43) and a hydrazone-type Charge transporting compound (Pox=0.67 volt, Example 44) instead of Charge-transporting compound No. 41.

Figure 12:
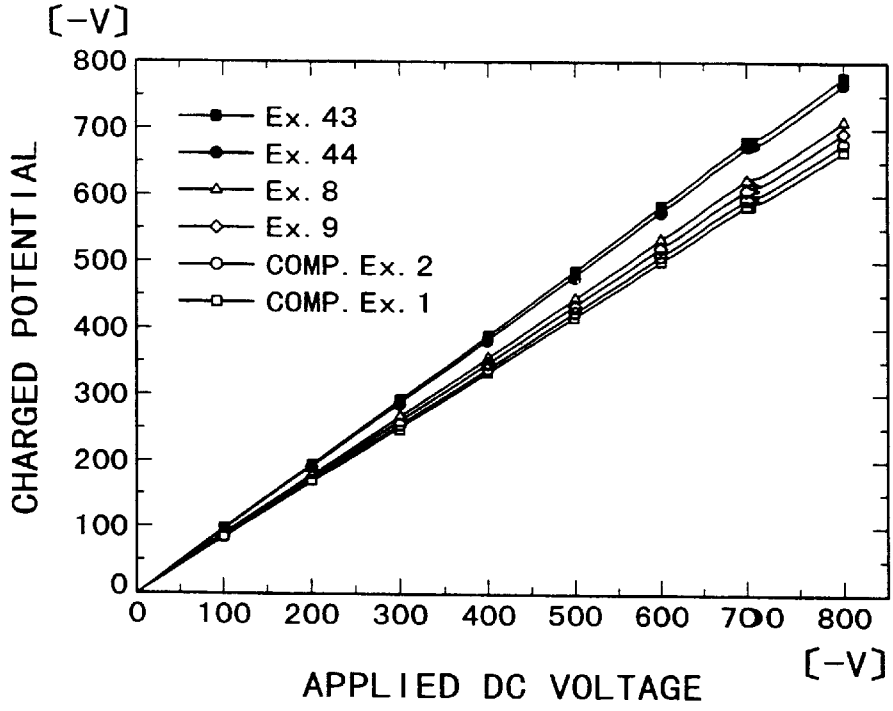
FIG. 12 is a graph showing charging characteristics according to Examples 8, 9, 43 and 44 and Comparative Examples 1–2.

The results are shown in FIG. 12 together with those of Comparative Example 1, etc., already shown in FIG. 11.

Examples 45–54

Coated aluminum cylinders were prepared in the same manner as in Example 10 except for replacing Charge-transporting Compound No. 4 with those shown in Table 6, respectively, and evaluated in the same manner as in Example 10. The results are also shown in Table 6.

Incidentally, the Charge-transporting compounds used in these Examples all had oxidation potentials (Pox) in the range of 0.4–1.0 volt, inclusive of, e.g., No. 286 (0.81 volt), No. 205 (0.79 volt), No. 243 (0.72 volt), No. 268 (0.83 volt), No. 282 (0.73 volt) and No. 315 (0.50 volt).

TABLE 6

| Ex. or Comp. Ex. | Charge-transporting compound No. | Charging efficiency (%) 23° C./50% RH 0 mm/sec | 23° C./50% RH −200 mm/sec | 35° C./85% RH 0 mm/sec | 35° C./85% RH −200 mm/sec | 15° C./10% RH 0 mm/sec | 15° C./10% RH −200 mm/sec |
|---|---|---|---|---|---|---|---|
| Ex. 45 | 286 | 86 | 99 | 87 | 99 | 84 | 97 |
| Ex. 46 | 205 | 85 | 98 | 87 | 99 | 83 | 96 |
| Ex. 47 | 235 | 85 | 97 | 86 | 98 | 83 | 94 |
| Ex. 48 | 243 | 84 | 96 | 85 | 97 | 83 | 93 |
| Ex. 49 | 247 | 85 | 97 | 86 | 99 | 83 | 94 |
| Ex. 50 | 252 | 85 | 97 | 86 | 99 | 83 | 93 |
| Ex. 51 | 259 | 84 | 96 | 86 | 98 | 83 | 93 |
| Ex. 52 | 268 | 85 | 98 | 88 | 99 | 83 | 96 |
| Ex. 53 | 282 | 85 | 99 | 87 | 99 | 84 | 97 |
| Ex. 54 | 315 | 84 | 96 | 85 | 97 | 83 | 93 |

Examples 55–64

Coated aluminum cylinders were prepared in the same manner as in Example 10 except for replacing the Charge-transporting Compound No. 4 with those shown in Table 7, respectively, and evaluated in the same manner as in Example 10, The results are also shown in Table 7.

Incidentally, the charge-transporting compounds used in these Examples all had oxidation potentials (Pox) in the range of 0.4–1.0 volt, inclusive of, e.g., No. 323 (0.57 volt), No. 326 (0.67 volt), No. 335 (0.83 volt), No. 340 (0.84 volt), No. 351 (0.92 volt).

TABLE 7

| Ex. or Comp. Ex. | Charge-transporting compound No. | Charging efficiency (%) 23° C./50% RH 0 mm/sec | 23° C./50% RH −200 mm/sec | 35° C./85% RH 0 mm/sec | 35° C./85% RH −200 mm/sec | 15° C./10% RH 0 mm/sec | 15° C./10% RH −200 mm/sec |
|---|---|---|---|---|---|---|---|
| Ex. 55 | 323 | 87 | 99 | 88 | 99 | 85 | 98 |
| Ex. 56 | 326 | 86 | 98 | 87 | 99 | 84 | 96 |
| Ex. 57 | 335 | 86 | 97 | 87 | 93 | 84 | 95 |
| Ex. 58 | 340 | 84 | 96 | 85 | 97 | 83 | 94 |
| Ex. 59 | 344 | 84 | 96 | 85 | 97 | 83 | 93 |
| Ex. 60 | 351 | 87 | 99 | 88 | 99 | 84 | 97 |
| Ex. 61 | 358 | 84 | 96 | 86 | 98 | 83 | 93 |
| Ex. 62 | 361 | 85 | 97 | 86 | 98 | 84 | 95 |
| Ex. 63 | 365 | 84 | 96 | 85 | 98 | 83 | 94 |
| Ex. 64 | 371 | 85 | 97 | 87 | 98 | 83 | 95 |

Examples 65–74

Coated aluminum cylinders were prepared in the same manner as in Example 10 except for replacing the Charge-transporting Compound No. 4 with those shown in Table 8, respectively, and evaluated in the same manner as in Example 22. The results are also shown in Table 8.

Incidentally, the charge-transporting compounds used in these Examples all had oxidation potentials (Pox) in the range of 0.4–1.0 volt, inclusive of, e.g., No. 196 (0.86 volt), No. 222 (0.81 volt), No. 281 (0.80 volt) and No. 316 (0.55 volt).

TABLE 8

| Ex. or Comp. Ex. | Charge-transporting compound No. | Charging efficiency (%) 23° C./50% RH 0 mm/sec | 23° C./50% RH −150 mm/sec | 35° C./85% RH 0 mm/sec | 35° C./85% RH −150 mm/sec | 15° C./10% RH 0 mm/sec | 15° C./10% RH −150 mm/sec |
|---|---|---|---|---|---|---|---|
| Ex. 65 | 196 | 87 | 99 | 89 | 99 | 85 | 97 |
| Ex. 66 | 215 | 85 | 97 | 88 | 99 | 83 | 93 |
| Ex. 67 | 222 | 84 | 97 | 85 | 98 | 83 | 94 |
| Ex. 68 | 238 | 84 | 96 | 87 | 98 | 84 | 94 |
| Ex. 69 | 257 | 85 | 98 | 86 | 99 | 84 | 95 |
| Ex. 70 | 266 | 84 | 97 | 87 | 98 | 84 | 95 |
| Ex. 71 | 281 | 86 | 99 | 88 | 99 | 86 | 97 |
| Ex. 72 | 290 | 84 | 97 | 88 | 99 | 84 | 95 |
| Ex. 73 | 303 | 84 | 96 | 86 | 97 | 83 | 93 |
| Ex. 74 | 316 | 85 | 97 | 86 | 99 | 84 | 94 |

Examples 75–84

Coated aluminum cylinders were prepared in the same manner as in Example 10 except for replacing the Charge-transporting Compound No. 4 with those shown in Table 9, respectively, and evaluated in the same manner as in Example 22. The results are also shown in Table 9.

Incidentally, the charge-transporting compounds used in these Examples all had oxidation potentials (Pox) in the range of 0.4–1.0 volt, inclusive of, e.g., No. 328 (0.68 volt), No. 337 (0.76 volt), No. 343 (0.65 volt), No. 347 (0.83 volt), No. 350 (0.96 volt) and No. 372 (0.55 volt).

TABLE 9

| Ex. or Comp. Ex. | Charge-transporting compound No. | Charging efficiency (%) 23° C./50% RH 0 mm/sec | 23° C./50% RH −150 mm/sec | 35° C./85% RH 0 mm/sec | 35° C./85% RH −150 mm/sec | 15° C./10% RH 0 mm/sec | 15° C./10% RH −150 mm/sec |
|---|---|---|---|---|---|---|---|
| Ex. 75 | 328 | 86 | 99 | 88 | 99 | 84 | 97 |
| Ex. 76 | 337 | 84 | 96 | 85 | 97 | 83 | 93 |
| Ex. 77 | 343 | 85 | 97 | 85 | 98 | 83 | 95 |
| Ex. 78 | 347 | 84 | 96 | 86 | 98 | 83 | 94 |
| Ex. 79 | 350 | 85 | 97 | 86 | 99 | 83 | 94 |
| Ex. 80 | 354 | 86 | 98 | 87 | 99 | 84 | 96 |
| Ex. 81 | 356 | 85 | 97 | 86 | 98 | 83 | 95 |
| Ex. 82 | 367 | 84 | 96 | 85 | 98 | 83 | 93 |
| Ex. 83 | 369 | 86 | 98 | 86 | 99 | 84 | 96 |
| Ex. 84 | 372 | 84 | 96 | 86 | 97 | 83 | 95 |

Examples 89–91

Photosensitive members were prepared in the same manner as in Example 34 except for replacing the Charge-transporting Compound No. 41 with those shown in Table 10, respectively, and evaluated in the same manner as in Example 34. The results are also shown in Table 10.

Incidentally, the charge-transporting compounds used in these Examples all had oxidation potentials (Pox) in the range of 0.4–1.0 volt, inclusive of, e.g., No. 199 (0.76 volt), No. 268 (0.73 volt) and No. 286 (0.81 volt).

TABLE 10

| Ex. or Comp. Ex. | Charge-transporting compound | Initial solid white | Initial half-tone | After 1000 sheets solid white | After 1000 sheets half-tone |
|---|---|---|---|---|---|
| Ex. 85 | 119 | good | good | good | good |
| Ex. 86 | 227 | good | good | good | good |
| Ex. 87 | 245 | good | good | good | good |
| Ex. 88 | 268 | good | good | good | good |
| Ex. 89 | 286 | good | good | good | good |
| Ex. 90 | 291 | good | good | good | good |
| Ex. 91 | 314 | good | good | good | good |

Examples 92–98

Coated aluminum cylinders were prepared in the same manner as in Example 34 except for replacing the Charge-transporting Compound No. 41 with those shown in Table 11, respectively, and evaluated in the same manner as in Example 34. The results are also shown in Table 11.

Incidentally, the charge-transporting compounds used in these Examples all had oxidation potentials (Pox) in the range of 0.4–1.0 volt, inclusive of, e.g., No. 332 (0.67 volt), No. 323 (0.57 volt), No. 336 (0.61 volt) and No. 353 (0.74 volt).

TABLE 11

| Ex. or Comp. Ex. | Charge-trans-porting compound | Initial solid white | Initial half-tone | After 1000 sheets solid white | After 1000 sheets half-tone |
|---|---|---|---|---|---|
| Ex. 92 | 332 | good | good | good | good |
| Ex. 93 | 323 | good | good | good | good |
| Ex. 94 | 336 | good | good | good | good |
| Ex. 95 | 342 | good | good | good | good |
| Ex. 96 | 348 | good | good | good | good |
| Ex. 97 | 353 | good | good | good | good |
| Ex. 98 | 370 | good | good | good | good |

From the results shown in Tables 10 and 11, it is understood that the photosensitive members used in the present invention exhibited good injection-chargeability, provided good images free from image defects attributable to charging failure or charging irregularity, and exhibited good continuous image forming performance.

Example 99

Figure 13:
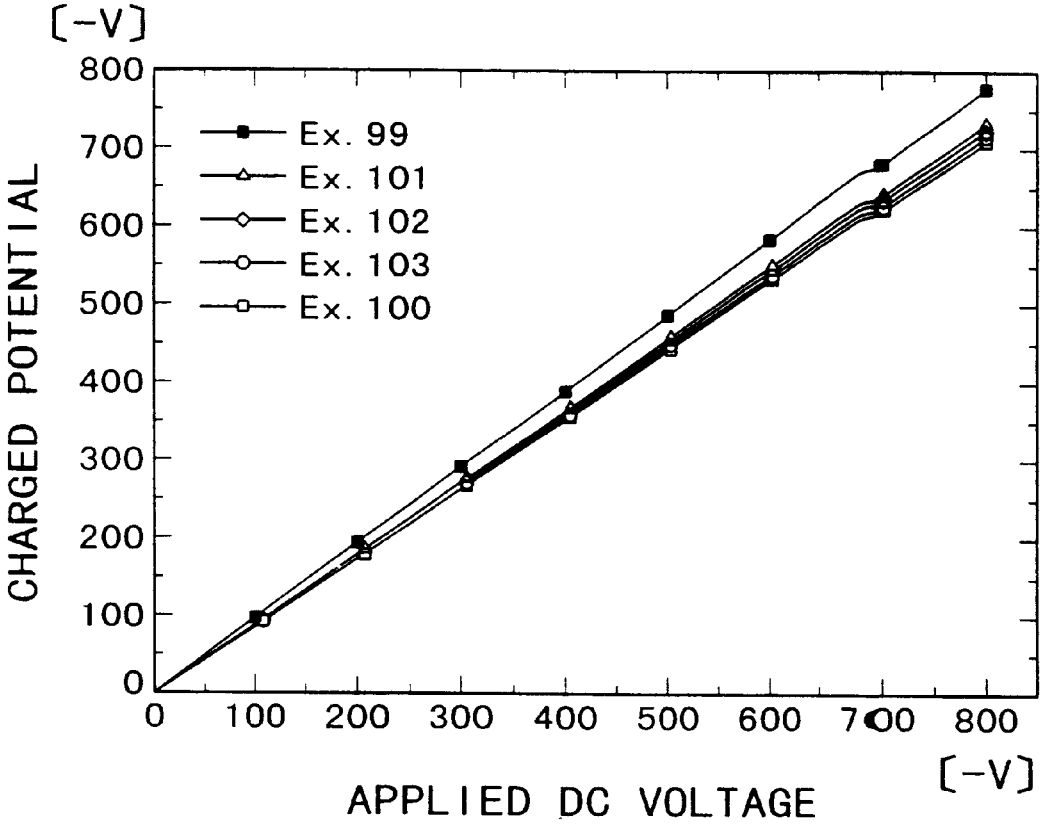
FIG. 13 is a graph showing charging characteristics according to Examples 99–103.

A photosensitive member was prepared in the same manner as in Example 7 except for using styryl-type Charge-transporting compound No. 286 (Pox=0.81 volt) instead of Charge-transporting compound No. 41 and polycarbonate of Binder No. B-24 (Mw=46000, ∈=3.0) instead of Binder No. B-12, and evaluated in the same manner as in Example 7. The results are shown in FIG. 13.

Examples 100–103

Photosensitive members were prepared and evaluated in the same manner as in Example 99 except for replacing Binder No. B-24 with the following binders CTB1 (Example 100), CTB2 (Example 101), CTB3 (Example 102) and CTE4 (Example 104), respectively.

CTB1: polystyrene (Mw=80000, ∈=2.5)

CTB2: polyester (∈=3.7; "S-1000", mfd. by Sumitomo Kagaku Kogyo K.K.)

CTB3: polysulfone (∈=3.7, "GF-130", mfd. by Teijin Acomo Engineering Plastics K.K.)

CTB4: polyethersulfone (∈=3.8; "AG-320", mfd. by Teijin Acomo Engineering Plastics K.K.)

The results are also shown in FIG. 13.

As is understood from the results shown in FIG. 13, according to the electrophotographic apparatus of the present invention, the photosensitive member can be charged to a potential that is linearly proportional to a voltage applied to the contact-charging member even at voltages below the discharge-threshold voltage.

Further, a photosensitive member formed of a binder resin having a dielectric constant (∈) in a range of 2.6–3.6 (Example 99) exhibited a better injection-chargeability to a potential comparable to the voltage applied to the charging member.

Example 104

A coated aluminum cylinder was prepared and evaluated in the same manner as in Example 10 except for using the hydrazone-type Charge-transporting compound No. 322 (Pox=0.57 volt) instead of the Charge-transporting compound No. 4 and the polycarbonate-type Binder No. B-14 (Mw=$10^5$, ∈=3.1) instead of the Binder No. B-12. The results are shown in Table 12 together with those of the following Examples.

Examples 105–113

Coated aluminum cylinders were prepared and evaluated in the same manner as In Example 104 except for replacing the Binder No. B-14 with the following Binder resins, respectively.

Example 105

No. B-1: polyphenyl ether ("X-9108", mfd. by Asahi Kasei Kogyo K.K.)

Example 106

No. B-2; polyphenylene ether ("X-1711", ditto)

Example 107

No. B-3: polysulfone ("GF-120", mfd. by Teijin Acomo Engineering Plastics K.K.)

Example 108

No. B-4: polysulfone ("P-1720", ditto)

Example 109

No. B-5: polyether sulfone ("A-200", ditto)

Example 110

No. B-12: polycarbonate (Mw=85000)

Example 111

No. B-35: polycarbonate (Mw=93000)

Example 112

No. B-48: polyacrylate (Mw=110,000)

Example 113

No. B-66: styrene-methacrylate copolymer (Mw=120,000).

The evaluation results are inclusively shown in Table 12 together with the dielectric constants (∈) of the respective resins.

Examples 114–117

Coated aluminum cylinders were prepared and evaluated in the same manner as in Example 104 except for replacing the Binder No. B-14 with binder resins CTB-1 to CTB-4, respectively, used in Examples 100–103. The evaluation results are also shown in Table 12.

TABLE 12

| Ex. or Comp. Ex. | Binder resin No. | ε | Charging efficiency (%) 23° C./50% RH 0 mm/sec | 23° C./50% RH −200 mm/sec | 35° C./85% RH 0 mm/sec | 35° C./85% RH −200 mm/sec | 15° C./10% RH 0 mm/sec | 15° C./10% RH −200 mm/sec |
|---|---|---|---|---|---|---|---|---|
| Ex. 104 | 14 | 3.1 | 85 | 98 | 86 | 99 | 83 | 96 |
| Ex. 105 | 1 | 2.8 | 82 | 96 | 83 | 96 | 81 | 92 |
| Ex. 106 | 2 | 3.0 | 81 | 95 | 82 | 96 | 80 | 91 |
| Ex. 107 | 3 | 3.6 | 82 | 95 | 83 | 96 | 81 | 92 |
| Ex. 108 | 4 | 3.3 | 81 | 95 | 82 | 96 | 80 | 91 |
| Ex. 109 | 5 | 3.6 | 81 | 96 | 82 | 96 | 80 | 92 |
| Ex. 110 | 12 | 3.0 | 84 | 97 | 85 | 98 | 83 | 95 |
| Ex. 111 | 35 | 3.0 | 83 | 97 | 85 | 99 | 82 | 95 |
| Ex. 112 | 48 | 3.3 | 86 | 99 | 87 | 99 | 84 | 97 |
| Ex. 113 | 66 | 2.6 | 84 | 98 | 85 | 99 | 83 | 96 |
| Ex. 114 | CTB1 | 2.5 | 78 | 91 | 79 | 91 | 76 | 88 |
| Ex. 115 | CTB2 | 3.7 | 79 | 92 | 80 | 93 | 76 | 89 |
| Ex. 116 | CTB3 | 3.7 | 77 | 91 | 78 | 92 | 75 | 87 |
| Ex. 117 | CTB4 | 3.8 | 76 | 90 | 77 | 91 | 74 | 87 |

Examples 118–127

Coated aluminum cylinders were prepared in the same manner as in Example 10 except for using the arylamine type Charge-transporting Compound NO. 105 (Pox=0.76 volt) instead of the Charge transporting compound No. 4 and replacing the Binder No. B-12 with the following Binder resins, respectively, and evaluated in the same manner as in Example 22. The results are inclusively shown in Table 13.

Example 118

B-10: polycarbonate (Mw=95,000)

Example 119

B-21: polycarbonate (Mw=55,000)

Example 120

B-26: polycarbonate (Mw=130,000)

Example 121

B-50: polyarylate (Mw=90,000)

Example 122

B-52: polyarylate (Mw=120,000)

Example 123

B-68: styrene-methacrylate copolymer (Mw=85,000)

Example 124

B-73: styrene-methacrylate copolymer (Mw=60,000)

Example 125

B-12+B-14: 1:1 (mol-ratio) polycarbonate copolymer (Mw=120,000)

Example 126

B-24+PDMS: polycarbonate/polydimethylsiloxane (=9/1 by mol) block copolymer (Mw=130,000)

Example 127

B-24 +B-48: 1:1 (by weight)-blend of polyearbonate Binder No. B-24 (Mw=46,000) and polyacrylate Binder No. B-48 (Mw=110,000).

Examples 128–131

Coated aluminum cylinders were prepared and evaluated in the same manner as in Example 118 except for replacing the Binder No. B-10 with binder resins CTB-1 to CTB-4, respectively, used in Examples 100–103. The evaluation results are also shown in Table 13.

TABLE 13

| Ex. or Comp. Ex. | Binder resin No. | ε | Charging efficiency (%) 23° C./50% RH 0 mm/sec | 23° C./50% RH −150 mm/sec | 35° C./85% RH 0 mm/sec | 35° C./85% RH −150 mm/sec | 15° C./10% RH 0 mm/sec | 15° C./10% RH −150 mm/sec |
|---|---|---|---|---|---|---|---|---|
| Ex. 118 | 10 | 3.1 | 83 | 97 | 84 | 98 | 82 | 94 |
| Ex. 119 | 21 | 3.0 | 84 | 97 | 85 | 98 | 82 | 94 |
| Ex. 120 | 26 | 3.1 | 84 | 98 | 85 | 99 | 83 | 95 |
| Ex. 121 | 50 | 3.4 | 86 | 99 | 87 | 99 | 85 | 97 |
| Ex. 122 | 52 | 3.2 | 83 | 98 | 84 | 98 | 83 | 95 |
| Ex. 123 | 68 | 2.8 | 83 | 97 | 84 | 98 | 82 | 94 |
| Ex. 124 | 73 | 2.7 | 84 | 97 | 85 | 98 | 82 | 94 |
| Ex. 125 | 12 + 14 (1:1) | 3.1 | 83 | 98 | 84 | 98 | 82 | 94 |

TABLE 13-continued

| Ex. or Comp. Ex. | Binder resin No. | ε | Charging efficiency (%) 23° C./50% RH 0 mm/sec | 23° C./50% RH −150 mm/sec | 35° C./85% RH 0 mm/sec | 35° C./85% RH −150 mm/sec | 15° C./10% RH 0 mm/sec | 15° C./10% RH −150 mm/sec |
|---|---|---|---|---|---|---|---|---|
| Ex. 126 | 24 + PDMS | 2.9 | 85 | 98 | 86 | 99 | 84 | 96 |
| Ex. 127 | 24 + 48 (1:1) | 3.3 | 85 | 99 | 86 | 99 | 84 | 96 |
| Ex. 128 | CTB1 | 2.5 | 77 | 90 | 78 | 91 | 76 | 87 |
| Ex. 129 | CTB2 | 3.7 | 78 | 92 | 80 | 92 | 76 | 89 |
| Ex. 130 | CTB3 | 3.7 | 76 | 91 | 77 | 92 | 74 | 86 |
| Ex. 131 | CTB4 | 3.8 | 75 | 90 | 77 | 91 | 73 | 86 |

Example 132

The photosensitive member prepared in Example 99 was incorporated as a photosensitive member 1 in the electrophotographic apparatus of the second embodiment (FIG. 6) and subjected to continuous image formation on 2000 sheets otherwise under the same conditions as in Example 34. The results are shown in Table 14 together with those of the following Examples.

Examples 133–138

Photosensitive members were prepared in the same manner as in Example 99 except for replacing the polycarbonate Binder No. B-24 with the following binder resins, respectively, and each photosensitive member was evaluated in the same manner as in Example 132. The results are also shown in Table 14.

Example 133

B-3: polysulfone ("GF-120")

Example 134

B-12: polycarbonate (Mw=85,000)

Example 135

B-35: polycarbonate (Mw=93,000)

Example 136

B-48: polyarylate (Mw=110,000)

Example 137

B-50: polyarylate (Mw=90,000)

Example 138

B-66: styrene-methacrylate copolymer (Mw=120,000).

Examples 139–142

Photosensitive members prepared in Examples 100–103 were evaluated in the same manner as in Example 132. The results are also shown in Table 14.

TABLE 14

| Ex. or Comp. Ex. | Binder resin No. | ε | Initial solid white | Initial half-tone | After 2000 sheets solid white *1 | After 2000 sheets half-tone *2 |
|---|---|---|---|---|---|---|
| Ex. 132 | 24 | 3.0 | good | good | good | good |
| Ex. 133 | 3 | 3.6 | good | good | good | good |
| Ex. 134 | 12 | 3.0 | good | good | good | good |
| Ex. 135 | 35 | 3.0 | good | good | good | good |
| Ex. 136 | 48 | 3.3 | good | good | good | good |
| Ex. 137 | 50 | 3.4 | good | good | good | good |
| Ex. 138 | 66 | 2.6 | good | good | good | good |
| Ex. 139 | CTB1 | 2.5 | good | good | F1300 | F1300 |
| Ex. 140 | CTB2 | 3.7 | good | good | F1400 | F1300 |
| Ex. 141 | CTB3 | 3.7 | good | good | F1300 | F1200 |
| Ex. 142 | CTB4 | 3.8 | good | good | F1200 | F1100 |

*1 Fn represents that fog occurred on about n-th sheet. (n = 1200, 1300, etc.)
*2 Bm represents that black streaks occurred on about m-th sheet. (m = 1100, 1200, etc.)

As is understood from the results shown in Table 4, it is believed understandable that photosensitive members formed by using a binder resin having a dielectric constant (∈) in a range of 2.6–3.6 exhibited especially better injection chargeability, provided good images free from image defects attributable to charging failure or charging irregularity and better continuous image forming performance.

Other Features

1) The charging promoter particles application and supply means 8 used in combination with the photosensitive member or the contact charging member is not restricted to those specifically described with reference to the above embodiments. For example, it is also possible to use a foamed body or a fur brush containing charging promoter particles m and abutted against the photosensitive member 1 or the charging member 2.

2) The electric or resilient contact charging member is not restricted to a charging brush or a charging roller. It is also possible to use a contact charging member formed of a material or a shape such as felt or cloth. It is also possible to laminate these materials to provide more appropriate elasticity and conductivity. It is also possible to use a contact charging member of any shape, inclusive of a blade.

3) It is possible that the charging bias voltage or developing bias voltage applied to the contact-charging member 2 or the developing sleeve 4*a* may be a DC voltage superposed with an alternating voltage or AC voltage. The alternating voltage may comprise any appropriate waveform, such as a since wave, a rectangular wave or a triangular wave. It is also possible to use a rectangular waveform obtained by periodically turning on and of f a DC voltage. Thus, it is possible to use a bias voltage comprising an alternating voltage having periodically varying voltage values.

4) The imagewise exposure means for electrostatic-latent-image formation is not restricted to a laser beam scanning exposure means, suitable for forming digital latent images, as used in the above embodiments. It is also possible to use ordinary analog image-exposure means or to use another light emission device, such as LED, or a combination of a light emission device, such as a fluorescent lamp, and a liquid crystal shutter, etc. Thus, any image light source capable of forming electrostatic latent images corresponding to image data, can be used. The image bearing member 1 can comprise an electrostatic recording dielectric instead of a photosensitive member. In this case, the dielectric surface may be uniformly primarily charged to a prescribed potential and a polarity and then selectively charge-removed by a charge-removal means, such as a charge removal stylus head or an electron gun, to form an objective electrostatic latent image on the dielectric surface.

5) In the above embodiments, a mono-component non-contact-type developing device using a magnetic developer is used as the developing device 4. It is however possible to use a non-contact-type developing device using a two-component developer or a non-magnetic developer. It is also possible to use a contact-type developing device using a mono-component or two-component developer.

6) It is also possible to insert an intermediate transfer member that once receives a toner image from the photosensitive member 1 and then transfer the toner image to a recording material, such as paper.

7) The toner particle size may for example be measured in the following manner. A Coulter counter (e.g., "Model TA-2", available from Coulter Electronics, Inc.) Is used as a measurement apparatus, and an interface for outputting a number-basis distribution and a volume-basis distribution (e.g., one available from Nikkaki K.K.) and a personal computer (e.g., "CX-1", available from Canon K.K.) are connected to the Coulter counter.

For measurement, a 1%-NaCl aqueous solution is prepared as an electrolytic solution by using a reagent-grade sodium chloride. Into the electrolytic solution, 0.1–5 ml of a surfactant, preferably an alkylbenzenesulfonic acid salt, and 0.5–50 mg of a toner sample, are added, followed by ca. 1–3 min. of dispersion treatment by means of an ultrasonic disperser, to form a sample liquid. The sample liquid is injected to the Coulter counter with a 100 $\mu$m aperture to obtain a particle size distribution of particles in a range of 2–40 $\mu$m, from which a volume-basis particle size distribution and a volume-average particle size are derived.

What is claimed is:

1. An electrophotographic apparatus, comprising:

an electrophotographic photosensitive member; charging means for charging the electrophotographic photosensitive member including a charging member supplied with a voltage and disposed in contact with the photosensitive member so as to form a nip with the photosensitive member to charge the photosensitive member; exposure means; developing means; and transfer means; wherein the photosensitive member includes a surface layer containing a charge-transporting material having an oxidation potential of 0.4–1.0 volt, and charging promoter particles are present at the nip between the photosensitive member and the charging member to injection-charge the photosensitive member.

2. An electrophotographic apparatus according to claim 1, wherein the charge-transporting material has an oxidation potential of 0.5–0.95 volt.

3. An electrophotographic apparatus according to claim 1, wherein the charge-transporting material comprises a member selected from the group consisting of compounds represent by formulae (1)–(7) shown below, condensed cyclic hydrocarbon compounds having a group represented by formula (7a) shown below, and condensed heterocyclic compounds having a group represented by the formula (7/a) shown below:

(1)

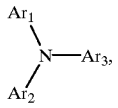

wherein $Ar_1$–$Ar_3$ independently denote a monovalent aromatic cyclic group capable of having a substituent provided that $Ar_1$ and $Ar_2$ can be connected to each other directly or via an organic group to form a ring;

(2)

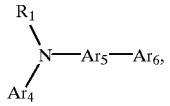

wherein $Ar_4$ and $Ar_6$ independently denote a monovalent aromatic cyclic group capable of having a substituent, $Ar_5$, denotes a divalent aromatic cyclic group capable of having a substituent; and $R_1$ denotes an alkyl group, an aralkyl group, a vinyl group or a monovalent aromatic cyclic group each capable of having a substituent, provided that $Ar_4$ and $R_1$ can be connected the each other directly or via an organic group to form a ring and $Ar_5$ and $Ar_6$ can form a ring via an organic group;

(3)

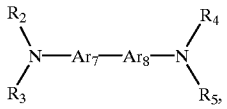

wherein $Ar_7$ and $Ar_8$ independently denote a divalent aromatic cyclic group capable of having a substituent, and $R_2$–$R_5$ independently denote an alkyl group, an aralkyl group, a vinyl group or a monovalent aromatic cyclic group each capable of having a substituent provided that at least two of $R_2$–$R_5$ denote a monovalent aromatic cyclic group capable of having a substituent, each pair of $R_2$ and $R_3$, $R_4$ and $R_5$ can be connected to each other directly or via an organic group to form a ring, and $Ar_7$ and $Ar_8$ can form a ring via an organic group;

(4)

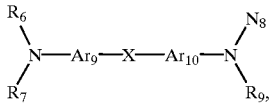

wherein $Ar_9$ and $Ar_{10}$ independently denote a divalent aromatic cyclic group capable of having a substituent, and $R_6$–$R_9$ independently denote an alkyl group, an aralkyl group, a vinyl group or a monovalent aromatic cyclic group each capable of having a substituent provided that at least two of $R_6$–$R_9$ denote a monovalent aromatic cyclic group capable of having a substituent, and each pair of $R_6$ and $R_7$, $R_8$ and $R_9$ can be connected to each other directly or via an organic group to form a ring; X denotes a divalent group selected from an alkylene group capable of having a substituent, a divalent aromatic cyclic group capable of having a substituent, a group represented by —$CR_{10}$=$CR_{11}$~ (wherein $R_{10}$ and $R_{11}$ independently denote an alkyl group capable of having a substituent, a monovalent aromatic cyclic group capable of having a substituent, or a hydrogen atom), —O—, —S—, —CO—, —SO—, —$SO_2$—, —$NR_{12}$— (wherein R12 denotes an alkyl group or a monovalent aromatic cyclic group each capable of having a substituent), and an organic residue group including at least one of oxygen and sulfur atoms;

(5)

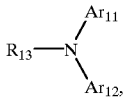

wherein $Ar_{11}$ and $Ar_{12}$ independently denote a monovalent aromatic cyclic group capable of having a substituent, and $R_{13}$ denotes an alkyl group, an aralkyl group or a monovalent aromatic cyclic group each capable of having a substituent, provided that at least one of $Ar_{11}$, $Ar_{12}$ and $R_{13}$ has at least one substituent represented by the following formula (5a):

(5a)

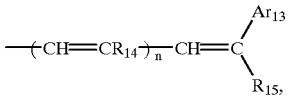

wherein $R_{14}$ and $R_{15}$ independently denote an alkyl group, an aralkyl group or a monovalent aromatic cyclic group each capable of having a substituent; $Ar_{13}$ denotes a monovalent aromatic cyclic group capable of having a substituent provided that $Ar_{13}$ and $R_{15}$ can be connected to each other directly or via an organic group to form a ring; and n is an integer of 0–2:

(6)

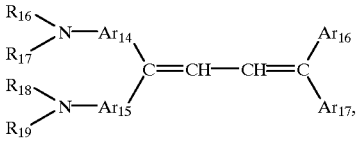

wherein $Ar_{14}$ and $Ar_{15}$ independently denote a divalent aromatic cyclic group capable of having a substituent; $Ar_{16}$ and $Ar_{17}$ independently denote a monovalent aromatic cyclic group capable of having a substituent; and $R_{16}$–$R_{19}$ independently denote an alkyl group, an aralkyl group or a monovalent aromatic cyclic group each capable of having a substituent, provided that each pair of $Ar_{16}$ and $Ar_{17}$, $R_{16}$ and $R_{17}$, and $R_{18}$ and $R_{19}$ can be connected to each other directly or via an organic group to form a ring;

(7)

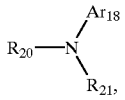

wherein $R_{20}$ and $R_{21}$ independently denote an alkyl group, aralkyl group or a monovalent aromatic cyclic group each capable of having a substituent, and $Ar_{18}$ denotes a monovalent aromatic cyclic group capable of having a substituent, with the proviso that at least one of $R_{20}$, $R_{21}$ and $A_{18}$ has a substituent represented by the following formula (7a):

(7a)

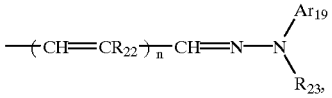

wherein $R_{22}$ and $R_{23}$ independently denote an alkyl group, an aralkyl group or a monovalent aromatic cyclic group each capable of having a substituent, or a hydrogen atom; $Ar_{19}$ denotes a monovalent aromatic cyclic group capable of having a substituent, provided that $Ar_{19}$ and $R_{23}$ can be connected to each other directly or via an organic group; and n is an integer of 0–2.

4. An electrophotographic apparatus according to claim 3, wherein the charge-transporting material is represented by the formula (1).

5. An electrophotographic apparatus according to claim 3, wherein the charge-transporting material iS represented by the formula (2).

6. An electrophotographic apparatus according to claim 3, wherein the charge-transporting material is represented by the formula (3).

7. An electrophotographic apparatus according to claim 3, wherein the charge-transporting material is represented by the formula (4).

8. An electrophotographic apparatus according to claim 3, wherein the charge-transporting material is represented by the formula (5).

9. An electrophotographic apparatus according to claim 3, wherein the charge-transporting material is represented by the formula (6).

10. An electrophotographic apparatus according to claim 3, wherein the charge-transporting material is represented by the formula (7).

11. An electrophotographic apparatus according to claim 3, wherein the charge-transporting material comprises a condensed cyclic hydrocarbon compound having a group represented by the formula (7a).

12. An electrophotographic apparatus according to claim 3, wherein the charge-transporting material comprises a condensed heterocyclic compound having a group represented by the formula (7a).

13. An electrophotographic apparatus according to claim 1, wherein the surface layer of the photosensitive member comprises a binder resin hating a dielectric constant of 2.6–3.6.

14. An electrophotographic apparatus according to claim 13, wherein the binder resin has a structural unit represented by the formula (8) below:

(8)

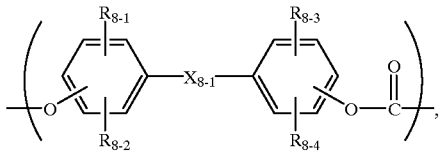

wherein $R_{8-1}$ to $R_{8-4}$ independently denote a hydrogen atom, an alkyl group capable of having a substituent, an aralkyl group capable of having a substituent, an alkoxy group or a halogen atom; and $X_{8-1}$ denotes a single bond (by which the two phenylene groups are directly bonded to each other), an alkylene groups capable of having a substituent, a phenylalkylidene group capable of having a substituent, a cycloalkylene group capable of having a substituent, a divalent aromatic cyclic group capable of having a substituent, a carbonyl group, a thiocarbonyl group, an oxygen atom, or a sulfur atom.

15. An electrophotographic apparatus according to claim 13, wherein the binder resin has a structural unit represented by the formula (9) below;

(9)

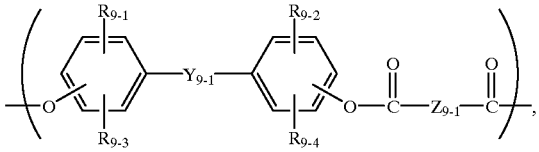

wherein $R_{9-1}$ to $R_{9-4}$ independently denote a hydrogen atom, an alkyl group capable of having a substituent, an aralkyl group capable of having a substituent, an alkoxy group or a halogen atom; $X_{9-1}$ denotes a single bond (by which the two phenylene groups are directly bonded to each other), an alkylene groups capable of having a substituent, a phenylalkylidene group capable of having a substituent, a cycloalkylene group capable of having a substituent, a divalent aromatic cyclic group capable of having a substituent, a carbonyl group, a thiocarbonyl group, an oxygen atom, or a sulfur atom; and $Z_{9-1}$ denotes an alkyl group capable of having a substituent, an alkylidene group capable of having a substituent, a phenylalkylidene group capable having a substituent, or a divalent aromatic cyclic group capable of having a substituent.

16. An electrophotographic apparatus according to claim 13, wherein the binder resin has a structural unit represented by the formula (10) below:

(10)

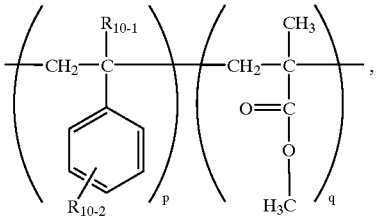

wherein $R_{10-1}$ and $R_{10-2}$ independently denote a hydrogen atom, an alkyl group capable of having a substituent, an aralkyl group capable of having a substituent, an aryl group capable of having a substituent, an alkoxy group, a halogen atom or a nitro group; and p/g represents a copolymerization ratio ranging from 9/1 to 3/7.

17. An electrophotographic apparatus according to claim 1, wherein the charging promoter particles are present on the electrophotographic photosensitive member at a density of at least $10^2$ particles/mm$^2$.

18. An electrophotographic apparatus according to claim 1, wherein the charging promoter particles are present on the electrophotographic photosensitive member at a density of at least $10^3$ particles/mm$^2$.

19. An electrophotographic apparatus according to claim 17, wherein the charging promoter particles are present on the electrophotographic photosensitive member at a density of at most $10^5$ particles/mm$^2$.

20. An electrophotographic apparatus according to claim 1, wherein the charging promoter particles have a resistivity of at most $1\times10^{12}$ ohm.cm.

21. An electrophotographic apparatus according to claim 1, wherein the charging promoter particles have a resistivity of at most $1\times10^{10}$ ohm.cm.

22. An electrophotographic apparatus according to claim 1, wherein the charging promoter particles have an average particle size of 10 nm–5 $\mu$m.

23. An electrophotographic apparatus according to claim 1, wherein the charging promoter particles comprise metal oxide particles.

24. An electrophotographic apparatus according to claim 23, wherein the charging promoter particles comprise zinc oxide particles.

25. An electrophotographic apparatus according to claim 1, wherein the charging member is moved with a peripheral speed difference relative to the photosensitive member at the nip with the photosensitive member.

26. An electrophotographic apparatus according to claim 25, wherein the charging member is moved in a direction opposite to a moving direction of the photosensitive member at the nip with the photosensitive member.

27. An electrophotographic apparatus according to claim 1, wherein the charging member comprises a charging roller.

28. An electrophotographic apparatus according to claim 1, wherein the charging member comprises a charging fur brush.

29. A process cartridge, comprising:

an electrophotographic photosensitive member; and charging means for charging the electrophotographic photosensitive member including a charging member supplied with a voltage and disposed in contact with the photosensitive member so as to form a nip with the photosensitive member to charge the photosensitive member; wherein the photosensitive member includes a surface layer containing a charge-transporting material having an oxidation potential of 0.4–1.0 volt, and charging promoter particles are present at the nip between the photosensitive member and the charging member to injection-charge the photosensitive member;

the photosensitive member and the charging member being integrally supported to provide an apparatus unit which is detachably mountable to a main assembly of electrophotographic apparatus.

30. A process cartridge according to claim 29, wherein the charge-transporting material has an oxidation potential of 0.5–0.95 volt.

31. A process cartridge according to claim 28, wherein the charge-transporting material comprises a member selected from the group consisting of compounds represent by formulae (1)–(7) shown below, condensed cyclic hydrocarbon compounds having a group represented by formula (7a) shown below, and condensed heterocyclic compounds having a group represented by the formula (7a) shown below:

(1)

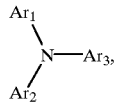

wherein $Ar_1$–$Ar_3$ independently denote a monovalent aromatic cyclic group capable of having a substituent, provided that $Ar_1$ and $Ar_2$ can be connected to each other directly or via an organic group to form a ring;

(2)

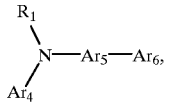

wherein $Ar_4$ and $Ar_6$ independently denote a monovalent aromatic cyclic group capable of having a substituent; $Ar_5$ denotes a divalent aromatic cyclic group capable of having a substituent; and $R_1$ denotes an alkyl group, an aralkyl group, a vinyl group or a monovalent aromatic cyclic group each capable of having a substituent, provided that $Ar_4$ and $R_1$ can be connected to each other directly or via an organic group to form a ring and $Ar_5$ and $Ar_6$ can form a ring via an organic group;

(3)

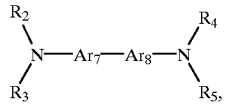

wherein $Ar_7$ and $Ar_8$ independently denote a divalent aromatic cyclic group capable of having a substituent, and $R_2$–$R_5$ independently denote an alkyl group, an aralkyl group, a vinyl group or a monovalent aromatic cyclic group each capable of having a substituent provided that at least two of $R_2$–$R_5$ denote a monovalent aromatic cyclic group capable of having a substituent, each pair of $R_2$ and $R_3$, $R_4$ and $R_5$ can be connected to each other directly or via an organic group to form a ring, and $Ar_7$ and $Ar_8$ can form a ring via an organic group;

(4)

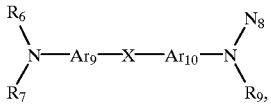

wherein $Ar_9$ and $Ar_{10}$ independently denote a divalent aromatic cyclic group capable of having a substituent, and $R_6$–$R_9$ independently denote an alkyl group, an aralkyl group, a vinyl group or a monovalent aromatic cyclic group each capable of having a substituent provided that at least two of $R_6$–$R_9$ denote a monovalent aromatic cyclic group capable of having a substituent, and each pair of $R_6$and $R_7$, $R_8$ and $R_9$ can be connected to each other directly or via an organic group to form a ring; X denotes a divalent group selected from an alkylene group capable of having a substituent, a divalent aromatic cyclic group capable of having a substituent, a group represented by —$CR_{10}$=$CR_{11}$— (wherein $R_{10}$ and $R_{11}$ independently denote an alkyl group capable of having a substituent, a monovalent aromatic cyclic group capable of having a substituent, or a hydrogen atom), —O—, —S—, —CO—, —SO—, —$SO_2$—, —$NR_{12}$— (wherein $R_{12}$ denotes an alkyl group or a monovalent aromatic cyclic group each capable of having a substituent), and an organic group including at least one of oxygen and sulfur atoms;

(5)

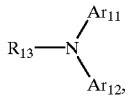

wherein $Ar_{11}$ and $Ar_{12}$ independently denote a monovalent aromatic cyclic group capable of, having substituent, and R13 denotes an alkyl group, an aralkyl group or a monovalent aromatic cyclic group each capable of having a substituent, provided that at least one of $Ar_{11}$, $Ar_{12}$ and $R_{13}$ has at least one substituent represented by the following formula (5a):

(5a)

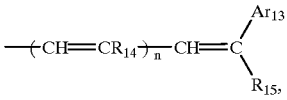

wherein $R_{14}$ and $R_{15}$ independently denote an alkyl group, an aralkyl group or a monovalent aromatic cyclic group each capable of having a substituent; $Ar_{13}$ denotes a monovalent aromatic cyclic group capable of having a substituent, provided that $Ar_{13}$ and $R_{15}$ can be connected to each other directly or via an organic group to form a ring; and n is an integer of 0–2;

(6)

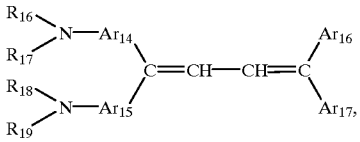

wherein $Ar_{14}$ and $Ar_{15}$ independently denote a divalent aromatic cyclic group capable of having a substituent; $Ar_{16}$ and $Ar_{17}$ independently denote a monovalent aromatic cyclic group capable of having a substituent; and $R_{16}$–$R_{19}$ independently denote an alkyl group, an aralkyl group or a monovalent aromatic cyclic group each capable of having a substituent, provided that each pair of $Ar_{16}$ and $Ar_{17}$, $R_{16}$ and $R_{17}$, and $R_{18}$ and $R_{19}$ can be connected to each other directly or via an organic group to form a ring, (7)

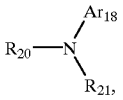

wherein $R_{20}$ and $R_{21}$ independently denote an alkyl group, an aralkyl group or a monovalent aromatic cyclic group each capable of having a substituent, and $Ar_{18}$ denotes a monovalent aromatic cyclic group capable of having a substituent, with the proviso that at least one of $R_{20}$, $R_{21}$ and $A_{18}$ has a substituent represented by the following formula (7a):

(7a)

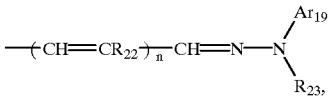

wherein $R_{22}$ and $R_{23}$ independently denote an alkyl group, an aralkyl group or a monovalent aromatic cyclic group each capable of having a substituent, or a hydrogen atom; $Ar_{19}$ denotes a monovalent aromatic cyclic group capable of having a substituent provided that $Ar_{19}$ and $R_{23}$ can be connected to each other directly or via an organic group; and n is an integer of 0–2.

32. A process cartridge according to claim 31, wherein the charge-transporting material is represented by the formula (1).

33. A process cartridge according to claim 31, wherein the charge-transporting material is represented by the formula (2).

34. A process cartridge according to claim 31, wherein the charge-transporting material is represented by the formula (3).

35. A process cartridge according to claim 31, wherein the charge-transporting material is represented by the formula (4).

36. A process cartridge according to claim 31, wherein the charge-transporting material is represented by the formula (5).

37. A process cartridge according to claim 31, wherein the charge-transporting material is represented by the formula (6).

38. A process cartridge according to claim 31, wherein the charge-transporting material is represented by the formula (7).

39. A process cartridge according to claim 31, wherein the charge-transporting material comprises a condensed cyclic hydrocarbon compound having a group represented by the formula (7a).

40. A process cartridge according to claim 31, wherein the charge-transporting material comprises a condensed heterocyclic compound having a group represented by the formula (7a).

41. A process cartridge according to claim 29, wherein the surface layer of the photosensitive member comprises a binder resin having a dielectric constant of 2.6–3.6.

42. A process cartridge according to claim 41, wherein the binder resin has a structural unit represented by the formula (8) below:

(8)

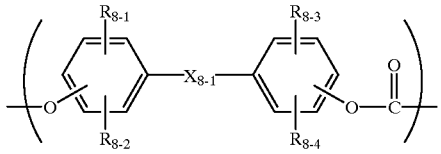

wherein $R_{8-1}$ to $R_{8-4}$ independently denote a hydrogen atom, an alkyl group capable of having a substituent, an aralkyl group capable of having a substituent, an alkoxy group or a halogen atom; and $X_{8-1}$ denotes a single bond (by which the two phenylene groups are directly bonded to each other), an alkylene groups capable of having a substituent, a phenylalkylidene group capable of having a substituent, a cycloalkylene group capable of having a substituent, a divalent aromatic cyclic group capable of having a substituent, a carbonyl group, a thiocarbonyl group, an oxygen atom, or a sulfur atom.

43. A process cartridge according to claim 41, wherein the binder resin has a structural unit represented by the formula (9) below:

(9)

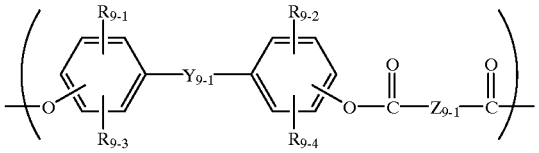

wherein $R_{9-1}$ to $R_{9-4}$ independently denote a hydrogen atom, an alkyl group capable of having a substituent, an aralkyl group capable of having a substituent, an alkoxy group or a halogen atom; $X_{9-1}$ denotes a single bond (by which the two phenylene groups are directly bonded to each other), an alkylene groups capable of having a substituent, a phenylalkylidene group capable of having a substituent, a cycloalkylene group capable of having a substituent, a divalent aromatic cyclic group capable of having a substituent, a carbonyl group, a thiocarbonyl group, an oxygen atom, or a sulfur atom; and $Z_{9-1}$ denotes an alkyl group capable of having a substituent, an alkylidene group capable of having a substituent, a phenylalkylidene group capable having a substituent, or a divalent aromatic cyclic group capable of having a substituent.

44. A process cartridge according to claim 41, wherein the binder resin has a structural unit represented by the formula (10) below:

(10)

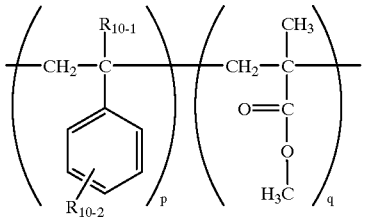

wherein $R_{10-1}$ and $R_{10-2}$ independently denote a hydrogen atom, an alkyl group Capable of having a substituent, an aralkyl group capable of having a substituent, and aryl group capable of having a substituent, an alkoxy group, a halogen atom or a nitro group; and p/q represents a copolymerization ratio ranging from 9/1 to 3/7.

45. A process cartridge according to claim 29, wherein the charging promoter particles are present on the electrophotographic photosensitive member at a density of at least $10^2$ particles/mm$^2$.

46. A process cartridge according to claim 29, wherein the charging promoter particles are present on the electrophotographic photosensitive member at a density of at least $10^3$ particles/mm$^2$.

47. A process cartridge according to claim 29, wherein the charging promoter particles are present on the electrophotographic photosensitive member at a density of at most $10^5$ particles/mm$^2$.

48. A process cartridge according to claim 29, wherein the charging promoter particles have a resistivity of at most $1\times10^{12}$ ohm.cm.

49. A process cartridge according to claim 29, wherein the charging promoter particles have a resistivity of at most $1\times10^{10}$ ohm.cm.

50. A process cartridge according to claim 29, wherein the charging promoter particles have an average particle size of 10 nm–5 $\mu$m.

51. A process cartridge according to claim 29, wherein the charging promoter particles comprise metal oxide particles.

52. A process cartridge according to claim 51, wherein the charging promoter particles comprise zinc oxide particles.

53. A process cartridge according to claim 29, wherein the charging member is moved with a peripheral speed difference relative to the photosensitive member at the nip with the photosensitive member.

54. A process cartridge according to claim 53, wherein the charging member is moved in a direction opposite to a moving direction of the photosensitive member at the nip with the photosensitive member.

55. A process cartridge according to claim 29, wherein the charging member comprises a charging roller.

56. A process cartridge according to claim 29, wherein the charging member comprises a charging fur brush.

* * * * *

UNITED STATES PATENT AND TRADEMARK OFFICE

CERTIFICATE OF CORRECTION

PATENT NO. : 6,289,190 B1
APPLICATION NO. : 09/389584
DATED : September 11, 2001
INVENTOR(S) : Shoji Amamiya et al.

It is certified that error appears in the above-identified patent and that said Letters Patent is hereby corrected as shown below:

COLUMN 1:
Line 9, “electro-photographic” should read --electrophotographic--.
Line 27, “image bearing-member” should read --image-bearing member--.

COLUMN 2:
Line 62, “characteristic” should read --characteristic.--.

COLUMN 4:
Line 32, “type” should read --types--.
Line 36, “of.” should read --of--.
Line 45, “structure” should read --structure,--.

COLUMN 5:
Line 55, “obviated” should read --obviated.--.

COLUMN 6:
Line 40, “be” should be deleted.
Line 51, “In” should read --in--.

COLUMN 7:
Line 8, “less” should read --less,--.
Line 10, “been also” should read --also been--.
Line 52, “also.” should read --also--.
Line 59, “Invention” should read --invention--.

COLUMN 8:
Line 48, “material,” should read --material, and--.
Line 59, “In” should read --in--.
Line 67, “forms.” should read --forms:--.

COLUMN 9:
Line 27, “pyrenequinane” should read --pyrenequinone--.
Line 30, “dyes;” should read --dyes; and--.
Line 49, “resin” should read --resin.--.

COLUMN 10:
Line 10, “oxadlazoles,” should read --oxadiazoles--.
Line 12, “derives” should read --derived--.

COLUMN 11:
Line 10, “$At_7$” should read --$Ar_7$--.

UNITED STATES PATENT AND TRADEMARK OFFICE

CERTIFICATE OF CORRECTION

PATENT NO. : 6,289,190 B1
APPLICATION NO. : 09/389584
DATED : September 11, 2001
INVENTOR(S) : Shoji Amamiya et al.

It is certified that error appears in the above-identified patent and that said Letters Patent is hereby corrected as shown below:

COLUMN 49:
Example No. 114 should read

-- 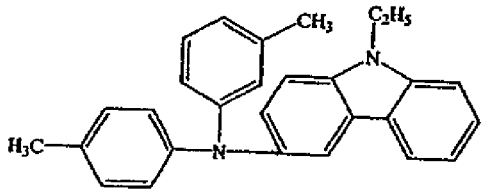 --.

COLUMN 69:
Example No. 178 should read

-- 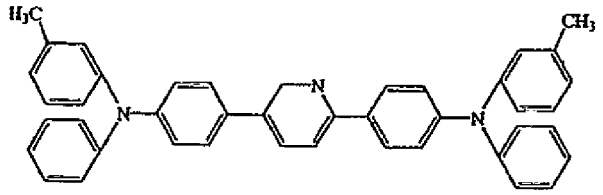 --.

COLUMN 71:
Example No. 182: should read

-- 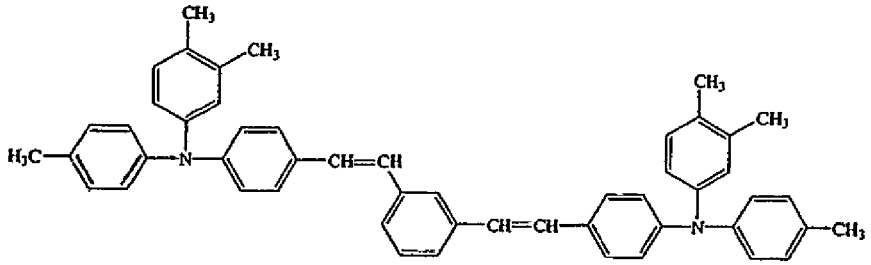 --.

Example No. 186: "$H_3C$-" should read --$CH_3$—--

COLUMN 79:
Example No. 208: should read

-- 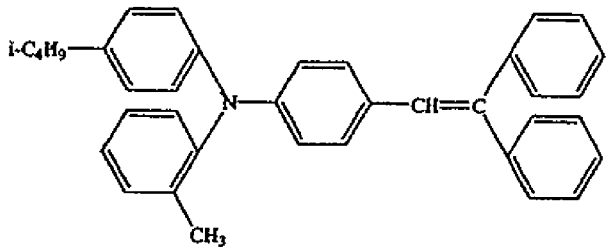 --.

UNITED STATES PATENT AND TRADEMARK OFFICE

CERTIFICATE OF CORRECTION

PATENT NO. : 6,289,190 B1
APPLICATION NO. : 09/389584
DATED : September 11, 2001
INVENTOR(S) : Shoji Amamiya et al.

It is certified that error appears in the above-identified patent and that said Letters Patent is hereby corrected as shown below:

COLUMN 81:

Example No. 215 should read

-- 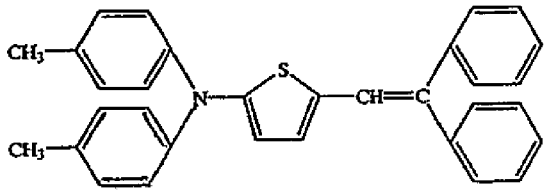 --.

Example No. 218 should read

-- 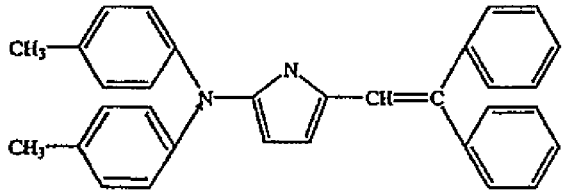 --.

Example No. 221 should read

-- 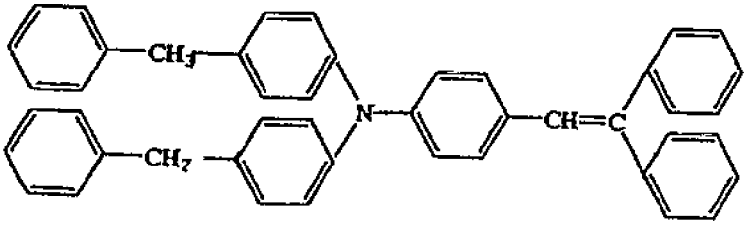 --.

COLUMN 82:

Example No. 222 should read

-- 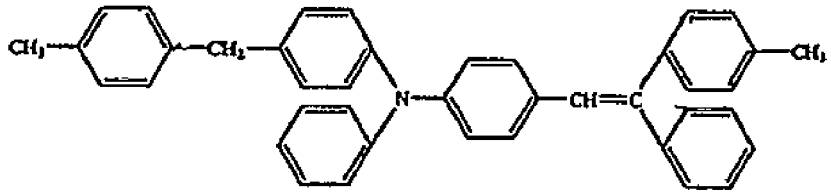 --.

UNITED STATES PATENT AND TRADEMARK OFFICE

CERTIFICATE OF CORRECTION

PATENT NO. : 6,289,190 B1
APPLICATION NO. : 09/389584
DATED : September 11, 2001
INVENTOR(S) : Shoji Amamiya et al.

It is certified that error appears in the above-identified patent and that said Letters Patent is hereby corrected as shown below:

COLUMN 87:
Example No. 234: "$CH_3$-" (both occurrences) should read --$CH_3O$— --.

COLUMN 91:
Example No. 244 should read

-- 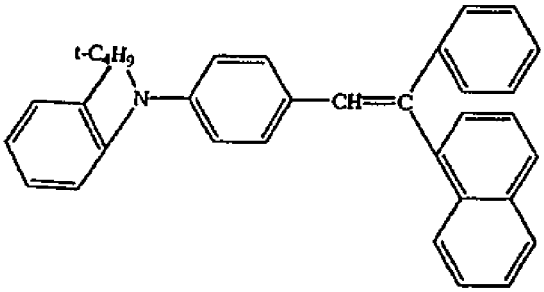

--.

Example No. 245: "CH=CH=CH=C" should read --CH=CH-CH=C--.

COLUMN 97:
Example No. 263: "i-$C_4H_9$" should read --t-$C_4H_9$--.
Example No. 264: "CH=CH=CH-C" should read --CH=CH-CH=C--.

COLUMN 99:
Example No. 269: "i-$C_4H_9$" should read --t-$C_4H_9$--.

COLUMN 102:
Example No. 272 should read

-- 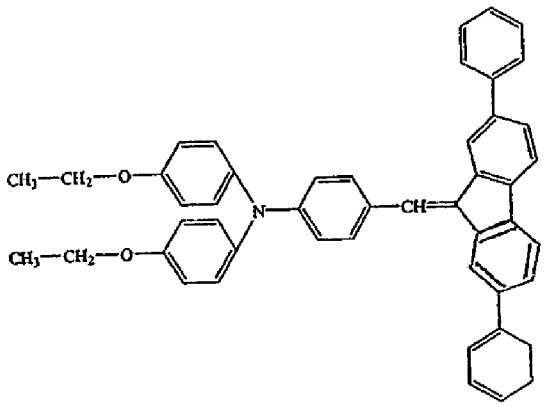

--.

UNITED STATES PATENT AND TRADEMARK OFFICE

CERTIFICATE OF CORRECTION

PATENT NO. : 6,289,190 B1
APPLICATION NO. : 09/389584
DATED : September 11, 2001
INVENTOR(S) : Shoji Amamiya et al.

It is certified that error appears in the above-identified patent and that said Letters Patent is hereby corrected as shown below:

COLUMN 101:
Example No. 274 should read

-- 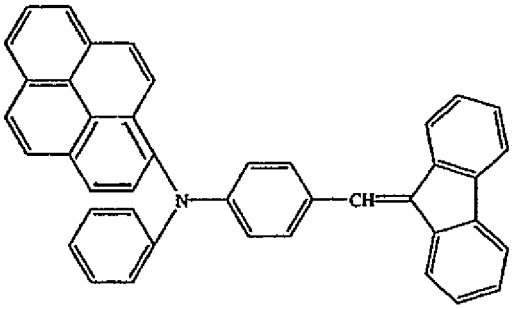

--.

COLUMN 106:
Example No. 284: "-CH-C" should read -- -CH=C--.

COLUMN 109:
Example No. 292 should read

-- 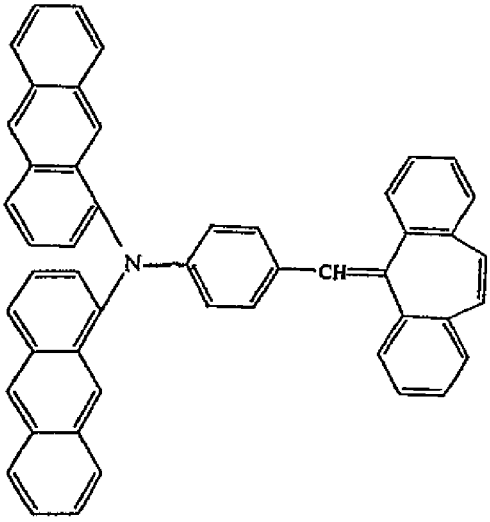

--.

COLUMN 113:
Example No. 301 "$H_3C$" should read --$H_2C$--.

UNITED STATES PATENT AND TRADEMARK OFFICE

CERTIFICATE OF CORRECTION

PATENT NO. : 6,289,190 B1
APPLICATION NO. : 09/389584
DATED : September 11, 2001
INVENTOR(S) : Shoji Amamiya et al.

It is certified that error appears in the above-identified patent and that said Letters Patent is hereby corrected as shown below:

COLUMN 115:
Example No. 306: "CH" should read --CN--.
Example No. 308 should read -- 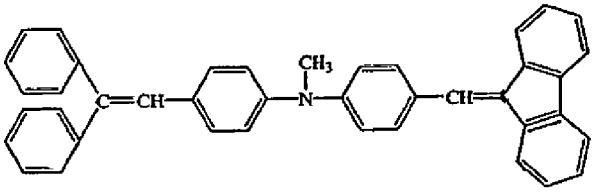 --.

COLUMN 117:
Example No. 312, "i-$C_4H_9$" should read --t-$C_4H_9$--.
Example No. 314 should read -- 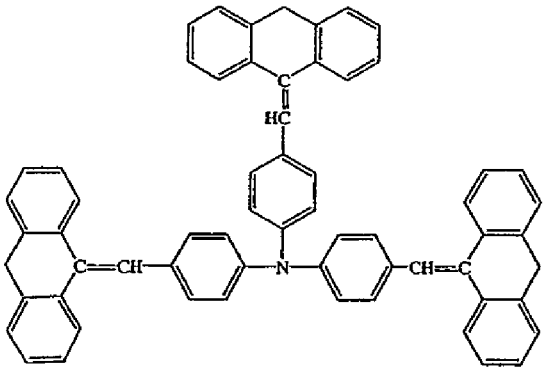 --.

COLUMN 125:
Example No. 336: "CH-N" should read --CH=N--.

COLUMN 129:
Example No. 349 should read

-- 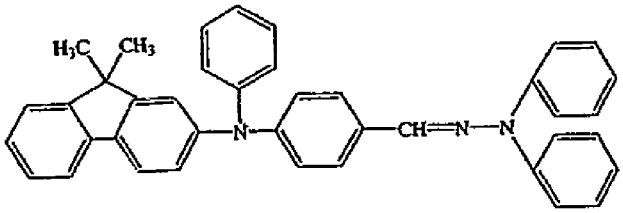 --.

UNITED STATES PATENT AND TRADEMARK OFFICE

CERTIFICATE OF CORRECTION

PATENT NO. : 6,289,190 B1
APPLICATION NO. : 09/389584
DATED : September 11, 2001
INVENTOR(S) : Shoji Amamiya et al.

It is certified that error appears in the above-identified patent and that said Letters Patent is hereby corrected as shown below:

COLUMN 131:
Example No. 352 should read

-- 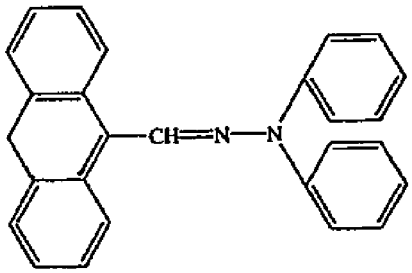 --.

Example No. 355 should read

-- 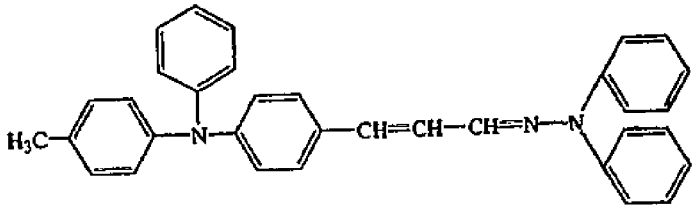 --.

COLUMN 135:
Example No. 363, "O=$CH_2$" should read --O-$CH_2$--.

COLUMN 139:
Line 31, "nay" should read --may--.

COLUMN 140:
Line 67, "bromine" should read --bromine.--.

COLUMN 141:
Line 4, "fluorenylidene" should read --fluorenylidene.--; and "include;" should read --include:--.

COLUMN 142:
Line 6, "ditto)." should read --ditto)--.
Line 21, "list" should read --lists--.

UNITED STATES PATENT AND TRADEMARK OFFICE

CERTIFICATE OF CORRECTION

PATENT NO. : 6,289,190 B1
APPLICATION NO. : 09/389584
DATED : September 11, 2001
INVENTOR(S) : Shoji Amamiya et al.

It is certified that error appears in the above-identified patent and that said Letters Patent is hereby corrected as shown below:

COLUMN 155:
Line 5, "charging bias" should read --charging-bias--.
Line 8, "contact" should read --contact- --.
Line 24, "charging" (1st occurrence) should read --charging.--.
Line 28, "Iree" should read --free--.
Line 63, "serial" should read --serial,--.

COLUMN 156:
Line 52, "apparatus" should read --apparatus.--.
Line 54, "soling" should read --soiling--.

COLUMN 157:
Line9, "9" should read --9.--.
Line 17, "mm-dia" should read --mm-dia.--.
Line 21, "m-thick" should read --$\mu$m-thick--.
Line 62, "nip On" should read --nip. On--.

COLUMN 158:
Line 2, "K.K.:" should read --K.K.;--.
Line 8, "In" should read --in--.
Line 25, "peripheral" should read --"peripheral--, and "ratio" should read --ratio"--.

COLUMN 159:
Line 19, "characteristics" should read --characteristic,--.
Table 1: "c" should read --C--.

COLUMN 160:
Line 63, "In" should read --in--.

COLUMN 161:
Line 13, "exhibited" should read --exhibit--.
Line 58, "of the" should read --of the photosensitive member) in a subsequent development--.

COLUMN 162:
Line 20, "effect" should read --effected--.
Line 54, "Initial" should read --initial--.
Line 55, "In" should read --in--.

UNITED STATES PATENT AND TRADEMARK OFFICE

CERTIFICATE OF CORRECTION

PATENT NO. : 6,289,190 B1
APPLICATION NO. : 09/389584
DATED : September 11, 2001
INVENTOR(S) : Shoji Amamiya et al.

It is certified that error appears in the above-identified patent and that said Letters Patent is hereby corrected as shown below:

COLUMN 163:
Line 2, “is” (2nd occurrence) should be deleted.
Line 9, “h,” should read --n,--.
Line 21, “ing promoter” should read --ing-promoter--; and “charging” should read --charging- --.
Line 22, “charging” should read --charging- --.
Line 24, “charging-roller” should read --charging roller--.
Line 29, “materials” should read --material,--.
Line 43, “Is” should read --is--.

COLUMN 164:
Line 1, “tonically” should read --ionically--.
Line 15, “charging bias voltage” should read --charging-bias-voltage--.
Line 16, “charging promoter” should read --charging-promoter--.
Line 17, “I” should read --l--.
Line 28, “charging” should read --charging- --.
Line 39, “charging” should read --charging- --.
Line 65, “charging-roller” should read --charging roller--.
Line 66, “charging” should read --charging- --.

COLUMN 165:
Line 1, “contact” should read --contact- --.
Line 3, “charged” should read --charged.--.
Line 6, “charging” should read --charging- --.
Line 32, “infection-” should read --injection- --.
Line 47, “surface most” should read --surfacemost--.
Line 59, “and” should read --and a--.

COLUMN 167:
Line 33, “<oxidation” should read --<Oxidation--.
Line 43, “mmol” should read --mmol.--.

COLUMN 168:
Line 58, “min.” should read --min.,--.

COLUMN 169:
Line 5, “charge-generation” should read --charge-generation,--.
Line 22, “of” should read --of the--.
Line 65, “liquid” should read --liquid.--.

UNITED STATES PATENT AND TRADEMARK OFFICE

CERTIFICATE OF CORRECTION

PATENT NO. : 6,289,190 B1
APPLICATION NO. : 09/389584
DATED : September 11, 2001
INVENTOR(S) : Shoji Amamiya et al.

It is certified that error appears in the above-identified patent and that said Letters Patent is hereby corrected as shown below:

COLUMN 170:
Line 6, “charge transport” should read --charge-transport--.
Line 27, “103” should read --$10^3$--.

COLUMN 171:
Line 42, “rotate” should read --rotated in--.
Line 45, “charging” should read --charging- --.

COLUMN 172:
Line 28, “Examples” should read --examples--; and “Comparative” should read --comparative--.
Line 29, “Examples.” should read --examples.--.

COLUMN 174:
Line 44, “Charge” should read --Charge- --.

COLUMN 178:
Line 1, “89-91” should read --85-91--.

COLUMN 179:
Line 48, “CTE4” should read --CTB4--.

COLUMN 180:
Line 18, “In” should read --in--.

COLUMN 181:
Line 27, “Compound” should read --compound--; and “NO” should read --No.--.
Line 28, “Charge” should read --Charge- --.

COLUMN 182:
Line 39, “polyearbonate” should read --polycarbonate--.

COLUMN 184:
Line 62, “charging” should read --charging- --.
Line 63, “oping” should read --oping- --.
Line 67, “since” should read --sine--.

UNITED STATES PATENT AND TRADEMARK OFFICE

CERTIFICATE OF CORRECTION

PATENT NO. : 6,289,190 B1
APPLICATION NO. : 09/389584
DATED : September 11, 2001
INVENTOR(S) : Shoji Amamiya et al.

It is certified that error appears in the above-identified patent and that said Letters Patent is hereby corrected as shown below:

COLUMN 185:
Line 2, “of f a” should read --off a--.
Line 6, “laser beam scanning” should read --laser-beam-scanning--.
Line 11, “light” should read --light- --.
Line 23, “contact-type” should read --contact type--.
Line 25, “contact-type” should read --contact type--.
Line 26, “contact-type” should read --contact type--.
Line 30, “transfer” should read --transfers--.
Line 34, “Is” should read --is--.
Line 60, “means;” should read --means,--.

COLUMN 186:
Line 6, “resent” should read --resented--.
Line 36, “the” should read --to--.

COLUMN 187:
Line 10, “$CR_{11}$~” should read --$CR_{11}$- --.

COLUMN 188:
Line 34, “iS” should read --is--.

COLUMN 189:
Line 23, “below;” should read --below:--.
Line 46, “capable” should read --capable of--.

COLUMN 190:
Line 1, “pg” should read --p/q--.
Line 50, “member;” should read --member,--.
Line 57, “ber;” should read --ber, and--.
Line 61, “of” should read --of an--.
Line 65, “28,” should read --29,--.

COLUMN 192:
Line 18, “of, having” should read --of having a--.
Line 56, “ring,” should read --ring;--.

COLUMN 193:
Line 2, “$A_{18}$” should read --$Ar_{18}$--.

UNITED STATES PATENT AND TRADEMARK OFFICE

CERTIFICATE OF CORRECTION

PATENT NO. : 6,289,190 B1
APPLICATION NO. : 09/389584
DATED : September 11, 2001
INVENTOR(S) : Shoji Amamiya et al.

It is certified that error appears in the above-identified patent and that said Letters Patent is hereby corrected as shown below:

COLUMN 194:
Line 32, "capable" should read --capable of--.
Line 51, "Capable" should read --capable--.
Line 64, "29," should read --45,--.

Signed and Sealed this

Eleventh Day of September, 2007

JON W. DUDAS
*Director of the United States Patent and Trademark Office*